US005679115A

United States Patent [19]

Fritzsche et al.

[11] Patent Number: 5,679,115

[45] Date of Patent: Oct. 21, 1997

[54] RADIATION-INDUCED FIXATION OF DYES

[75] Inventors: Katharina Fritzsche, Weil am Rhein, Germany; Peter Aeschlimann, Allschwil; Peter Scheibli, Bottmingen, both of Switzerland

[73] Assignee: Ciba-Geigy Corporation, Tarrytown, N.Y.

[21] Appl. No.: 495,533

[22] PCT Filed: Jan. 17, 1994

[86] PCT No.: PCT/EP94/00104

§ 371 Date: Jul. 28, 1995

§ 102(e) Date: Jul. 28, 1995

[87] PCT Pub. No.: WO94/18381

PCT Pub. Date: Aug. 18, 1994

[30] Foreign Application Priority Data

Feb. 1, 1993 [CH] Switzerland ..... 293/93

[51] Int. Cl.[6] ..... D06P 1/38; D06P 5/20

[52] U.S. Cl. ..... 8/444; 8/499; 8/606; 8/552; 8/661; 8/662; 8/917; 8/918; 8/922; 8/924; 8/927; 8/928; 8/405; 8/543

[58] Field of Search ..... 8/405, 444, 499, 8/606, 662, 661, 658, 917, 918, 922, 924, 927, 928, 532, 543–549, 552

[56] References Cited

U.S. PATENT DOCUMENTS 5,006,129 4/1991 Martini et al. ..... 8/554
5,230,711 7/1993 Kerl et al. ..... 8/652
5,238,465 8/1993 Fritzsche ..... 8/444
5,409,504 4/1995 Fritzsche ..... 8/444

OTHER PUBLICATIONS

Walsh et al., Textile Chemist and Colorist, vol. 10, No. 10, (Oct. 1978).
Chem Abstracts, vol. 117, No. 8, 70513c ab of JP 04 95 053, Mar. 1992.
Chem. Abstracts, vol. 98, No. 14 108842p Abstract of JP 57–167455 Oct. 1982.
Chem. Abstracts, vol. 95, No. 24, 205340u of JP 56 096 76, Aug. 1981.
Journal of Polymer Science, Polymer Chemistry Ed., vol. 29, 1991, pp. 1319–1327; Fouassier et al.

*Primary Examiner*—Margaret Einsmann
*Attorney, Agent, or Firm*—Kevin T. Mansfield; Edward McC Roberts

[57] ABSTRACT

Process for dyeing or printing organic material, in particular fibre material which comprises applying dyes containing no polymerizable double bond together with at least one colorless cationic compound containing at least one polymerizable double bond and, if desired, one or more colorless nonionic compounds containing at least one polymerizable double bond and, if desired, further auxiliaries to the fibre material and then fixing them by means of ionizing radiation, or applying dyes containing no polymerizable double bond together with at least one colorless cationic compound containing one polymerizable double bond, and if desired, one or more colorless nonionic compounds containing at least one polymerizable double bond and at least one photoinitiator and also, if desired, further auxiliaries to the fibre material and then fixing them by means of UV light.

39 Claims, No Drawings

RADIATION-INDUCED FIXATION OF DYES

The invention relates to a process for fixing dyes containing no polymerizable double bond to organic materials in the presence of colourless polymerizable compounds by means of ionizing radiation or by irradiation with UV light in the presence of photoinitiators.

It is known that dyes containing activated unsaturated groups can be fixed on organic material, in particular on fibre material, by the action of ionizing radiation. Compared with the conventional processes for fixing dyes, in particular reactive dyes, fixation by radiation is notable for the fact that, for example, fixing baths and fixing agents can be completely avoided. A further advantage is the simultaneous application and fixation of dye and textile finishes, for example for improving antistatic properties, reducing soil retention and improving crease resistance. Furthermore, to improve the crosslinking between dye and fibre, polymerization-capable compounds were added to the dyeing liquor and the dry material was irradiated for the purpose of fixation. The object of the present invention is consequently to provide a fixation process which offers the advantages of radiation-induced fixation for dyes containing no polymerizable double bond, too.

It has now been found that this object is achieved by the below-described, inventive process.

The present invention accordingly provides a process for dyeing or printing organic material, in particular fibre material, which comprises applying dyes containing no polymerizable double bond together with at least one colourless cationic compound containing at least one polymerizable double bond and, if desired, one or more colourless nonionic compounds containing at least one polymerizable double bond and, if desired, further auxiliaries to the fibre material and then fixing them by means of ionizing radiation, or applying dyes containing no polymerizable double bond together with at least one colourless cationic compound containing at least one polymerizable double bond and, if desired, one or more colourless nonionic compounds containing at least one polymerizable double bond and at least one photoinitiator and also, if desired, further auxiliaries to the fibre material and then fixing them by means of UV light.

The process of the invention is notable for the fact that the dye and the colourless cationic compound can be applied together, so that only a single dyebath or dyeing liquor is required and a distinctly higher degree of fixation is achieved than in known processes not involving the use of colourless cationic polymerizable compounds. However, the colourless cationic compound can also be applied separately before or after the actual dyeing process. Another advantage is that it is possible to use such a low radiation dosage that less dye is destroyed, which leads to a dyeing of high brilliance.

The process of fixation consists in irradiating a fibre material to be dyed, for example a textile fibre material, after the treatment with a dye containing no polymerizable double bond and in the presence of at least one colourless cationic compound containing at least one polymerizable double bond and, if desired, one or more colourless nonionic compound(s) containing at least one polymerizable double bond and also, if desired, further auxiliaries in the wet, moist or dry state with ionizing radiation for a short period or in the presence of at least one photoinitiator with UV light. The treatment of the fibre material with a dye of the type defined can take place by one of the usual methods, for example in the case of textile fabric by impregnation with a dye solution in an exhaust bath or by spraying onto the fabric or by padding with a padding solution or by printing, for example on a roller printing machine, or by means of the ink-jet printing technique.

Ionizing radiation is to be understood as meaning radiation which can be detected by means of an ionization chamber. It consists either of electrically charged, directly ionizing particles which produce ions in gases along their trajectory by collision or of uncharged, indirectly ionizing particles or photons which produce directly ionizing charged secondary particles in matter, such as the secondary electrons of X-rays or gamma-rays or the recoil nuclei (in particular protons) of fast neutrons; slow neutrons which are capable of producing high-energy charged particles by nuclear reactions either directly or via photons from ($\beta,\gamma$) processes are also indirectly ionizing particles. Suitable heavy charged particles are photons, atomic nuclei or ionized atoms. Of particular importance for the process of the invention are light charged particles, for example electrons. Suitable X-ray radiation is both the bremsstrahlung and the characteristic radiation. An important corpuscular radiation of heavy charged particles is $\alpha$-radiation.

The ionizing radiation can be generated by one of the customary methods. For instance, spontaneous nuclear transformations and also nuclear reactions (enforced nuclear transformations) can be used for generating this radiation. Accordingly, suitable radiation sources are natural or induced radioactive materials and in particular nuclear reactors. The radioactive fission products formed in such reactors by nuclear fission are a further important source of radiation.

A further suitable method of generating radiation is by means of an X-ray tube.

Of particular importance are rays consisting of particles accelerated in electric fields. Suitable radiation sources are in this respect thermion, electron-impact ion, low-voltage arc discharge ion, cold cathode ion and high-frequency ion sources.

Of particular importance for the process of the present invention are electron beams. They are produced by accelerating and focusing electrons which are emitted from a cathode by thermionic, field or photoemission and by electron or ion bombardment. Ion sources are electron guns and accelerators of customary design. Examples of radiation sources are disclosed in the literature, for example International Journal of Electron Beam & Gamma Radiation Processing, in particular 1/89 pages 11–15; Optik, 77 (1987), pages 99–104.

Suitable radiation sources for electron beams are furthermore $\beta$-emitters, for example strontium-90.

Other technically advantageously usable ionizing rays are $\gamma$-rays which can be easily produced using, in particular, caesium-137 or cobalt-60 isotope sources.

When ultraviolet radiation is used, a photoinitiator must be present. The photoinitiator absorbs the radiation to produce free radicals which initiate the polymerization. Examples of photoinitiators or photosensitizers used according to the invention are carbonyl compounds, such as 2,3-hexanedione, diacetylacetophenone, benzoin and benzoin ethers, such as dimethyl derivatives, ethyl derivatives and butyl derivatives, for example 2,2-diethoxyacetophenone and 2,2-dimethoxyacetophenone, benzophenone or a benzophenone salt and phenyl 1-hydroxycyclohexyl ketone or a ketone of the formula

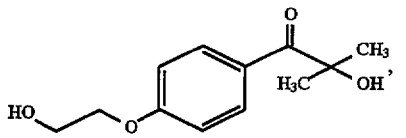

(80)

benzophenone in combination with a catalyst such as triethylamine, N,N'-dibenzylamine and dimethylaminoethanol and benzophenone plus Michler's ketone; acylphosphine oxides; nitrogen-containing compounds, such as diazomethane, azobisisobutyronitrile, hydrazine, phenylhydrazine and trimethylbenzylammonium chloride; and sulfur-containing compounds, such as benzenesulfonate, diphenyl disulfide and tetramethylthiuram disulfide. photosensitizers of this type are used by themselves or in a combination with one another.

The amount of photoinitiators in the dyeing components applied directly before irradiation is 0.01–20%, preferably 0.1 to 5%, relative to the total amount of the colourless polymerizable compounds used.

Not only water-soluble but also water-insoluble photosensitizers are suitable. Moreover, copolymerizable photoinitiators such as are mentioned, for example, in "Polymers Paint Colour Journal, 180, p. 42f (1990)" are particularly advantageous.

Cationic photoinitiators, such as triarylsulfonium salts, diaryliodonium salts, diaryliron complexes or, in general, structures such as described in "Chemistry and Technology of UV & EB Formulation for Coatings, Inks & Paints" Volume 3, edited by SITA Technology Ltd., Gardiner House, Broomhill Road, London, 1991 are also suitable.

Acylphosphine oxides, for example 2,4,6-trimethylbenzoyldiphenylphosphine oxide, or photoinitiators of the formula

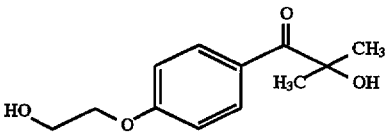

(80)

or

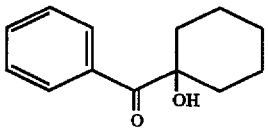

(80a)

are preferably used, or a photoinitiator of the formula

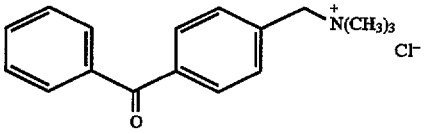

(80b)

is used together with a co-initiator of the formula (80), (80a ) or

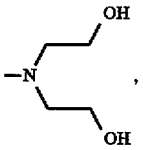

(80c)

or benzophenone is used together with a co-initiator of the formula (80), (80b ) or (80c).

Particularly preferably, a photoinitiator of the formula

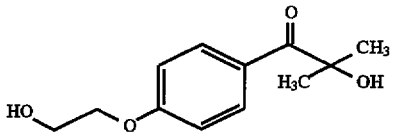

(80)

is used.

Moreover, in addition to the photoinitiator, there may also be added polymerization co-initiators, such as peroxides or aliphatic azo compounds which are activated by the heat formed upon irradiation or by an additional hot-air process step and initiate polymerization.

The customary free-radical forming catalysts can be used for polymerization or copolymerization. These include hydrazine derivatives, such as hydrazine hydrochloride, organometallic compounds, such as tetraethyllead, and in particular aliphatic azo compounds, such as α,α'-azobisisobutyronitrile, and organic peroxides, chloroacetyl peroxide, trichloroacetyl peroxide, benzoyl peroxide, chlorobenzoyl peroxide, benzoyl acetyl peroxide, propionyl peroxide, fluorochloropropionyl peroxide, lauryl peroxide, cumene hydroperoxide, cyclohexanone hydroperoxide, tert-butyl hydroperoxide, di-tert-butyl peroxide, di-tert-amyl peroxide and p-menthane hydroperoxide, and also inorganic peroxide compounds, such as sodium peroxide, alkali metal percarbonates, alkali metal persulfates or alkali metal perborates, and in particular hydrogen peroxide, which may advantageously replace the expensive benzoyl peroxide. The amount of catalysts to be added depends in a known manner on the desired course of the reaction or on the desired properties of the polymer. Advantageously, about 0.05 to 10% by weight, relative to the total mount of binder or binder mixture, are added.

The UV light to be used is radiation whose emission is between 200 and 450 nm, in particular between 210 and 400 nm. The radiation is preferably produced artificially by means of high-, medium- or low-pressure mercury vapour lamps, halogen lamps, metal halide lamps, xenon lamps or tungsten lamps, carbon arc lamps or fluorescent lamps, H and D lamps, superactinic fluorescent tubes and lasers.

Advantageously, capillary high-pressure mercury lamps or high-pressure mercury lamps or low-pressure mercury lamps are used. High-pressure mercury lamps and medium-pressure mercury lamps, which may also be doped with iron halide or gallium halide, are very particularly advantageous. These lamps can also be excited by means of microwaves or operated in pulsed form in order to concentrate the radiation in peaks. With xenon lamps, pulsed operation is also possible for the case where a higher proportion of UV light of longer wavelength is required.

In general, customary UV radiation sources such as described in "Chemistry & Technology of UV & EB Formulation for Coatings, Inks and Paints", Volume 1, edited by SITA Technology, Gardiner House, Broomhill Road, London, 1991, are suitable.

The exact time of irradiation of the dyes or prints will depend on the luminosity of the UV source, the distance from the light source, the type and amount of photosensitizer and the UV light transmissivity of the formulation and the textile substrate.

Customary times of irradiation are 1 second to 20 minutes, preferably 5 seconds to 2 minutes. Fixation can be stopped by interrupting the irradiation with light, so that it can also be carried out intermittently.

Irradiation can also be carried out under inert gas in order to prevent inhibition by oxygen, but this precaution is usually not necessary. Inhibition by oxygen can also be effectively suppressed by addition of so-called anti-blocking agents, which are amines and specifically in particular also amino acrylates.

Suitable are water-soluble dyes which are characterized in that they carry no polymerizable double bond.

Water-soluble dyes are to be understood as meaning in particular those which contain chromophores having sulfo groups.

Suitable dyes include for example direct dyes and reactive dyes.

Direct dyes are to be understood as meaning for example those dyes described in the Colour Index, 3rd Edition (3rd Revision 1987 additions and amendments from 1 to 85 inclusive) as "Direct Dyes".

Reactive dyes are to be understood as meaning those dyes which contain one or more reactive groups other than vinyl, allyl, acryloyl, methacryloyl and haloacryloyl groups.

Reactive groups are to be understood as meaning fibre-reactive radicals which are capable of reacting with the hydroxyl groups of cellulose, the amino, carboxyl, hydroxyl and thiol groups of wool and silk or with the amino and possibly carboxyl groups of synthetic polyamides to form covalent chemical bonds. The reactive groups are generally bonded to the dye residue directly or via a bridge member. Suitable reactive groups include for example those which contain at least one detachable substituent bonded to an aliphatic, aromatic or heterocyclic radical or wherein the radicals mentioned contain a radical suitable for reaction with the fibre material, for example a triazine radical. Suitable reactive groups include for example radicals containing substituted carbo- or heterocyclic 4-, 5- or 6-rings containing a detachable atom or group. Suitable heterocyclic radicals include for example those which contain at least one detachable substituent bonded to a heterocyclic radical; inter alia those which contain a reactive substituent bonded to a 5- or 6-membered heterocyclic ring as to a monoazine, diazine, triazine, pyridine, pyrimidine, pyridazine, pyrazine, thiazine, oxazine or asymmetrical or symmetrical triazine ring or to such a ring system which contains one or more fused-on aromatic rings such as a quinoline, phthalazine, cinnoline, quinazoline, quinoxaline, acridine, phenazine and phenanthridine ring system. Furthermore, the heterocyclic fibre-reactive radicals mentioned may contain, via a direct bond or via a bridge member, further fibre-reactive radicals, for example the above-enumerated radicals.

Detachable atoms and groups include amongst others for example halogen, such as fluorine, chlorine or bromine, ammonium including hydrazinium, sulfato, thiosulfato, phosphato, acetoxy, propionoxy or carboxypyridinium.

A wide range of radicals are suitable for use as bridge member between the dye radical and the fibre-reactive radical or as bridge member between two fibre-reactive radicals, besides the direct bond. The bridge member is for example an aliphatic, aromatic or heterocyclic radical; furthermore, the bridge member can also be composed of various radicals of that type. The bridge member generally contains at least one functional group, for example the carbonyl group or the amino group, which amino group may if desired be further substituted by unsubstituted or halogen-, hydroxyl-, cyano-, $C_1$–$C_4$alkoxy-, $C_1$–$C_4$alkoxycarbonyl-, carboxyl-, sulfamoyl-, sulfo- or sulfato-substituted $C_1$–$C_4$alkyl. A suitable aliphatic radical is for example an alkylene radical having 1 to 7 carbon atoms or its branched isomers. The carbon chain of the alkylene radical may be interrupted by a hetero atom, for example an oxygen atom. A suitable aromatic radical is for example a phenyl radical, which may be substituted by $C_1$–$C_4$alkyl, e.g. methyl or ethyl, $C_1$–$C_4$alkoxy, e.g. methoxy or ethoxy, halogen, e.g. fluorine, bromine or in particular chlorine, carboxyl or sulfo, and a suitable heterocyclic radical is for example a piperazine radical. Examples of such bridge members are the following radicals:

$$—CO—N(R_1)—(CH_2)_{2\text{-}3}—;\ —CO—N(R_1)—(CH_2)_2—O—(CH_2)_2—;$$

$$—N(R_1)—CO—(CH_2)_3—;\ —N(R_1)—;$$

$$—N(R_1)—(CH_2)_2—O—(CH_2)_2—;\ —O—(CH_2)_2—;$$

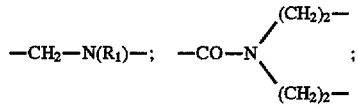

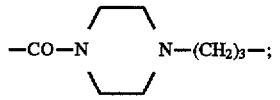

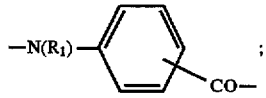

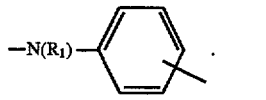

In the above-indicated formulae $R_1$ is hydrogen or $C_1$–$C_4$alkyl which may be substituted by halogen, hydroxyl, cyano, $C_1$–$C_4$alkoxy, $C_1$–$C_4$alkoxycarbonyl, carboxyl, sulfamoyl, sulfo or sulfato.

Examples of fibre-reactive radicals are the following radicals: precursors of the derivatives of the acryloyl radical such as β-chloro- or β-bromopropionyl, 3-phenylsulfonylpropionyl, 3-methylsulfonylpropionyl, 2-chloro-3-phenylsulfonylpropionyl, 2,3-dichloropropionyl, 2,3-dibromopropionyl and also 2-fluoro-2-chloro-3,3-difluorocyclobutane-1-carbonyl, 2,2,3,3-tetrafluorocyclobutane-1-carbonyl or -1-sulfonyl, chloroacetyl, bromoacetyl, 3-(β-chloroethylsulfonyl) butyryl, 5-(β-chloroethylsulfonyl)caproyl and also 4-fluoro-3-nitrobenzoyl, 4-fluoro-3-nitrophenylsulfonyl, 4-fluoro-3-methylsulfonylbenzoyl, 4-fluoro-3-cyanobenzoyl, 2-fluoro-5-methylsulfonylbenzoyl.

The following fibre-reactive radicals may also be mentioned by way of example: 2-alkoxy-4-chlorotriazin-6-yl, such as 2-methoxy- or ethoxy-4-chlorotriazin-6-yl, 2-(phenylsulfonylmethoxy)-4-chlorotriazin-6-yl, 2-aryloxy and substituted aryloxy-4-chlorotriazin-6-yl, such as 2-phenoxy-4-chlorotriazin-6-yl, 2-(p-sulfophenyl)-oxi-4-chlorotriazin-6-yl, 2-(o-,m- or p-methyl- or methoxy-phenyl)-oxi-4-chlorotriazin-6-yl, 2-alkylmercapto- or 2-arylmercapto- or 2-(substituted aryl)-mercapto-4-chlorotriazin-6-yl, such as 2-methylmercapto-4-chlorotriazin-6-yl, 2-β-hydroxyethyl-mercapto-4-chlorotriazin-6-yl, 2-phenylmercapto-4-chlorotriazin-6-yl, 2-methyl-4-chlorotriazin-6-yl, 2-phenyl-4-chlorotriazin-6-yl, mono-, di- or trihalopyrimidinyl radicals, such as 2,4-dichloropyrimidin-6-yl, 2,4,5-trichloropyrimidin-6-yl, 2,4-dichloro-5-nitro- or -5-methyl- or -5-carboxymethyl- or -5-carboxy- or -5-cyano- or -5-sulfo- or -5-mono-, -di- or -trichloromethyl- or-5-carboalkoxy-pyrimidin-6-yl, 2,6-dichloropyrimidine-4-carbonyl, 2,4-dichloropyrimidine-5-carbonyl, 2-chloro-4-methylpyrimidine-5-carbonyl, 2-methyl-4-chloropyrimidine-5-carbonyl, 2-methylthio-4-fluoropyrimidine-5-carbonyl, 6-methyl-2,4-dichloropyrimidine-5-carbonyl, 2,4,6-trichloropyrimidine-5-carbonyl, 2,4-dichloropyrimidine-5-sulfonyl, 2,4-difluoro-5-chloropyrimidin-6-yl, 2,3-dichloroquinoxaline-6-carbonyl, 2,3-dichloroquinoxaline-6-sulfonyl, 1,4-dichlorophthalazine-6-sulfonyl or -6-carbonyl.

Interesting reactive groups are 1,3,5-triazine radicals of the formula

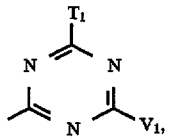

(1)

where $T_1$ is fluorine, chlorine or carboxypyridinium and suitable for use as substituents $V_1$ on the triazine ring are in particular: fluorine or chlorine and also —$NH_2$, alkylamino, N,N-dialkylamino, cycloalkylamino, N,N-dicycloalkylamino, aralkylamino, arylamino groups, mixed-substituted amino groups, such as N-alkyl-N-cyclohexylamino and N-alkyl-N-arylamino groups, also amino groups which contain heterocyclic radicals which may contain further fused-on carbocyclic rings, and amino groups wherein the amino nitrogen atom is part of an N-heterocyclic ring which if desired contains further hetero atoms, and also hydrazino and semicarbazido. The above-mentioned alkyl radicals can be straight-chain or branched, low molecular weight or high molecular weight, preferably alkyl radicals having 1 to 6 carbon atoms; suitable cycloalkyl, aralkyl and aryl radicals are in particular cyclohexyl, benzyl, phenethyl, phenyl and naphthyl radicals; heterocyclic radicals are in particular furan, thiophene, pyrazole, pyridine, pyrimidine, quinoline, benzimidazole, benzothiazole and benzoxazole radicals; and suitable amino groups in which the amino nitrogen atom is part of an N-heterocyclic ring are preferably radicals or six-membered N-heterocyclic compounds which may contain nitrogen, oxygen or sulfur as further hetero atoms. The above-mentioned alkyl, cycloalkyl, aralkyl and aryl radicals, the heterocyclic radicals and also the N-heterocyclic radicals can be further substituted, for example by halogen, such as fluorine, chlorine or bromine, nitro, cyano, trifluoromethyl, sulfamoyl, carbamoyl, $C_1$–$C_4$alkyl, $C_1$–$C_4$alkoxy, acylamino groups, such as acetylamino or benzoylamino, ureido, hydroxyl, carboxyl, sulfomethyl or sulfo. Examples of such amino groups are: —$NH_2$, methylamino, ethylamino, propylamino, isopropylamino, butylamino, hexylamino, β-methoxyethylamino, γ-methoxyethylamino, β-ethoxyethylamino, N,N-dimethylamino, N,N-diethylamino, β-chloroethylamino, β-cyanoethylamino, γ-cyanopropylamino, β-carboxyethylamino, sulfomethylamino, β-sulfoethylamino, β-hydroxyethylamino, N,N-di-β-hydroxyethylamino, γ-hydroxypropylamino, benzylamino, phenethylamino, cyclohexylamino, phenylamino, toluidino, xylidino, chloroanilino, anisidino, phenethidino, N-methyl-N-phenylamino, N-ethyl-N-phenylamino, N-β-hydroxyethyl-N-phenylamino, 2-, 3- or 4-sulfoanilino, 2,5-disulfoanilino, 4-sulfomethylanilino, N-sulfomethylanilino, 2-, 3- or 4-carboxyphenylamino, 2-carboxy-5-sulfophenylamino, 2-carboxy-4-sulfophenylamino, 4-sulfo-1-naphthylamino, 3,6-disulfo-1-naphthylamino, 3,6,8-trisulfo-1-naphthylamino, 4,6,8-trisulfonaphthyl-1-amino, 1-sulfo-2-naphthylamino, 1,5-disulfo-2-naphthylamino, 6-sulfo-2-naphthylamino, morpholino, piperidino, piperazino, hydrazino and semicarbazido.

Preferably $V_1$ in the radical of the formula (1) is fluorine, chlorine, —$NH_2$, a $C_1$–$C_6$alkylamino, N,N-di-$C_1$–$C_6$alkylamino, cyclohexylamino, N,N-dicyclohexylamino, benzylamino, phenethylamino, phenylamino, naphthylamino, N—$C_1$–$C_6$alkyl-N-cyclohexylamino or N—$C_1$–$C_6$alkyl-N-phenylamino radical, or morpholino, piperidino, piperazino, hydrazino or semicarbazido, or an amino group substituted by a furan, thiophene, pyrazole, pyridine, pyrimidine, quinoline, benzimidazole, benzothiazole or benzoxazole radical. The alkyl, cycloalkyl, aralkyl and aryl radicals mentioned and also the heterocyclic radicals can be further substituted as indicated under the formula (1).

Particularly preferably $V_1$ in the radical of the formula (1) is fluorine, chlorine, phenylamino or N—$C_1$–$C_4$alkyl-N-phenylamino, wherein the phenyl rings are if desired substituted by halogen, such as fluorine, chlorine or bromine, nitro, cyano, trifluoromethyl, sulfamoyl, carbamoyl, $C_1$–$C_4$alkyl, $C_1$–$C_4$alkoxy, acylamino groups, such as acetylamino or benzoylamino, ureido, hydroxyl, carboxyl, sulfomethyl or in particular sulfo.

The triazinyl radicals can also be linked to further fibre-reactive radicals, in which case the further fibre-reactive radicals are generally bonded to the halotriazinyl radical via a bridge member. Suitable further fibre-reactive radicals and also bridge members include inter alia for example those mentioned above.

Interesting fibre-reactive radicals include further those of the formula

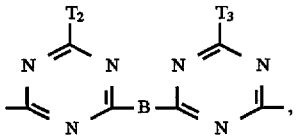

(2)

where $T_2$ and $T_3$ are independently of each other fluorine, chlorine or carboxypyridinium and B is a bridge member.

A suitable bridge member B is for example a radical of the formula

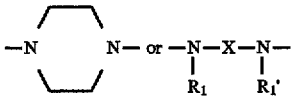

where $R_1$ and $R_1'$ are independently of each other hydrogen or unsubstituted or halogen-, hydroxy-, cyano-, $C_1$–$C_4$alkoxy-, $C_1$–$C_4$alkoxycarbonyl, carboxyl-, sulfamoyl-, sulfo- or sulfato-substituted $C_1$–$C_4$alkyl and X is an unsubstituted or hydroxy-, sulfo-, sulfato-, $C_1$–$C_4$alkoxy-, carboxyl- or halogen-substituted $C_2$–$C_6$alkylene or $C_5$–$C_9$cycloalkylene radical or an unsubstituted or $C_1$–$C_4$alkyl-, $C_1$–$C_4$alkoxy-, sulfo-, halogen- or carboxyl-substituted phenylene, biphenylene or naphthylene radical.

Further interesting reactive groups are those of the formula

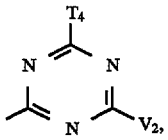

(3)

where $T_4$ is fluorine, chlorine or carboxypyridinium and $V_2$ is a radical of the formula

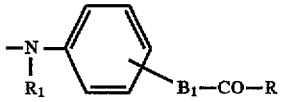

(4)

where $R_1$ is hydrogen or $C_1$–$C_4$alkyl which may be substituted by halogen, hydroxyl, cyano, $C_1$–$C_4$alkoxy, $C_1$–$C_4$alkoxycarbonyl, carboxyl, sulfamoyl, sulfo or sulfato; $B_1$ is a direct bond or a radical $-(CH_2)_n$- or $-O-(CH_2)_n$-; n is 1, 2, 3, 4, 5 or 6; and R is a radical of the formula $$-\underset{\underset{V}{|}}{N}-(alk)-CH_2-SO_2-Z \quad (4a)$$

$$-\overset{\overset{T}{|}}{\underset{\underset{R'}{|}}{N}}-(alk)-CH_2-SO_2-Z \quad (4b)$$

$$-\underset{\underset{R'}{|}}{N}-(CH_2)_p-O-(CH_2)_q-SO_2-Z \quad (4c)$$

$$-\underset{\underset{R'}{|}}{N}-(alk')-NH-(alk')-SO_2-Z \quad (4d)$$

$$-\underset{\underset{R'}{|}}{N}-(CH_2)_r-N[(CH_2)_s-SO_2-Z]_2 \quad (4e)$$

$$-N[(CH_2)_s-SO_2-Z]_2 \quad (4f)$$

or

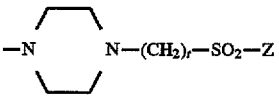

(4g)

where R' is hydrogen or $C_1$–$C_6$alkyl, alk is an alkylene radical having 1 to 7 carbon atoms, T is hydrogen, halogen, hydroxyl, sulfato, carboxyl, cyano, $C_1$–$C_4$alkanoyloxy, $C_1$–$C_4$alkoxycarbonyl, carbamoyl or a radical $-SO_2-Z$, V is hydrogen, substituted or unsubstituted $C_1$–$C_4$alkyl or a radical of the formula $$-(alk)-\overset{\overset{T}{|}}{CH}-CH_2-SO_2-Z \quad (4h)$$

where (alk) is as defined above, alk' are independently of each other polymethylene radicals having 2 to 6 carbon atoms, Z is β-sulfatoethyl, β-thiosulfatoethyl, β-phosphatoethyl, β-acyloxyethyl or β-haloethyl, p, q, r and t are independently of one another 1, 2, 3, 4, 5 or 6 and s is 2, 3, 4, 5 or 6; and the benzene ring in the formula (4) may contain further substituents; or where $V_2$ is directly bonded to the triazine ring and has the formula (4a), (4b), (4c), (4d), (4e), (4f) or (4g) where R', T, alk, V, Alk', Z, p, q, r, s and t are each as defined above; or where $V_2$ is a radical of the formula

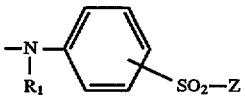

(4')

where $R_1$ and Z are each as defined above and the benzene ring can be further substituted.

Further possible substituents of benzene rings of the compounds of the formulae (4) and (4') are halogen, such as fluorine, chlorine or bromine, nitro, cyano, trifluoromethyl, sulfamoyl, carbamoyl, $C_1$–$C_4$alkyl, $C_1$–$C_4$alkoxy, acylamino groups, such as acetylamino or benzoylamino, ureido, hydroxyl, carboxyl, sulfomethyl and sulfo.

The radical $B_1$ contains from 1 to 6, preferably from 1 to 4, carbon atoms; examples of $B_1$ are: methylene, ethylene, propylene, butylene, methyleneoxy, ethyleneoxy, propyleneoxy and butyleneoxy. If B is a radical $-O-(CH_2)_n$-, $B_1$ is bonded to the benzene ring by the oxygen atom. $B_1$ is preferably a direct bond.

Z as β-haloethyl is in particular β-chloroethyl and as β-acyloxyethyl is in particular β-acetoxyethyl. The alkylene radical alk is preferably methylene, ethylene, methylmethylene, propylene or butylene. The substituent T as alkanoyloxy is in particular acetyloxy, propionyloxy or butyryloxy and as alkoxycarbonyl is in particular methoxycarbonyl, ethoxycarbonyl or propyloxycarbonyl. Alkyl V can be methyl, ethyl, propyl, isopropyl, butyl, isobutyl, sec-butyl or ten-butyl. The radical R' is for example methyl, ethyl, propyl, isopropyl, butyl, isobutyl, sec-butyl, tert-butyl, pentyl or hexyl or preferably hydrogen. The polymethylene radicals alk' are preferably ethylene, propylene or butylene. The indices p, q and t are independently of one another preferably 2, 3 or 4.

The indices r and s are independently of each other preferably 2.

Preferred radicals $V_2$ are those of the formula (4) where $B_1$ is a direct bond and R is a radical of the formula (4a) or where $V_2$ is a radical of the formula (4b), (4c) or (4f) which is bonded directly to the triazine ring, or where $V_2$ is a radical of the formula (4').

Preferred aliphatic reactive groups are those of the formulae $$-SO_2Z \quad (5a),$$

$$-SO_2-NH-Z \quad (5b),$$

$$-NH-CO-(CH_2)_3-SO_2Z \quad (5c),$$

$$-CO-NH-CH_2CH_2-SO_2Z \quad (5d) \text{ and}$$

$$-NH-CO-Z_1 \quad (5e),$$

where Z is as defined above, and $Z_1$ has the meanings of Z and may in addition be α,β-dihaloethyl.

Suitable halogen $Z_1$ in the β-haloethyl and α,β-dihaloethyl groups is in particular chlorine or bromine.

Particularly preferred aliphatic reactive groups are those of the formula (5a) and also those of the formulae (5c) and (5d). For these radicals Z is in particular β-sulfatoethyl or β-haloethyl.

Very particularly preferably the reactive dyes contain at least one reactive group of the formulae (1), (2), (3) and (5a) to (5e) where $T_1$, $T_2$, $T_3$, $T_4$, $V_1$, $V_2$, B, Z and $Z_1$ are each subject to the above-indicated definitions and preferences.

The reactive dyes are derived in particular from the radical of a monoazo, polyazo, metal complex azo, anthraquinone, phthalocyanine, formazan, azomethine, dioxazine, phenazine, stilbene, triphenylmethane, xanthene, thioxanthone, nitroaryl, naphthoquinone, pyrenequinone or perylenetetracarbimide dye, preferably from the radical of a monoazo, disazo, metal complex azo, formazan, anthraquinone, phthalocyanine or dioxazine dye. The reactive dyes may in addition to the reactive group contain bonded to their basic skeleton as further substituents the substituents customary in organic dyes.

Examples of such further substituents of the reactive dyes are: alkyl groups having 1 to 4 carbon atoms, such as methyl, ethyl, propyl, isopropyl or butyl, alkoxy groups having 1 to 4 carbon atoms, such as methoxy, ethoxy, propoxy, isopropoxy or butoxy, acylamino groups having 1 to 8 carbon atoms, in particular alkanoylamino groups and alkoxycarbonylamino groups, such as acetylamino, propionylamino, methoxycarbonylamino, ethoxycarbonylamino or benzoylamino, phenylamino, N,N-di-β-hydroxyethylamino, N,N-di-β-sulfatoethylamino, sulfobenzylamino, N,N-disulfobenzylamino, alkoxycarbonyl having 1 to 4 carbon atoms in the alkoxy radical, such as methoxycarbonyl or ethoxycarbonyl, alkylsulfonyl having 1 to 4 carbon atoms, such as methylsulfonyl or ethylsulfonyl, trifluoromethyl, nitro, cyano, halogen, such as fluorine, chlorine or bromine, carbamoyl, N-alkylcarbamoyl having 1 to 4 carbon atoms in the alkyl radical, such as N-methylcarbamoyl or N-ethylcarbamoyl, sulfamoyl, N-alkylsulfamoyl having 1 to 4 carbon atoms, such as N-methylsulfamoyl, N-ethylsulfamoyl, N-propylsulfamoyl, N-isopropylsulfamoyl or N-butylsulfamoyl, N-(β-hydroxyethyl)sulfamoyl, N,N-di-(β-hydroxyethyl) sulfamoyl, N-phenylsulfamoyl, ureido, hydroxyl, carboxyl, sulfomethyl or sulfo, and also further fibre-reactive radicals. Preferably the reactive dyes contain one or more sulfonic acid groups.

Preferably the reactive dyes are derived from the following dye radicals:

a) Dye radicals of a 1:1 copper complex azo dye of the benzene or naphthalene series wherein the copper atom is bonded with each of its bonds to a metallizable group on both sides ortho to the azo bridge.

b) Particular preference is given to the monoazo or disazo dye radicals of the formula $$D_1—N=N—(M—N=N)_u—K— \quad (6a),$$

$$—D_1—N=N—(M—N=N)_u—K \quad (6b) \text{ or}$$

$$—D_1—N=N—(M—N=N)_u—K— \quad (6c),$$

or of a metal complex derived therefrom; $D_1$ is the radical of a disazo component of the benzene or naphthalene series, M is the radical of a middle component of the benzene or naphthalene series, and K is the radical of a coupling component of the benzene, naphthalene, pyrazolone, 6-hydroxy-2-pyridone or acetoacetarylamide series, where $D_1$, M and K can carry substituents customary in azo dyes, in particular hydroxy, amino, methyl, ethyl, methoxy or ethoxy groups, substituted or unsubstituted alkanoylamino groups having 2 to 4 carbon atoms, substituted or unsubstituted benzoylamino groups, haloger atoms or a fibre-reactive radical, in particular a radical $—SO_2—Z$, where Z is β-sulfatoethyl, β-thiosulfatoethyl, β-phosphatoethyl, β-acyloxyethyl or β-haloethyl; u is 0 or 1, and $D_1$, M and K contain at least one sulfo group, preferably three or four sulfo groups.

c) Particular preference is likewise given to the dye radicals of a disazo dye of the formula $$—D_1—N=N—K—N=N—D_2 \quad (7a) \text{ or}$$

$$—D_1—N=N—K—N=N—D_2— \quad (7b),$$

where $D_1$ and $D_2$ are independently of each other the radical of a disazo component of the benzene or naphthalene series and K is the radical of a coupling component of the naphthalene series and $D_1$, $D_2$ and K can carry substituents customary in azo dyes, in particular hydroxyl, amino, methyl, ethyl, methoxy or ethoxy groups, substituted or unsubstituted alkanoylamino groups having 2 to 4 carbon atoms, substituted or unsubstituted benzoylamino groups, halogen atoms or a fibre-reactive radical, in particular a radical $—SO_2—Z$, where Z is as defined above and $D_1$, $D_2$ and K together contain at least two sulfo groups, preferably three or four sulfo groups.

Important are d) dye radicals of a formazan dye of the formula

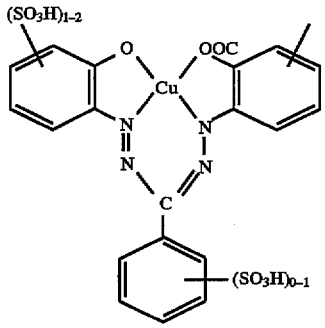

(8a)

or

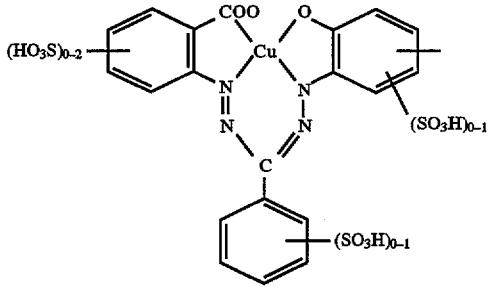

(8b)

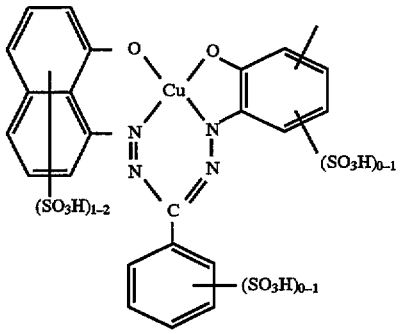

(8c)

or

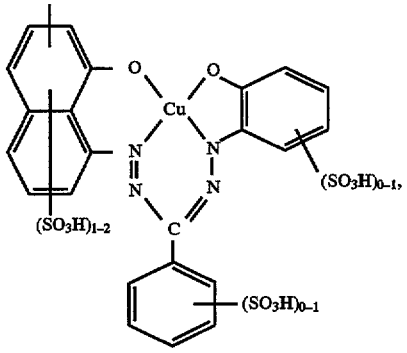

(8d)

where the benzene rings can be further substituted by alkyl having 1 to 4 carbon atoms, alkoxy having 1 to 4 carbon atoms, alkylsulfonyl having 1 to 4 carbon atoms, halogen or carboxyl.

e) Dye radicals of an anthraquinone dye of the formula

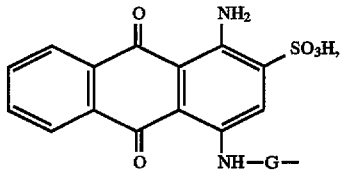

(9)

where G is a phenylene, cyclohexylene, phenylenemethylene or $C_2$–$C_6$alkylene radical, the anthraquinone nucleus may be substituted by a further sulfo group, and phenyl G may be substituted by alkyl having 1 to 4 carbon atoms, alkoxy having 1 to 4 carbon atoms, halogen, carboxyl or sulfo, and the dye preferably contains at least 2 sulfo groups.

f) Dye radicals of a phthalocyanine dye of the formula

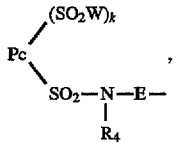

(10)

where Pc is the radical of a copper or nickel phthalocyanine, W is —OH and/or —$NR_5R_{5'}$; $R_5$ and $R_{5'}$ are independently of each other hydrogen or alkyl having 1 to 4 carbon atoms, which may be substituted by hydroxyl or sulfo, $R_4$ is hydrogen or alkyl having 1 to 4 carbon atoms, E is a phenylene radical which may be substituted by alkyl having 1 to 4 carbon atoms, halogen, carboxyl or sulfo, or an alkylene radical having 2 to 6 carbon atoms, preferably a sulfophenylene or ethylene radical, and k is 1, 2 or 3.

g) Dye radicals of a dioxazine dye of the formula

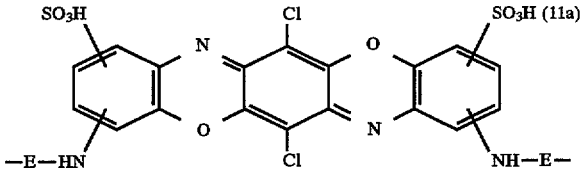

(11a)

or

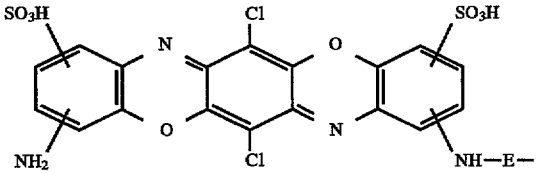

(11b)

or

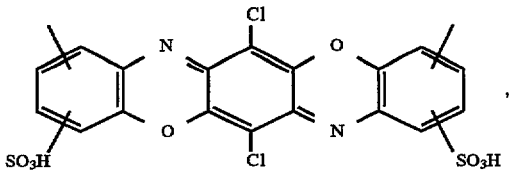

(11c)

where E is a phenylene radical which may be substituted by alkyl of 1 to 4 carbon atoms, halogen, carboxyl or sulfo or is an alkylene radical having 2 to 6 carbon atoms, and the outer benzene rings in the formulae (11a), (11b) and (11c) may be further substituted by alkyl having 1 to 4 carbon atoms, alkoxy having 1 to 4 carbon atoms, acetylamino, nitro, halogen, carboxyl, sulfo or —$SO_2$—Z, where Z is β-sulfatoethyl, β-thiosulfatoethyl, β-phosphatoethyl, β-acyloxyethyl or β-haloethyl.

Of particular importance for the reactive dyes are dye radicals of the following formulae (12) to (23):

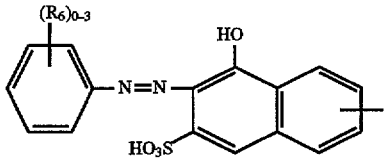

(12a)

or

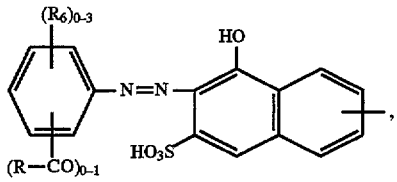

(12b)

where $R_6$ is $C_1$–$C_4$alkyl, $C_1$–$C_4$alkoxy, halogen, —$SO_2$—Z, carboxyl and sulfo and Z is β-sulfatoethyl, β-thiosulfatoethyl, β-phosphatoethyl, β-acyloxyethyl or β-haloethyl, and R is as defined under the formula (4).

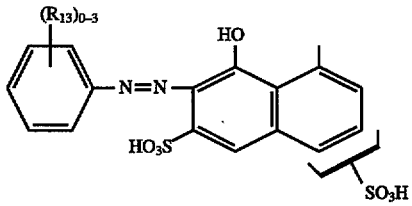

(13a)

or

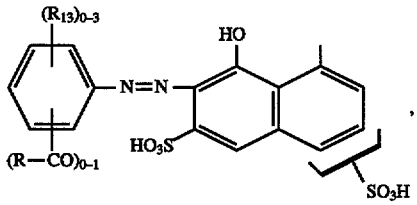

(13b)

where $R_{13}$ is $C_1$–$C_4$alkyl, $C_1$–$C_4$alkoxy, halogen, —$SO_2$—Z, carboxyl, sulfo and $C_1$–$C_4$alkoxyanilino, and Z is β-sulfatoethyl, β-thiosulfatoethyl, β-phosphatoethyl, β-acyloxyethyl or β-haloethyl, and R is as defined under the formula (4).

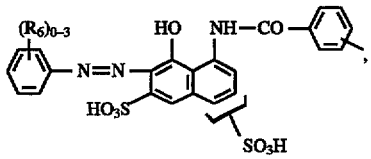

(14)

where $R_6$ is $C_1$–$C_4$alkyl, $C_1$–$C_4$alkoxy, halogen, —$SO_2$—Z, carboxyl and sulfo; and Z is β-sulfatoethyl, β-thiosulfatoethyl, β-phosphatoethyl, β-acyloxyethyl or β-haloethyl.

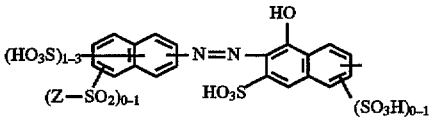

(15)

-continued

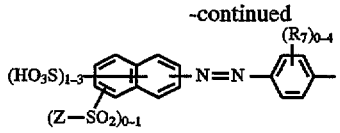

(16a)

or

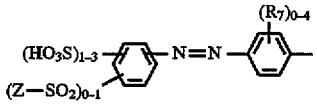

(16b)

or

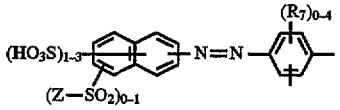

(16c)

or

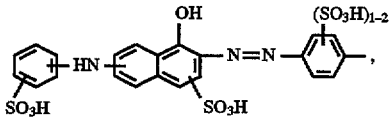

(16d)

where $R_7$ is halogen, nitro, cyano, trifluoromethyl, sulfamoyl, carbamoyl, $C_1$–$C_4$alkyl, $C_1$–$C_4$alkoxy, amino, acetylamino, ureido, hydroxyl, carboxyl, sulfomethyl and sulfo and Z is β-sulfatoethyl, β-thiosulfatoethyl, β-phosphatoethyl, β-acyloxyethyl or β-halogenethyl.

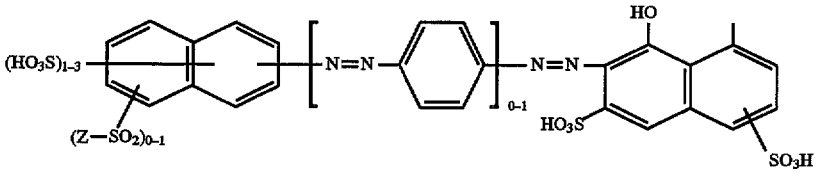

(17)

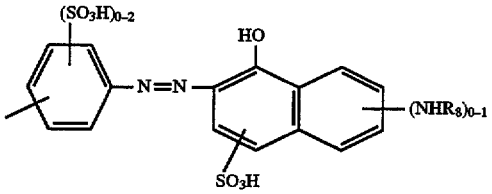

(18a)

or

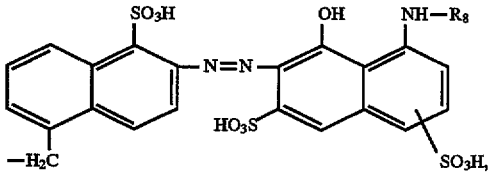

(18b)

where $R_8$ is $C_1$–$C_4$-alkanoyl or benzoyl and Z is β-sulfatoethyl, β-thiosulfatoethyl, β-phosphatoethyl, β-acyloxyethyl or β-haloethyl.

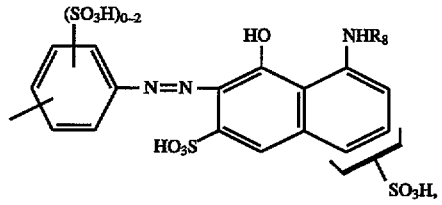

(19)

where $R_8$ is $C_1$–$C_4$alkanoyl or benzoyl.

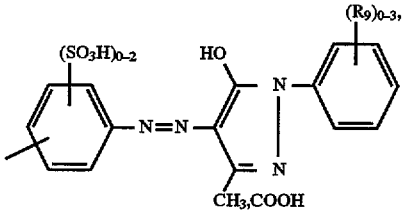

(20)

where $R_9$ is $C_1$–$C_4$alkyl, $C_1$–$C_4$alkoxy, halogen, —$SO_2$—Z, carboxyl and sulfo and Z is β-sulfatoethyl, β-thiosulfatoethyl, β-phosphatoethyl, β-acyloxyethyl or β-haloethyl,

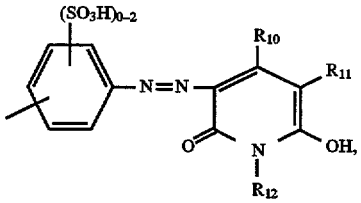

(21)

where $R_{12}$ and $R_{10}$ are independently of each other hydrogen, $C_1$–$C_4$alkyl or phenyl, and $R_{11}$ is hydrogen, cyano, carbamoyl or sulfomethyl.

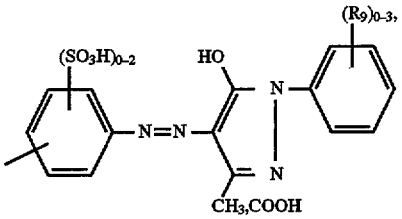

(22)

where $R_9$ is $C_1$–$C_4$alkyl, $C_1$–$C_4$alkoxy, halogen, —$SO_2$—Z, carboxyl and sulfo and Z is β-sulfatoethyl, β-thiosulfatoethyl, β-phosphatoethyl, β-acyloxyethyl or β-haloethyl.

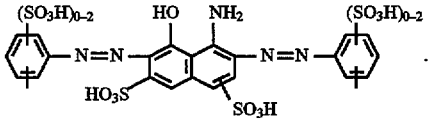

(22a)

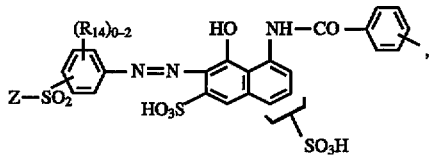

(23)

where $R_{14}$ is $C_1$–$C_4$alkyl, $C_1$–$C_4$alkoxy, halogen, carboxyl and sulfo and Z is β-sulfatoethyl, β-thiosulfatoethyl, β-phosphatoethyl, β-acyloxyethyl or β-haloethyl,

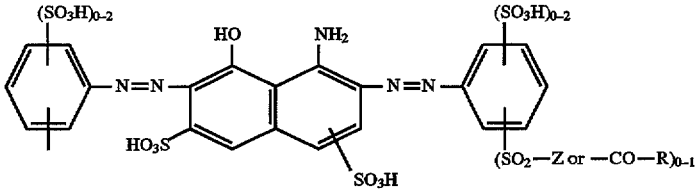

(23a)

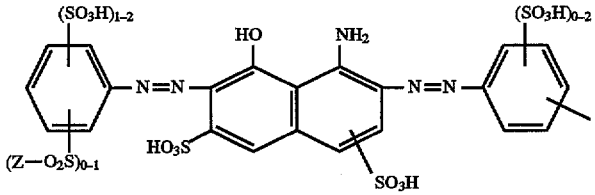

(23b)

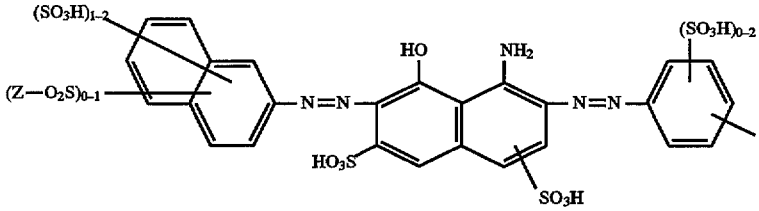

(23c)

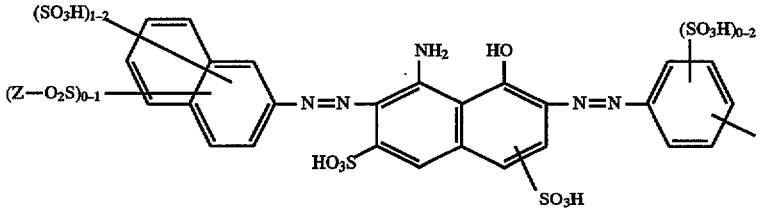

(23d)

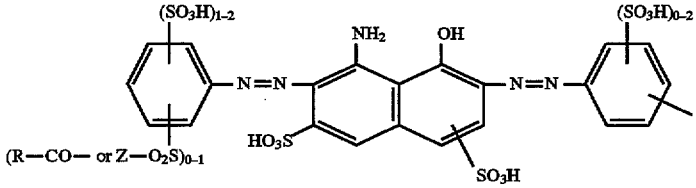

(23e)

-continued

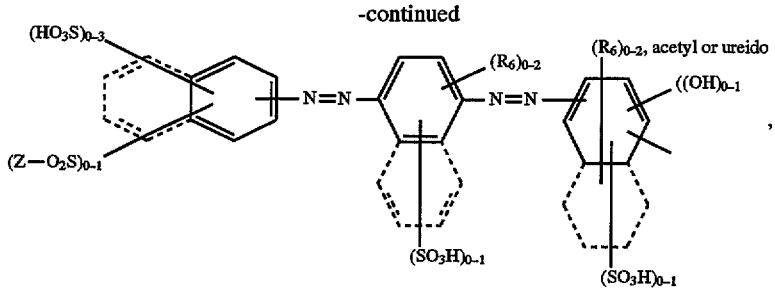

(23f)

where $R_6$ and Z are each as defined under the formula (14) and R is as defined under the formula (4).

Also important are heavy metal complexes of reactive dyes; suitable complexing heavy metals are in particular copper, nickel, cobalt and chromium. Preference is given to copper complex azo dyes, in particular to those of the formulae (12) to (23), which contain the copper atom bonded via an oxygen atom in each case ortho to the azo bridge.

Examples of azo dyes which are suitable for use as metal complexes are:

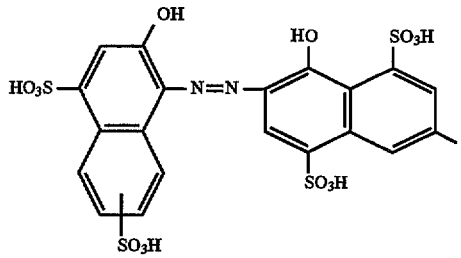

(24)

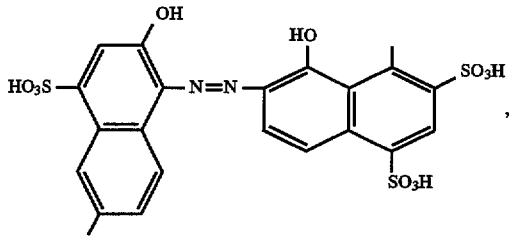

(25)

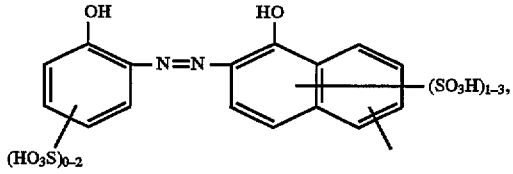

(26)

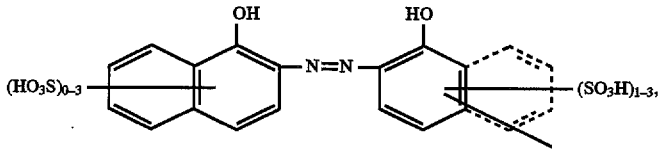

(27)

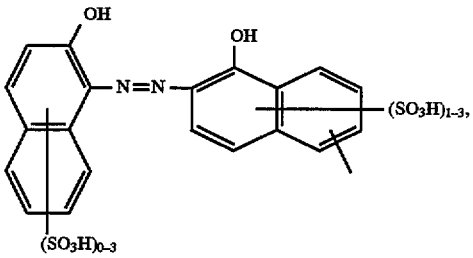

(28)

-continued
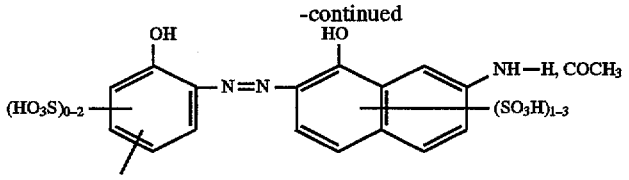
(29a)
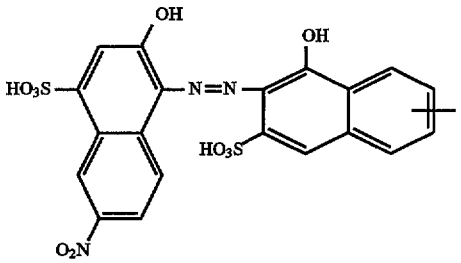
(29b)
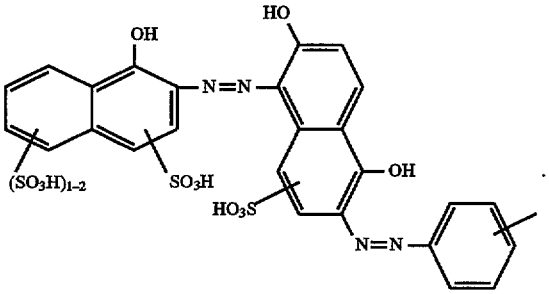
(29c)
Preferred metal atoms are copper (1:1 complex) or chromium and cobalt (1:2 complex). Chromium and cobalt complexes may contain the azo compound of the above-indicated formula once or twice; that is, they can be symmetrical or, incorporating any other ligands, asymmetrical.
Preference is given to copper complexes such as
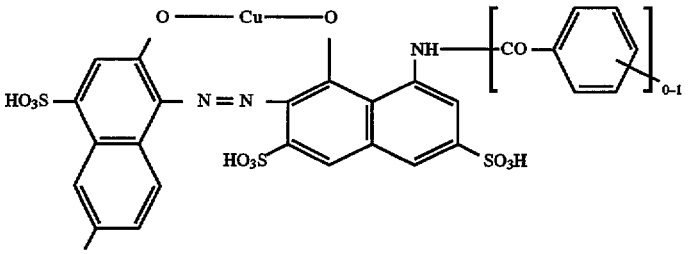
(30)
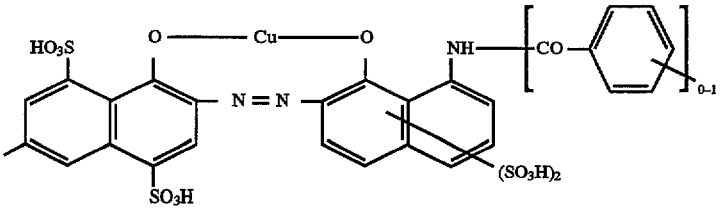
(31a)
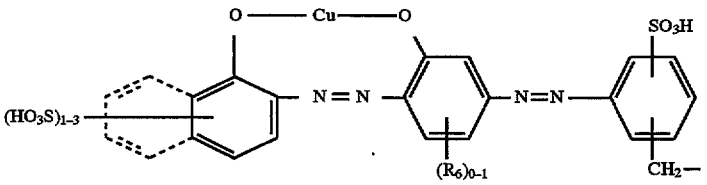
(31b)

-continued

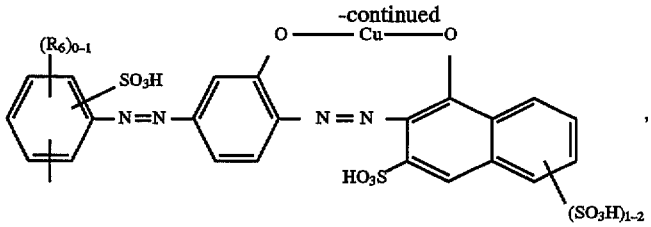

(31c)

where $R_6$ is as defined under the formula (14).

The aromatic rings in the above dyes can be further substituted, the benzene rings in particular by methyl, ethyl, methoxy, ethoxy, methylsulfonyl, ethylsulfonyl, carboxyl, acetylamino or chlorine and the naphthalene rings in particular by methoxy, carboxyl, acetylamino, nitro or chlorine. Preferably the benzene rings are not further substituted.

Of particular interest are reactive dyes which contain a dye radical of the formulae (12) to (31c) and in which the reactive groups have the above-indicated definitions and preferences.

Of very particular interest are reactive dyes of the formulae

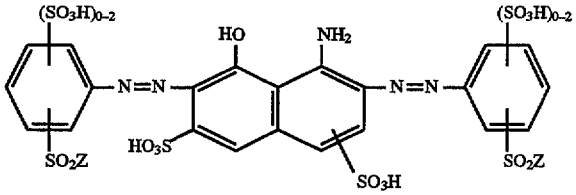

(32a)

and

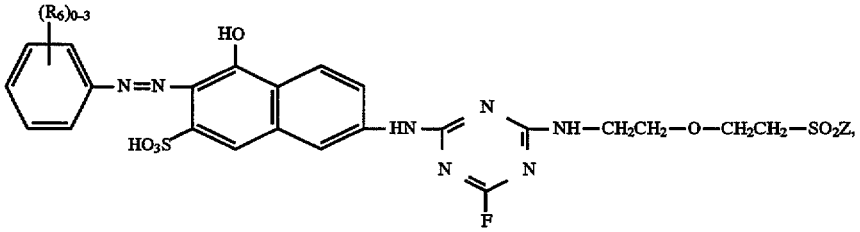

(32b)

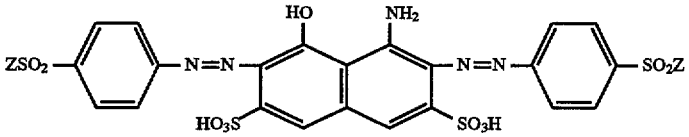

(33a)

and

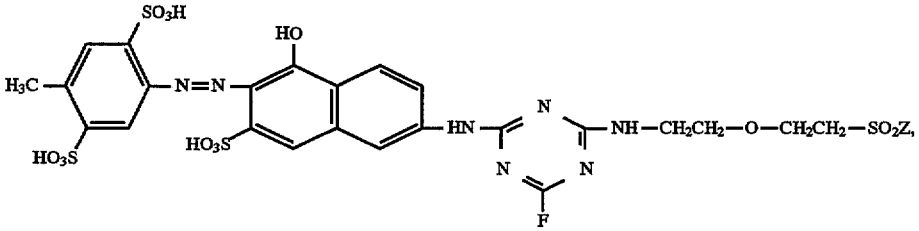

(33b)

where $R_6$ is $C_1$–$C_4$alkyl, $C_1$–$C_4$alkoxy, halogen, carboxyl or sulfo and Z has the above-indicated meanings and preferences.

Suitable direct dyes are in particular phthalocyanine dyes, dioxazine dyes and dyes of the formula $$A_1—B_2—A_2 \quad (34a)$$

where $B_2$ is a bridge member and $A_1$ and $A_2$ are independently of each other the radical of a monoazo, polyazo, metal complex azo, stilbene or anthraquinone dye, or where $B_2$ and $A_1$ are each as defined and $A_2$ is a phenyl or naphthyl radical substituted by a heterocyclic radical or a benzoylamino or phenylamino radical or is a reactive group as defined above, or where $B_2$ is the direct bond and $A_1$ and $A_2$ are each the radical of a metal complex azo dye, or dyes of the formula $$A_3—NH—L \quad (34b),$$

where $A_3$ is the chromophore radical of an organic dye and L is a radical of the formulae

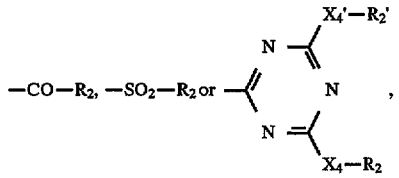

where $X_4$ and $X_4'$ are independently of each other a direct bond, NH, NR, O or S, $R_2$ and $R_2'$ are independently of each other hydrogen, aromatic, aliphatic or cycloaliphatic radicals which are substituted if desired by halogen, OR", COOR", $SO_3H$ or aralkyl, which is substituted if desired by halogen, OR", COOR" or $SO_3H$, where R" is hydrogen or $C_1$–$C_6$alkyl.

Suitable bridge members for $B_2$ in the formula (34a) are for example the following:

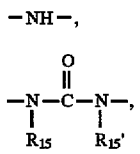

(35a)

(35b)

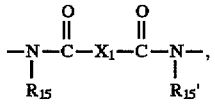

(35c)

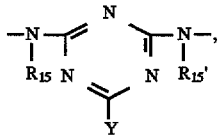

(35d)

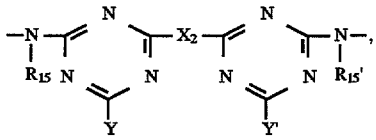

(35e)

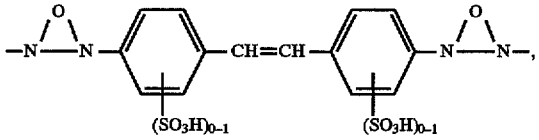

(35f)

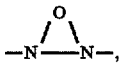

(35g)

−N=N− and (35h)

−CH=CH−, (35i)

where $R_{15}$ and $R_{15'}$, are independently of each other substituted or unsubstituted $C_1$–$C_8$alkyl or in particular hydrogen, $X_1$ and $X_2$ are bridge members and Y and Y' are independently of each other hydroxyl, $C_1$–$C_4$alkoxy, chlorine, bromine, $C_1$–$C_4$alkylthio, amino, N-mono- or N,N-di-$C_1$–$C_4$alkylamino, which is unsubstituted or substituted in the alkyl moiety by hydroxyl, sulfo, carboxyl or $C_1$–$C_4$alkoxy, cyclohexylamino, phenylamino which is unsubstituted or substituted in the phenyl moiety by $C_1$–$C_4$alkyl, $C_1$–$C_4$alkoxy, carboxyl, sulfo and/or halogen, or N—$C_1$–$C_4$alkyl-N-phenylamino, morpholino or 3-carboxy- or 3-carbamoyl-1-pyridinyl.

$R_{15}$ and $R_{15'}$, as $C_1$–$C_8$alkyl can be unsubstituted or for example substituted by halogen, hydroxyl, cyano, $C_1$–$C_4$alkoxy, $C_1$–$C_4$alkoxycarbonyl, carboxyl, sulfamoyl, sulfo or sulfato.

A bridge member $X_1$ in the formula (35c) is preferably an unsubstituted or hydroxyl-, sulfo-, sulfato-, $C_1$–$C_4$alkoxy-, carboxyl- or halogen-substituted $C_2$–$C_6$alkylene or $C_5$–Ccycloalkylene radical or an unsubstituted or $C_1$–$C_4$alkyl-, $C_1$–$C_4$alkoxy-, sulfo-, halogen- or carboxyl-substituted phenylene, biphenylene or naphthylene radical. $X_1$ is in particular unsubstituted or sulfo-substituted phenylene.

Suitable bridge members $X_2$ in the formula (35e) are for example the radical of the formulae $-NR_{15}-(CH_2)_{2-4}-NR_{15'}-$, (36a)

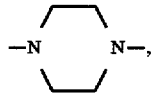

(36b)

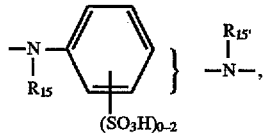

(36c)

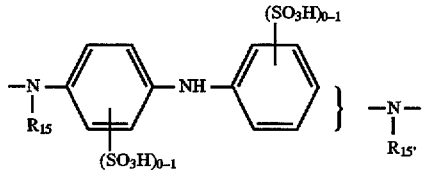

(36d)

and in particular

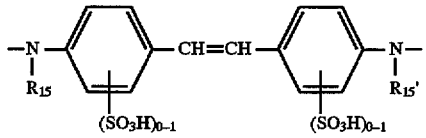

(36e)

where $R_{15}$ and $R_{15'}$ have the above-indicated meanings and preferences.

The radicals $R_2$ and $R_2'$ in the formula (34b) are preferably $C_1$–$C_6$alkyls or $C_1$–$C_6$alkylenes, e.g. methyl, ethyl or isopropyl, which may if desired be substituted for example by carboxyl or phenyl; phenols, which may likewise be substituted for example by carboxyl; unsubstituted or substituted benzyl radicals; and also radicals of the formulae

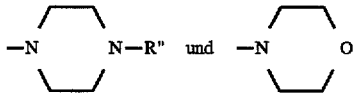

where R" is as defined under the formula (34b).

The radicals $A_1$ and $A_2$ in the formula (34a) can be substituted, for example by alkyl groups having 1 to 4 carbon atoms, such as methyl, ethyl, propyl, isopropyl or butyl, alkoxy groups having 1 to 4 carbon atoms such as methoxy, ethoxy, propoxy, isopropoxy or butoxy, acylamino groups having 1 to 8, preferably 2 to 6, carbon atoms, in particular alkanoylamino groups and alkoxycarbonylamino groups, such as acetylamino, propionylamino, methoxycarbonylamino, ethoxycarbonylamino or benzoylamino, phenylamino, N,N-di-β-hydroxyethylamino, N,N-di-β-sulfatoethylamino, sulfobenzylamino, N,N-disulfobenzylamino, alkanoyl groups having 2 to 6 carbon atoms, alkanoyl or alkanoylamino groups having 2 to 6 carbon atoms which are further substituted in the alkyl moiety by hydroxyl, phenylazo, naphthotriazolyl, benzothiazolyl, benzoisothiazolyl, alkoxycarbonyl having 1 to 4 carbon atoms in the alkoxy radical, such as methoxycarbonyl or ethoxycarbonyl, alkylsulfonyl having 1 to 4 carbon atoms, such as methylsulfonyl or ethylsulfonyl, trifluoromethyl, nitro, cyano, halogen, such as fluorine, chlorine or bromine, carbamoyl, N-alkylcarbamoyl having 1 to 4 carbon atoms in the alkyl radical, such as N-methylcarbamoyl or N-ethylcarbamoyl, sulfamoyl, N-alkylsulfamoyl having 1 to 4 carbon atoms, such as N-methylsulfamoyl, N-ethylsulfamoyl, N-propylsulfamoyl, N-isopropylsulfamoyl or N-butylsulfamoyl, N-phenylsulfamoyl, ureido, hydroxyl, carboxyl, sulfomethyl, sulfo, or amino which may if desired be further substituted by $C_1$–$C_4$alkyl or $C_1$–$C_4$hydroxyalkyl, and the abovementioned heterocyclic radicals and also the phenyl-containing groups can be further substituted by one or more of the groups mentioned above as substituents of the radicals $A_1$ and $A_2$.

Azo dye radicals $A_1$ and $A_2$ are preferably radicals of the formula $$D_3—N=N—(M_1—N=N)_{0-1}—K_1— \quad (37a) \text{ or}$$

$$—D_3—N=N—(M_1—N=N)_{0-1}—K_1 \quad (37b),$$

where $D_3$ is the radical of a diazo component of the benzene or naphthalene series, $M_1$ is the radical of a middle component of the benzene or naphthalene series and $K_1$ is the radical of a coupling component of the benzene or naphthalene series, and $D_3$, $M_1$ and $K_1$ may be substituted by the substituents indicated above for $A_1$ and $A_2$, in particular by $C_1$–$C_4$alkyl, $C_1$–$C_4$alkoxy, halogen, carboxyl, hydroxyl, sulfo, sulfamoyl, ureido, amino which may if desired be further substituted by $C_1$–$C_4$alkyl or $C_1$–$C_4$hydroxyalkyl, $C_2$–$C_6$alkanoyl or $C_2$–$C_6$alkanoylamino which may if desired be further substituted in the alkyl moiety by hydroxyl, or phenylamino or benzoylamino which may each if desired be further substituted in the phenyl ring by carboxyl, halogen, sulfo, $C_1$–$C_4$alkyl or $C_1$–$C_4$alkoxy;

Metal complex azo dye radicals $A_1$ and $A_2$ are preferably radicals of the formula

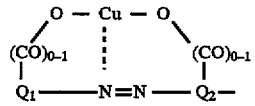

(38a)

or

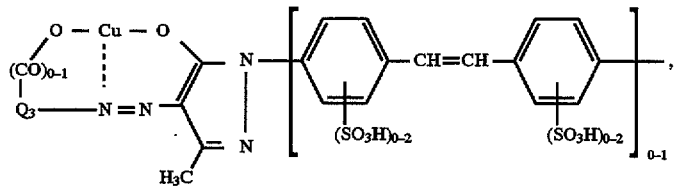

(38b)

where the oxygen and the carboxyl group are each bonded to the radical $Q_1$, $Q_2$ and $Q_3$ ortho to the azo group, $Q_1$, $Q_2$ and $Q_3$ are independently of one another a radical of the benzene or naphthalene series, and $Q_1$, $Q_2$ and $Q_3$ can be substituted by the substituents indicated above for $A_1$ and $A_2$, in particular by $C_1$–$C_4$alkyl, $C_1$–$C_4$alkoxy, halogen, carboxyl, hydroxyl, sulfo, sulfamoyl, ureido, amino which may if desired be further substituted by $C_1$–$C_4$alkyl or $C_1$–$C_4$hydroxyalkyl, $C_2$–$C_6$alkanoyl or $C_2$–$C_6$alkanoylamino which may each if desired be further substituted in the alkyl moiety by hydroxyl, or phenylazo, benzoylamino or phenylamino which may each if desired be further substituted in the phenyl ring by carboxyl, halogen, hydroxyl, sulfo, $C_1$–$C_4$alkyl, $C_1$–$C_4$alkoxy or $C_1$–$C_4$carboxyalkoxy;

Stilbene dye radicals $A_1$ and $A_2$ are preferably radicals of the formula

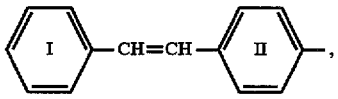

(39)

where the benzene rings I and II may be substituted independently of each other by the substituents indicated above for $A_1$ and $A_2$, in particular by $C_1$–$C_4$alkyl, $C_1$–$C_4$alkoxy, halogen, carboxyl, hydroxyl, sulfo, sulfamoyl, ureido, amino which may if desired be further substituted by $C_1$–$C_4$alkyl or $C_1$–$C_4$hydroxyalkyl, $C_2$–$C_6$alkanoyl or $C_2$–$C_6$alkanoylamino which may each if desired be further substituted in the alkyl moiety by hydroxyl, or naphthotriazole which may if desired be further substituted by $C_1$–$C_4$alkyl, $C_1$–$C_4$alkoxy, halogen or sulfo;

Anthraquinone dye radicals $A_1$ and $A_2$ are preferably radicals of the formula

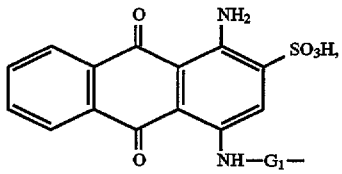

(40)

where $G_1$ is a $C_2$–$C_6$alkylene, cyclohexylene, phenylenemethylene or preferably a phenylene radical and the anthraquinone nucleus may be substituted by a further sulfo group and phenylene $G_1$ by alkyl having 1 to 4 carbon atoms, alkoxy having 1 to 4 carbon atoms, halogen, carboxyl or in particular sulfo;

A heterocyclyl-substituted phenyl or naphthyl radical $A_2$ is preferably a benzothiazolyl, benzisothiazolyl or naphthotriazolyl-substituted phenyl radical in which the phenyl radical and the benzothiazolyl, benzisothiazolyl and naphthotriazolyl substituents of the phenyl radical may be substituted independently of one another by $C_1$–$C_4$alkyl, $C_1$–$C_4$alkoxy, halogen, carboxyl, hydroxyl, sulfo, sulfamoyl, ureido, amino which may if desired be further substituted by $C_1$–$C_4$alkyl or $C_1$–$C_4$hydroxyalkyl, or $C_2$–$C_6$alkanoyl or $C_2$–$C_6$alkanoylamino which may each if desired be further substituted in the alkyl moiety by hydroxyl.

Dyes of the formula (34a) where $B_2$ is a bridge member may contain for $A_1$ and $A_2$ identical or different radicals of the formulae (37a), (37b), (38a), (38b), (39) and (40). Similarly, dyes of the formula (34a) where B is a direct bond may contain identical or different radicals of the formulae (38a) and (38b) for $A_1$ and $A_2$.

Preference for use in the dye mixtures of the invention as dyes of the formula (34a) in which $A_2$ is a phenyl or naphthyl radical which is substituted by a benzoylamino or phenylamino radical is given to dyes of the formula

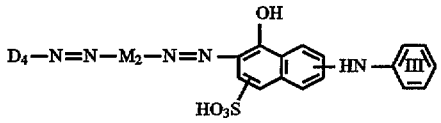

(41)

where $D_4$ and $M_2$ independently of each other have the meanings and preferences indicated above under the formulae (37a) and (37b) for $D_3$ and $M_1$ and where the benzene ring III may if desired be substituted by $C_1$–$C_4$alkyl, $C_1$–$C_4$alkoxy, halogen, $C_2$–$C_6$alkanoylamino, unsubstituted or $C_1$–$C_4$alkyl-, $C_1$–$C_4$alkoxy-, halogen-, nitro-, N,N-di-$C_1$–$C_4$alkylamino-, $C_2$–$C_6$alkanoylamino-, benzoylamino-, $C_1$–$C_4$alkoxycarbonyl- or $C_1$–$C_4$alkylsulfonyl- substituted benzoylamino or phenylamino.

Particular preference is given to direct dyes of the formula (34a) in which $B_2$ is a bridge member of the formulae (35a) to (35i) and $A_1$ and $A_2$ are independently of each other a radical of the formulae (37a), (37b), (38a), (38b), (39) and (40), or dyes of the formula (34a) in which $B_2$ and $A_1$ are each as defined and $A_2$ is a benzothiazolyl-, benzisothiazolyl- or naphthotriazolyl-substituted phenyl radical in which the phenyl radical and the benzothiazolyl, benzisothiazolyl and naphthotriazolyl substituents in the phenyl radical may be independently of one another substituted by $C_1$–$C_4$alkyl, $C_1$–$C_4$alkoxy, halogen, carboxyl, hydroxyl, sulfo, sulfamoyl, ureido, unsubstituted or $C_1$–$C_4$alkyl- or $C_1$–$C_4$hydroxyalkyl-substituted amino or $C_2$–$C_6$alkanoyl or $C_2$–$C_6$alkanoylamino which may each be further substituted in the alkyl moiety by hydroxyl, or dyes of the formula (34a) in which $B_2$ is the direct bond and $A_1$ and $A_2$ are independently of each other a radical of the formulae (38a) and (38b), or dyes of the formula (41).

Also of particular preference are the direct dyes of the formula (34b) in which L is a radical of the formulae

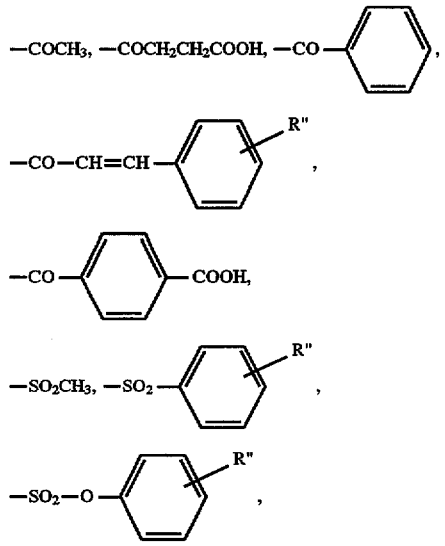

-continued

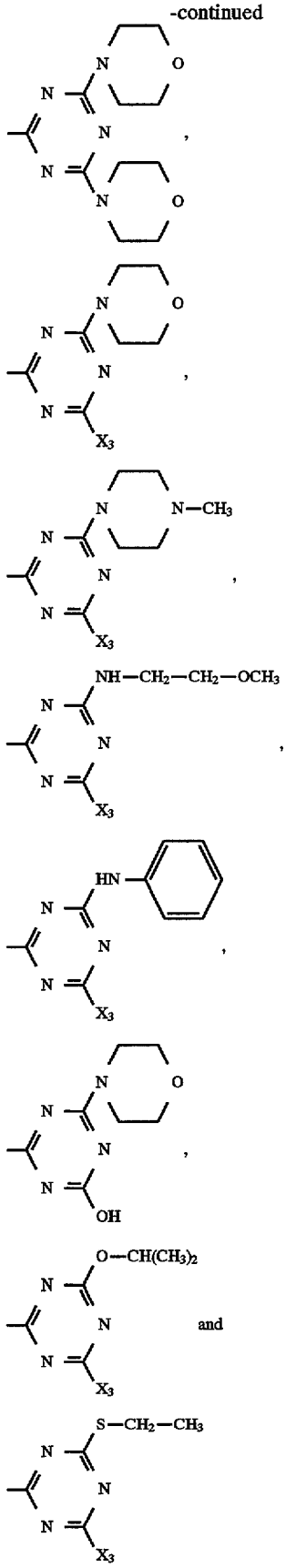

and where $X_3$ is halogen and R" is as defined under the formula (34b).

Very particular preference is given to direct dyes of the formulae

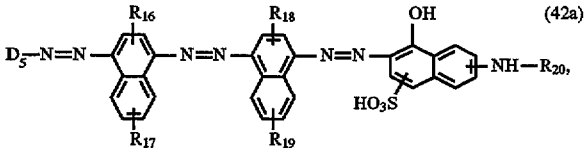

(42a)

where $D_5$ is the radical of a diazo component of the benzene or naphthalene series which may if desired be substituted by $C_1$–$C_4$alkyl, $C_1$–$C_4$alkoxy, halogen, carboxyl, hydroxyl, sulfo, sulfamoyl, ureido, unsubstituted or $C_1$–$C_4$alkyl- or $C_1$–$C_4$hydroxyalkyl-substituted amino or $C_2$–$C_6$alkanoyl or $C_2$–$C_6$alkanoylamino which may each if desired be further substituted in the alkyl moiety by hydroxyl, $R_{16}$, $R_{17}$, $R_{18}$ and $R_{19}$ are independently of one another hydrogen, $C_1$–$C_4$alkyl, $C_1$–$C_4$alkoxy, halogen, sulfo, unsubstituted or $C_1$–$C_4$alkyl- or $C_1$–$C_4$hydroxyalkyl-substituted amino or $C_2$–$C_6$alkanoyl or $C_2$–$C_6$alkanoylamino which may each be further substituted in the alkyl moiety by hydroxyl, and $R_{20}$ is hydrogen or phenyl or benzoyl which may each be further substituted in the phenyl ring by $C_1$–$C_4$alkyl, $C_1$–$C_4$alkoxy, halogen, sulfo or carboxyl;

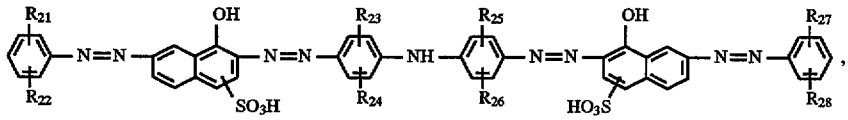

(42b)

where $R_{21}$, $R_{22}$, $R_{23}$, $R_{24}$, $R_{25}$, $R_{26}$, $R_{27}$ and $R_{28}$ are independently of one another hydrogen, $C_1$–$C_4$alkyl, $C_1$–$C_4$alkoxy, halogen, sulfo, unsubstituted or $C_1$–$C_4$alkyl- or $C_1$–$C_4$hydroxyalkyl-substituted amino or $C_2$–$C_6$alkanoyl or $C_2$–$C_6$alkanoylamino which may each if desired be further substituted in the alkyl moiety by hydroxyl;

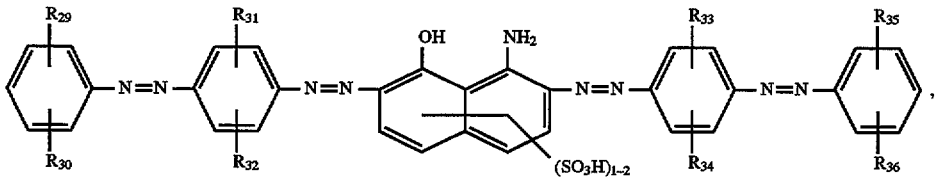

(42c)

where $R_{29}$, $R_{30}$, $R_{31}$, $R_{32}$, $R_{33}$, $R_{34}$, $R_{35}$ and $R_{36}$ have the meanings indicated above under the formula (42b) for $R_{21}$, $R_{22}$, $R_{23}$, $R_{24}$, $R_{25}$, $R_{26}$, $R_{27}$ and $R_{28}$.

Preference for use as dyes of the formula (42a) is given to those where $D_5$ is the radical of a diazo component of the benzene series which may if desired be substituted by $C_1$–$C_4$alkyl, $C_1$–$C_4$alkoxy, halogen, sulfo or unsubstituted or $C_1$–$C_4$alkyl- or $C_1$–$C_4$hydroxyalkyl-substituted amino;

$R_{16}$, $R_{17}$, $R_{18}$ and $R_{19}$ are hydrogen or sulfo;

$R_{20}$ is hydrogen, phenyl or benzoyl.

Preference for use as dyes of the formula (42b) is given to those where $R_{21}$, $R_{22}$, $R_{27}$ and $R_{28}$ are hydrogen, $C_1$–$C_4$alkyl, $C_1$–$C_4$alkoxy, halogen, sulfo or unsubstituted or $C_1$–$C_4$alkyl- or $C_1$–$C_4$hydroxyalkyl-substituted amino;

$R_{23}$, $R_{24}$, $R_{25}$ and $R_{26}$ are hydrogen or sulfo.

Preference for use as dyes of the formula (42c) is given to those where $R_{29}$, $R_{30}$, $R_{35}$ and $R_{36}$ are each hydrogen, $C_1$–$C_4$alkyl, $C_1$–$C_4$alkoxy, halogen, sulfo or unsubstituted or $C_1$–$C_4$alkyl- or $C_1$–$C_4$hydroxyalkyl-substituted amino;

$R_{31}$, $R_{32}$, $R_{33}$ and $R_{34}$ are hydrogen or sulfo.

The chromophore units listed in Table 1 are particularly preferred for the reactive dyes but also for the direct dyes.

TABLE 1
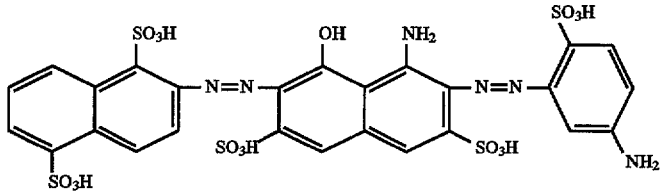
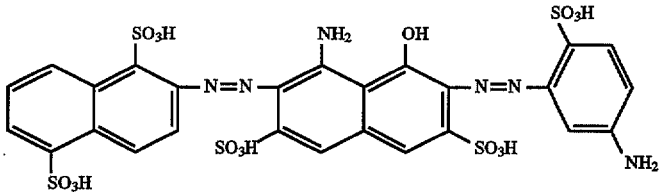
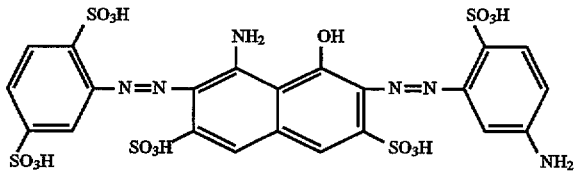
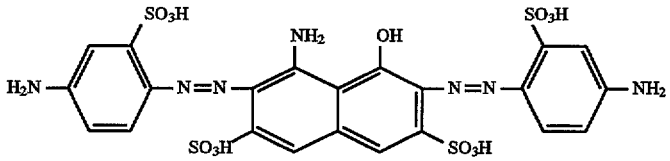
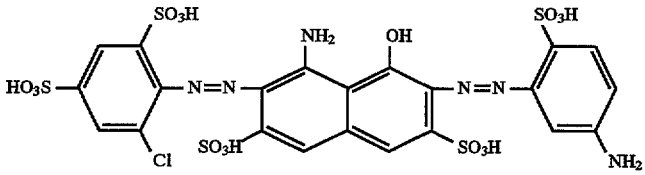
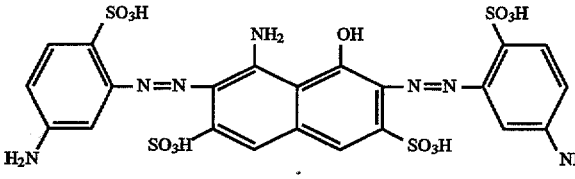
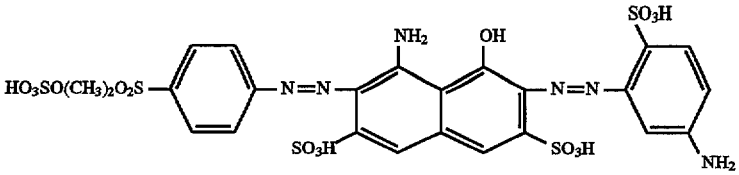
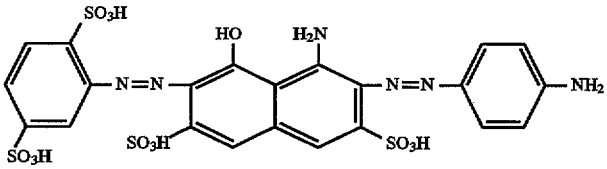

TABLE 1-continued
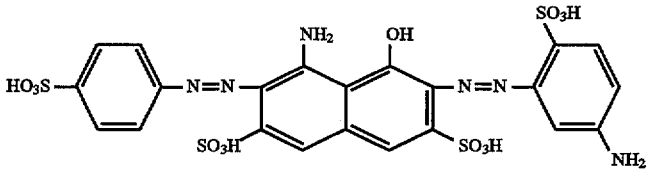
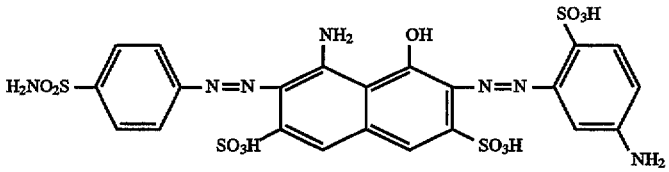
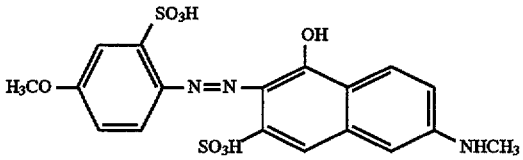
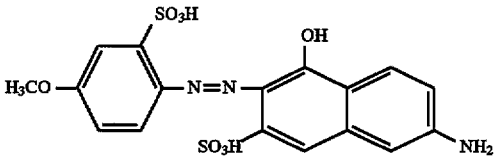
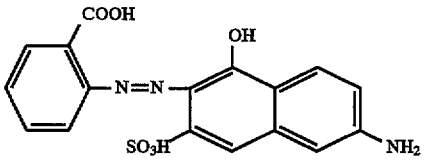
1/2 Cr complex
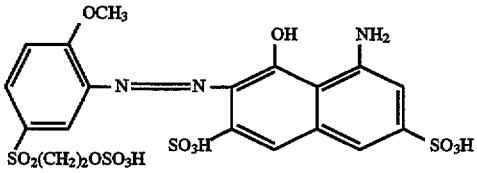
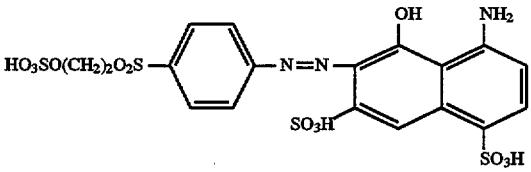
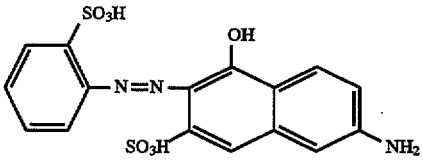
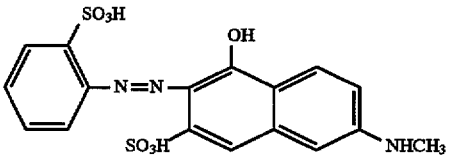

TABLE 1-continued
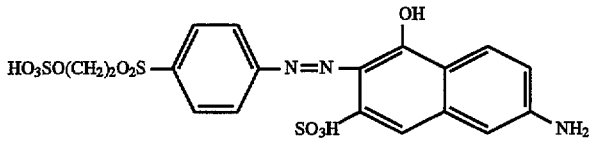
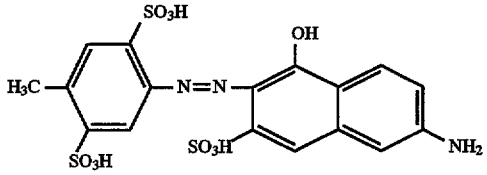
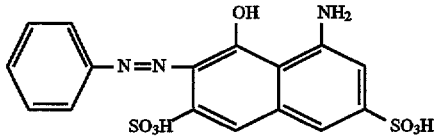
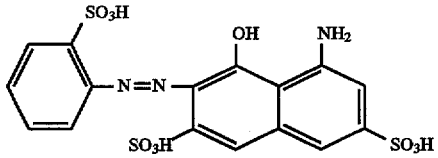
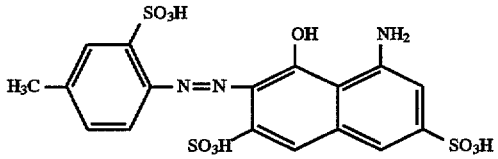
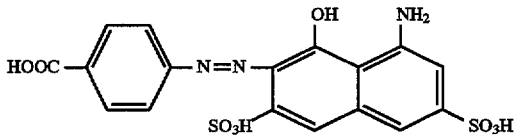
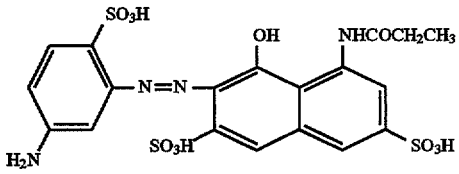
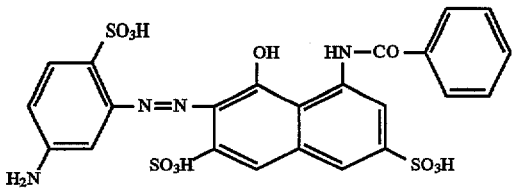
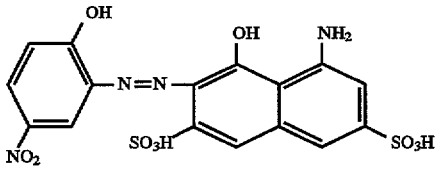
1/2 Cr complex TABLE 1-continued
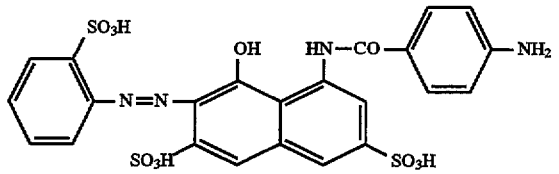
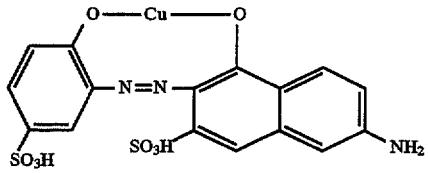
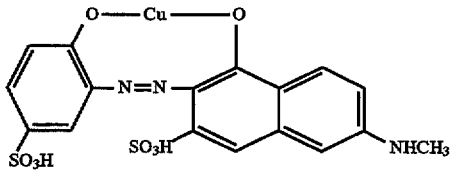
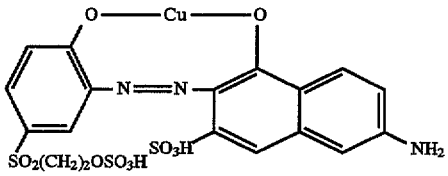
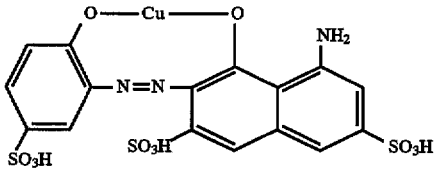
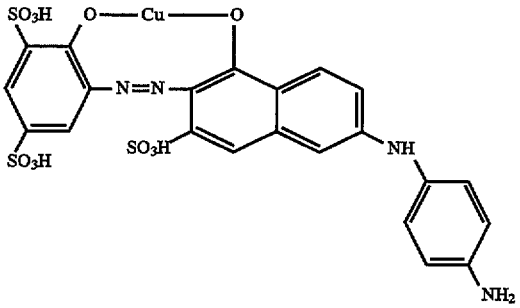
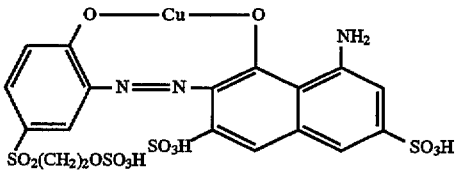
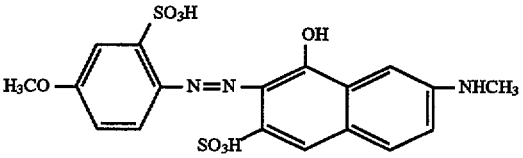

TABLE 1-continued
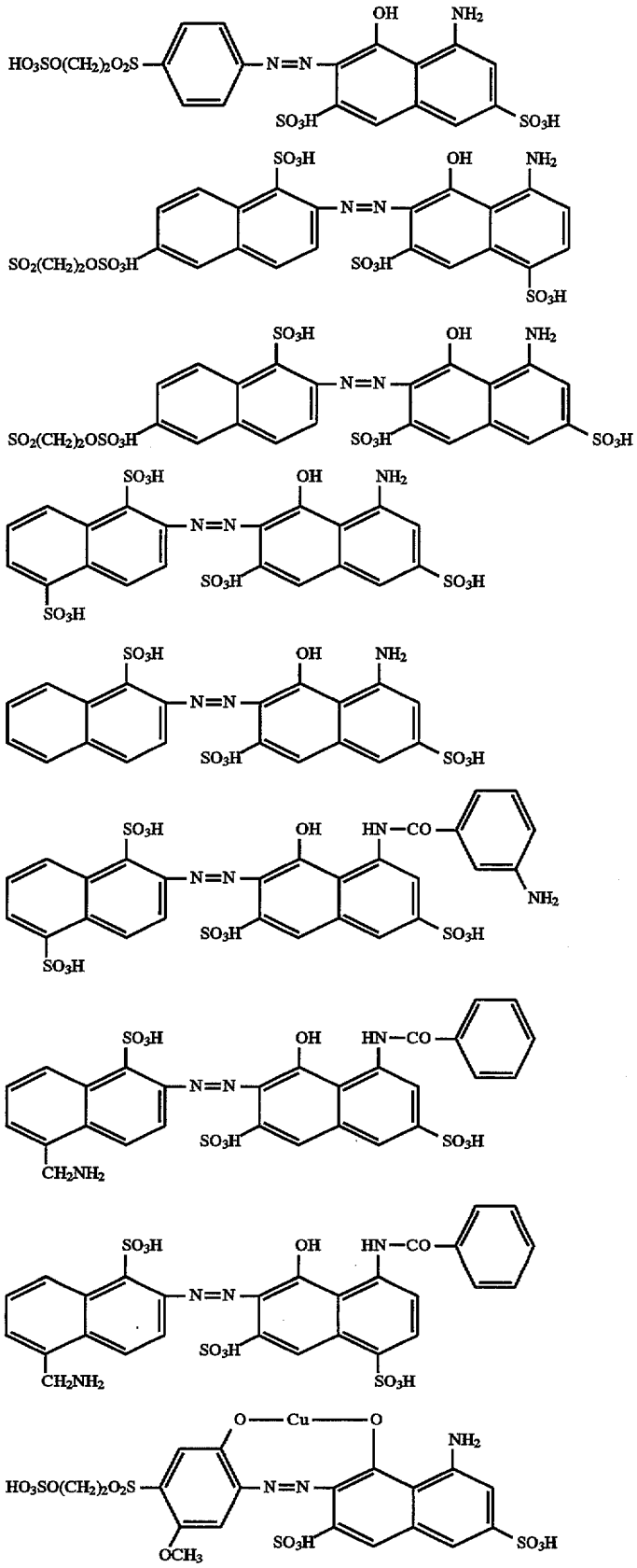

TABLE 1-continued
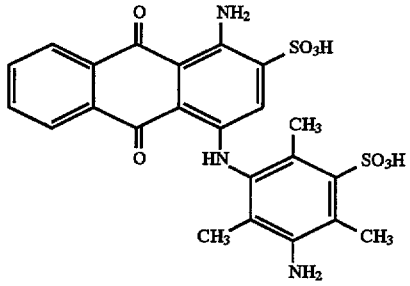
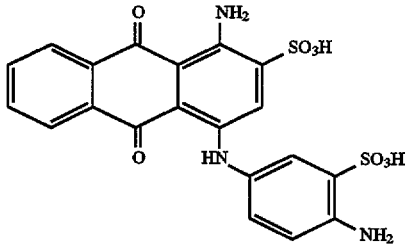
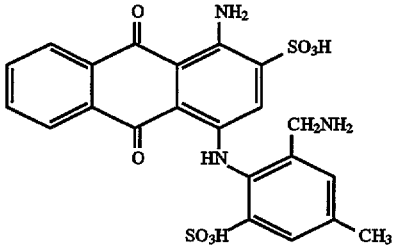
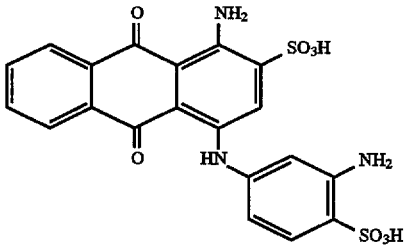
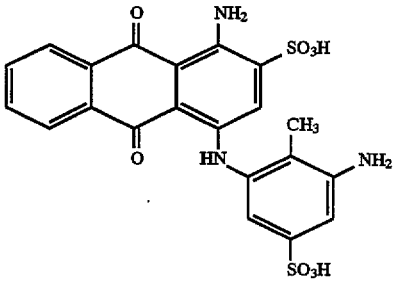
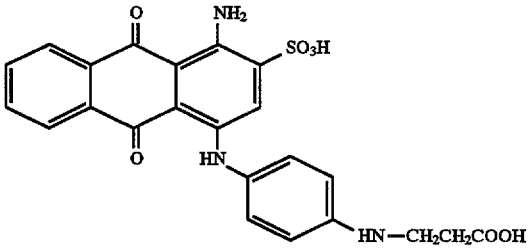

TABLE 1-continued
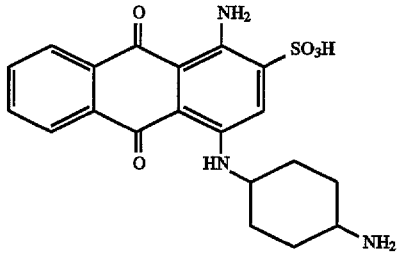
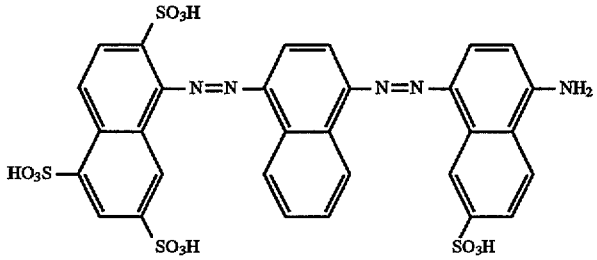
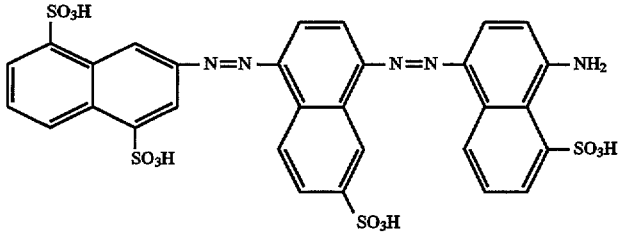
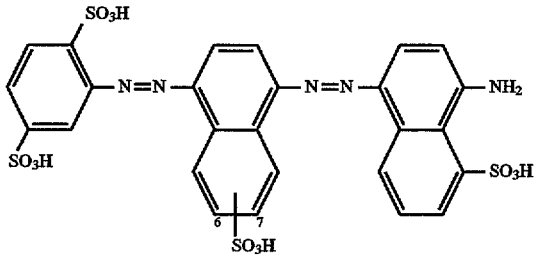
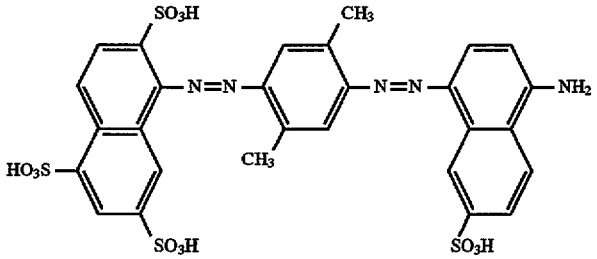
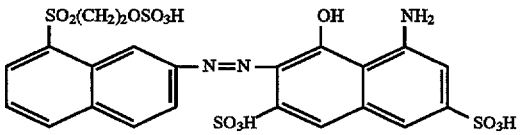
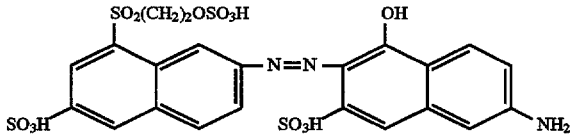

TABLE 1-continued
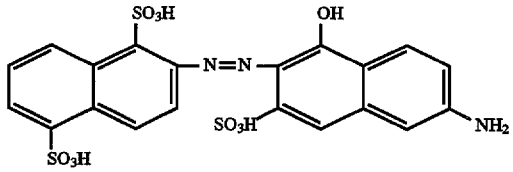
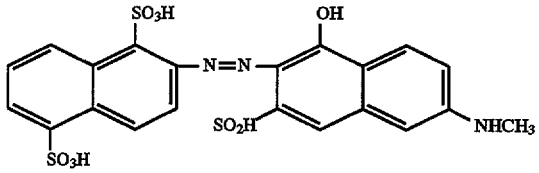
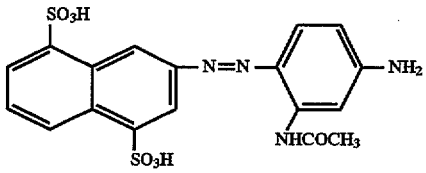
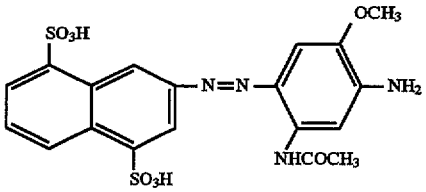
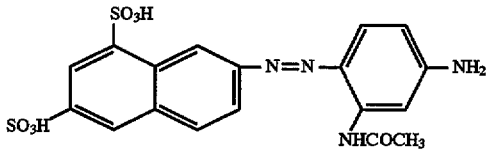
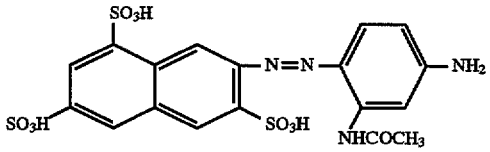
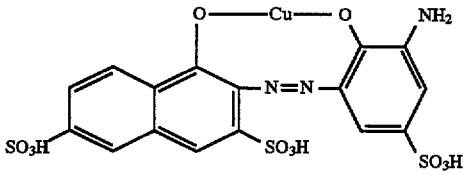
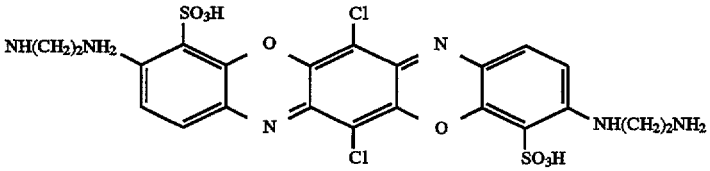
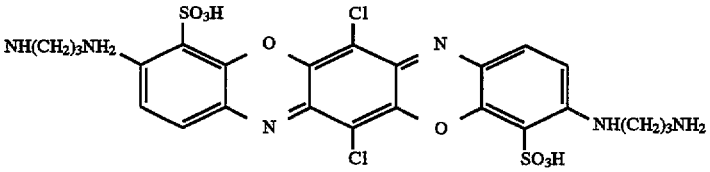

TABLE 1-continued
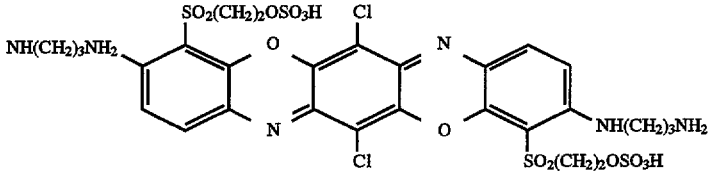
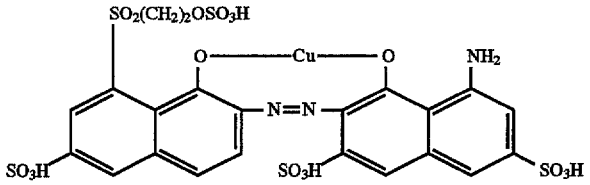
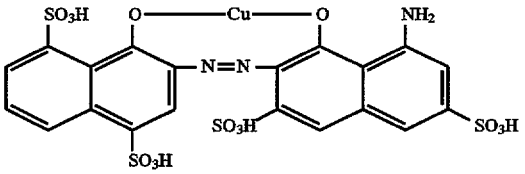
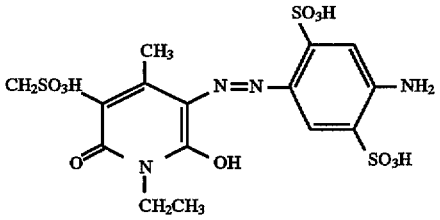
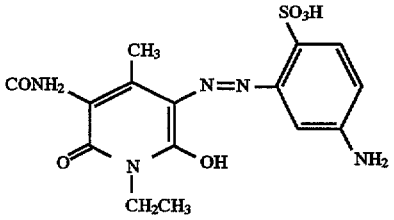
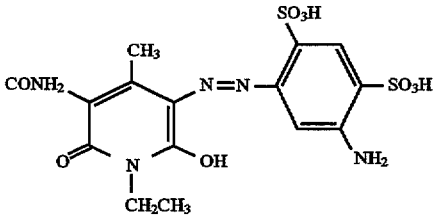
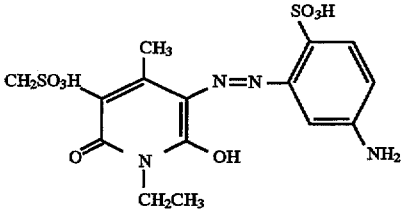

TABLE 1-continued
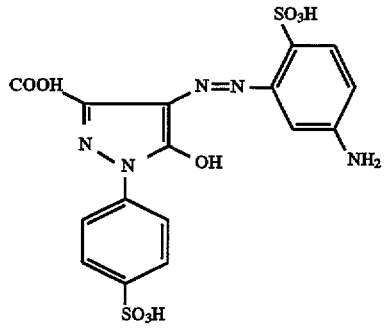
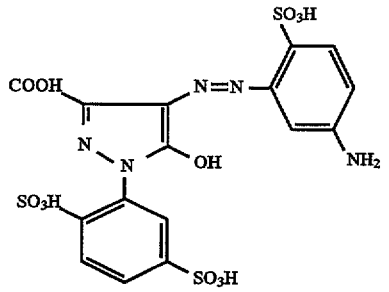
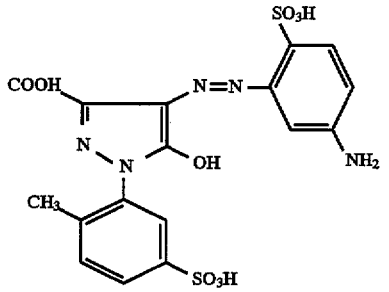
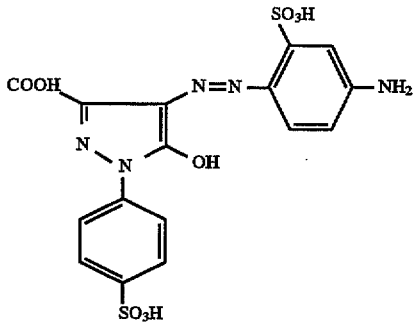
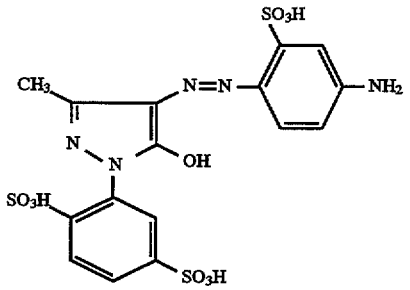

TABLE 1-continued
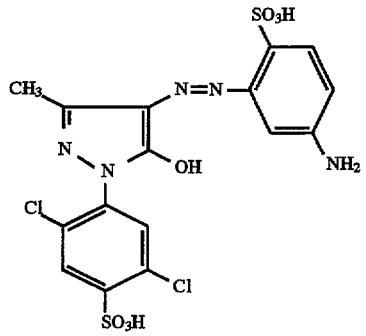
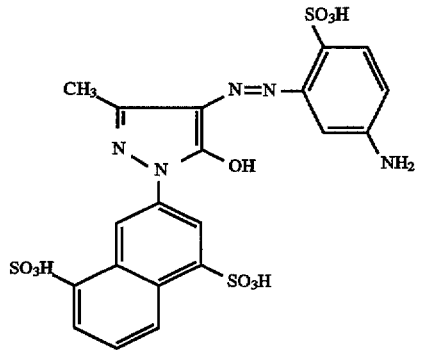
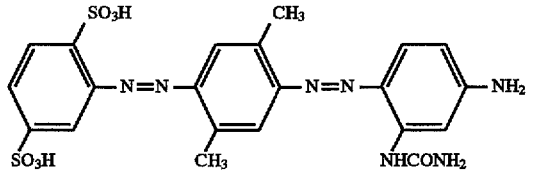
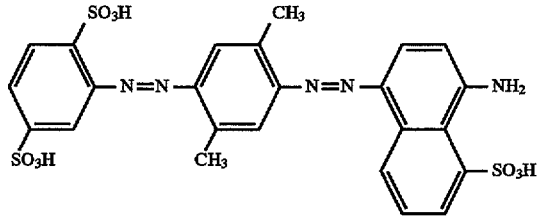
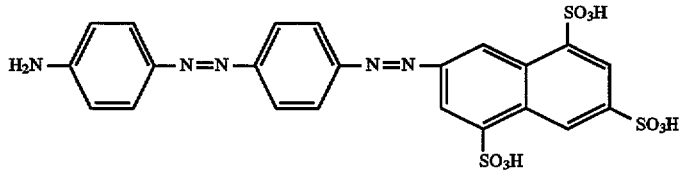
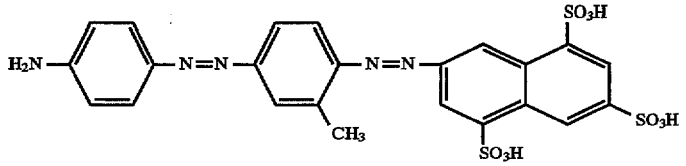
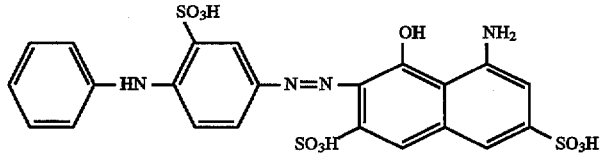

TABLE 1-continued
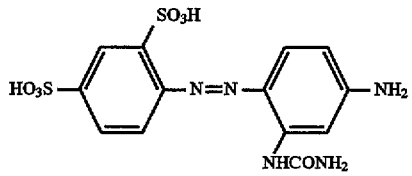
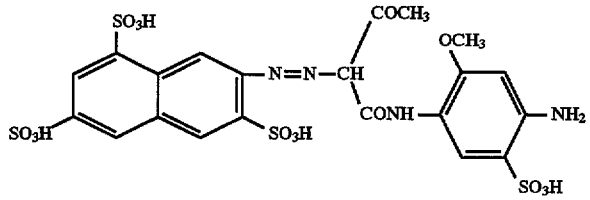
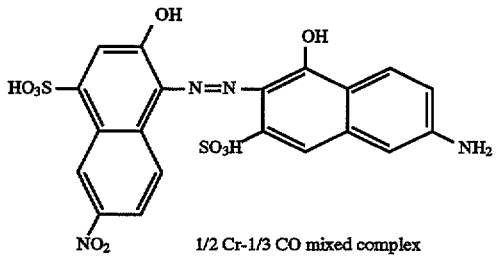
1/2 Cr-1/3 CO mixed complex
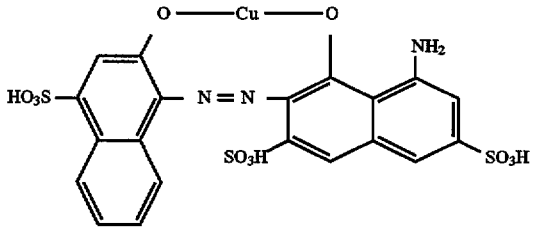
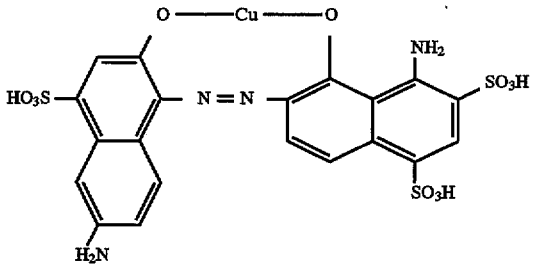
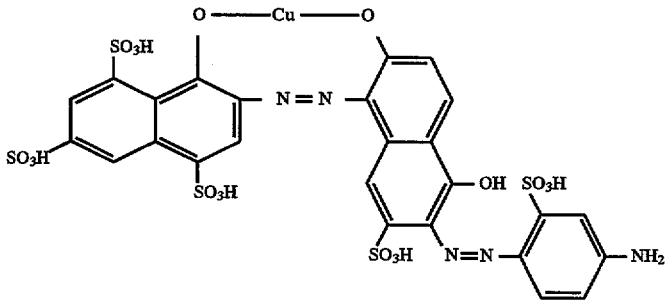

TABLE 1-continued
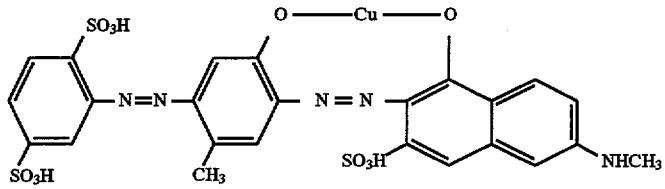
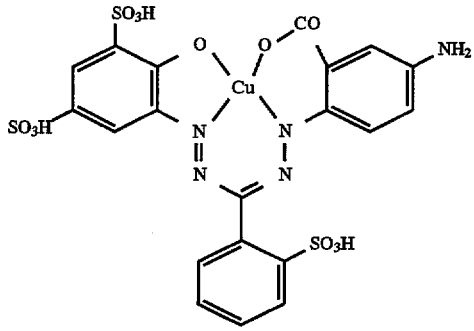
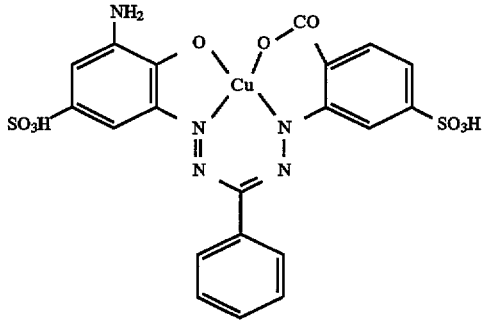
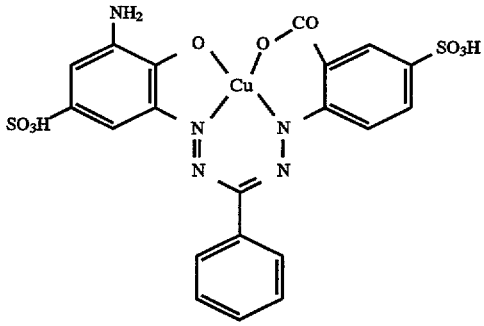
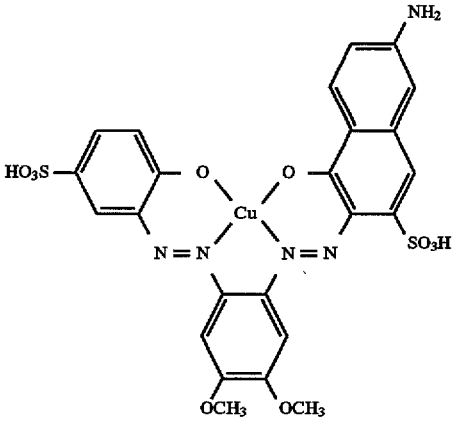

TABLE 1-continued
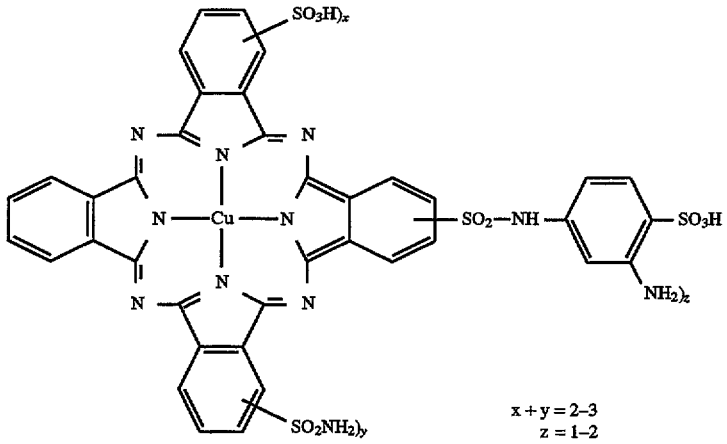
x + y = 2–3
z = 1–2
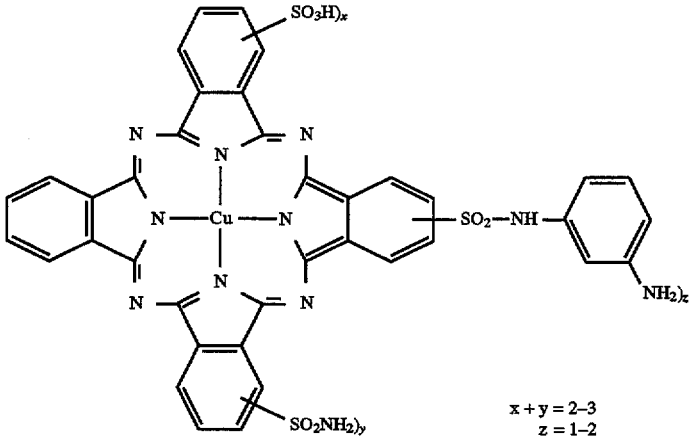
x + y = 2–3
z = 1–2
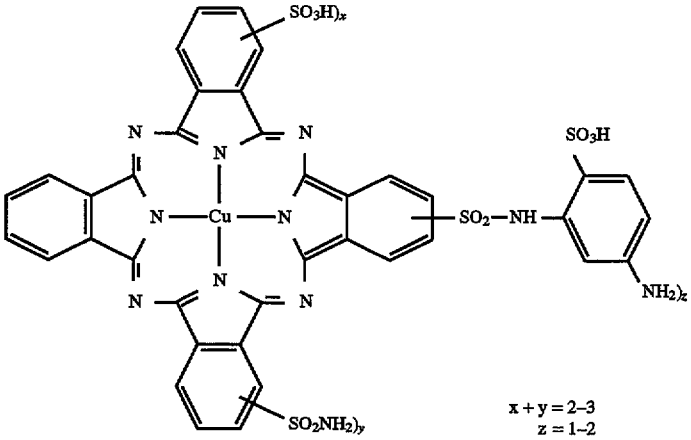
x + y = 2–3
z = 1–2

TABLE 1-continued

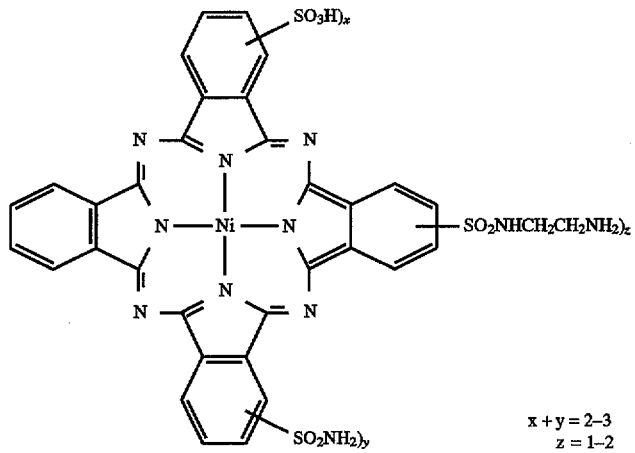

x + y = 2–3
z = 1–2

The reactive dyes and also the direct dyes preferably contain at least one water-solubilizing group, such as a sulfo or sulfato group, and are in this case either in the form of their free acid or preferably as their salts, for example the alkali, alkaline earth metal or ammonium salts or salts of an organic amine. Examples are the sodium, potassium, lithium or ammonium salts or the salt of triethanolamine.

The reactive dyes and also the direct dyes are known or can be prepared analogously to known dyes.

The cationic compounds to be used are advantageously colourless or almost colourless quaternary ammonium salts also carrying at least one polymerisable double bond or are mixtures thereof. Preference is given to those of the general formula $$(R_3R_5R_{5'}R_{5''}N)_m^+(A)^{m-}, \quad (50),$$

in which $R_3$ is a radical of the formula $$CH_2{=}CX_5{-}Y_1{-}Q_4{-} \quad (50a)$$

in which $X_5$ is hydrogen, $C_{1-2}$alkyl or halogen, $Y_1$ is —CO—O—, —CO—NH— or a direct bond, $Q_4$ is $-CH_2CHOH-CH_2-$, $-(CH_2)_z-$ or $-(CH_2-CH_2-O)_z-CH_2-CH_2-$, A is an anion from the group consisting of halides, sulfates, $C_1$–$C_2$alkyl sulfates, thiosulfates, phosphates, carboxylates and sulfonates, $R_5$, $R_{5'}$ and $R_{5''}$, independently of one another are hydrogen, $C_{1-24}$alkyl or $R_3$, or the quaternary nitrogen atom in formula (50) can also be a member of an N heterocyclic ring which may be substituted or unsubstituted and may contain further hetero atoms, m is 1, 2 or 3 and z is an integer between 1 and 20.

Quaternary ammonium salts of the formulae $$CH_2{=}CH{-}CO{-}O{-}CH_2{-}CH_2{-}N(CH_3)_3^+A^- \quad (50b),$$

$$CH_2{=}C(CH_3){-}CO{-}O{-}CH_2{-}CH_2{-}N(CH_3)_3^+A^- \quad (50c),$$

$$CH_2{=}C(CH_3){-}CO{-}NH{-}CH_2{-}CH_2{-}CH_2N(CH_3)_3^+A^- \quad (50d) \text{ or}$$

$$CH_2{=}C(CH_3){-}CO{-}O{-}CH_2{-}CHOH{-}CH_2{-}N(CH_3)_3^+A^- \quad (50e)$$

in which A is as defined above are particularly preferably used.

A further example of such quaternary compounds is the compound of the formula $$(CH_3)_2(CH_2{=}CH{-}CH_2)_2N^+A^- \quad (50f).$$

The nonionic compounds to be used are polymerisable colourless or almost colourless, for example possibly slightly yellowish, monomeric, oligomeric or polymeric compounds or mixtures thereof; for example N—$C_{1-4}$alkylolacrylamide, N-butoxymethylacrylamide, N-isobutoxymethylacrylamide, N—$C_{1-4}$alkylolmethacrylamide, N-butoxymethylmethacrylamide, N-isobutoxymethylmethacrylamide, N,N-di($C_{1-4}$alkylol)acrylamide, N,N-di(butoxymethyl)acrylamide, N,N-di(isobutoxymethyl)acrylamide, N,N-di($C_{1-4}$methylol)methacrylamide, N,N-di(butoxymethyl)methacrylamide, N,N-di(isobutoxymethyl)methacrylamide.

Colourless compounds preferably used in the process according to the invention are monomeric, oligomeric or polymeric organic compounds or mixtures thereof.

Nonionic colourless compounds particularly preferably used in the process according to the invention are acrylates, diacrylates, triacrylates, polyacrylates, acrylic acid, methacrylates, dimethacrylates, trimethacrylates, polymethacrylates, methacrylic acid, acrylamide and acrylamides, diacrylamides, methacrylamide and methacrylamides and dimethacrylamides.

Mixtures of monomeric and oligomeric colourless organic compounds are very particularly preferably used in the process according to the invention.

Very particularly preferably, diacrylates of the general formula $$CH_2{=}CR_{37}{-}CO{-}O{-}(CH_2{-}CH_2{-}O)_w{-}CO{-}CR_{37}{=}CH_2 \quad (51)$$

are used in which $R_{37}$ is hydrogen or $C_{1-2}$alkyl and w is an integer between 1 and 12.

Acrylates of the formula $$CH_2{=}CR_{37}{-}Y_1{-}Q_4{-}R_{11} \quad (52)$$

in which $Y_1$, $Q_4$ and $R_{37}$ are as defined above and, $R_{11}$ is 2-oxazolidon-3-yl are also particularly preferably used.

The colourless nonionic compounds containing at least one polymerisable double bond are free of colouring radicals. They are monomeric, oligomeric or polymeric organic compounds or a mixture thereof which can be polymerised or crosslinked.

A suitable monomeric colourless compound is one having a molecular weight of up to about 1000 and containing at least one polymerisable group.

Bi-, tri- and polyfunctional monomers are also suitable.

The monomeric colourless compound can be used directly by itself or as a mixture with other monomers, oligomers and/or polymers.

A suitable oligomeric colourless compound is one having a molecular weight of between 1000 and 10,000 and containing one or more polymerisable groups. The oligomeric colourless compound can, if liquid, be used directly by itself or as a solution in water or organic solvents or as a mixture with other monomers, oligomers and/or polymers.

A suitable polymeric colourless compound is one having a molecular weight of >10,000 and containing one or more polymerisable groups.

The polymeric colourless compound can, if liquid, be used directly by itself or as a solution in water or organic solvents or as a mixture with other monomers, oligomers, and/or polymers.

Suitable colourless compounds are ethylenically unsaturated monomeric, oligomeric and polymeric compounds.

Examples of particularly suitable compounds are esters of ethylenically unsaturated carboxylic acids and polyols or polyepoxides, and polymers having ethylenically unsaturated groups in the chain or in side groups, for example unsaturated polyesters, polyamides and polyurethanes and copolymers thereof, polybutadiene and butadiene copolymers, polyisoprene and isoprene copolymers, polymers and copolymers having (meth)acrylic groups in side chains, and mixtures of one or more of such polymers.

Examples of unsaturated carboxylic acids are acrylic acid, methacrylic acid, crotonic acid, itaconic acid, cinnamic acid and unsaturated fatty acids, such as linolenic acid or oleic acid. Acrylic and methacrylic acid are preferred.

Suitable polyols are aliphatic and cycloaliphatic polyols. Examples of polyepoxides are those based on polyols and epichlorohydrin. Furthermore, suitable polyols are also polymers or copolymers containing hydroxyl groups in the polymer chain or side groups, for example polyvinyl alcohol and copolymers thereof or poly(hydroxyalkyl) methacrylates or copolymers thereof. Further suitable polyols are hydroxyl-terminated oligoesters.

Examples of aliphatic and cycloaliphatic polyols are alkylenediols having preferably 2 to 12 C atoms, such as ethylene glycol, 1,2- or 1,3-propanediol, 1,2-, 1,3- or 1,4-butanediol, pentanediol, hexanediol, octanediol, dodecanediol, diethylene glycol, triethylene glycol, polyethylene glycols having molecular weights of, preferably, 200 to 1500, 1,3-cyclopentanediol, 1,2-, 1,3- or 1,4-cyclohexanediol, 1,4-dihydroxymethylcyclohexane, glycerol, tris(β-hydroxyethyl)amine, trimethylolethane, trimethylolpropane, pentaerythritol, dipentaerythritol and sorbitol.

The polyols can be partially or completely esterified with one or various unsaturated carboxylic acids, it being possible for the free hydroxyl groups in partial esters to be modified, for example esterified, or to be esterified with other carboxylic acids.

Examples of esters are:

trimethylolpropane triacrylate, trimethylolethane triacrylate, trimethylolpropane trimethacrylate, trimethylolethane trimethacrylate, tetramethylene glycol dimethacrylate, triethylene glycol dimethacrylate, tetraethylene glycol diacrylate, pentaerythritol diacrylate, pentaerythritol triacrylate, pentaerythritol tetraacrylate, dipentaerythritol diacrylate, dipentaerythritol triacrylate, dipentaerythritol tetraacrylate, dipentaerythritol pentaacrylate, dipentaerythritol hexaacrylate, tripentaerythritol octaacrylate, pentaerythritol dimethacrylate, pentaerythritol trimethacrylate, dipentaerythritol dimethacrylate, dipentaerythritol tetramethacrylate, tripentaerythritol octamethacrylate, pentaerythritol diitaconate, dipentaerythritol triitaconate, dipentaerythritol pentaitaconate, dipentaerythritol hexaitaconate, ethylene glycol dimethacrylate, 1,3-butanediol diacrylate, 1,3-butanediol dimethacrylate, 1,4-butanediol diitaconate, sorbitol triacrylate, sorbitol tetraacrylate, modified pentaerythritol triacrylate, sorbitol tetramethacrylate, sorbitol pentaacrylate, sorbitol hexaacrylate, oligoester acrylates and oligoester methacrylates, glycerol di- and triacrylate, 1,4-cyclohexanediol diacrylate, bisacrylates and bismethacrylates of polyethylene glycol of molecular weight 200–1500, or mixtures thereof.

Suitable colourless compounds are also the amides of the same or different unsaturated carboxylic acids with aromatic, cycloaliphatic and aliphatic polyamines having preferably 2 to 6, in particular 2 to 4, amino groups. Examples of such polyamines are ethylenediamine, 1,2- or 1,3-propylenediamine, 1,2-, 1,3- or 1,4-butylenediamine, 1,5-pentylenediamine, 1,6-hexylenediamine, octylenediamine, dodecylenediamine, 1,4-diaminocyclohexane, isophoronediamine, phenylenediamine, bisphenylenediamine, di-β-aminoethyl ether, diethylenetriamine, triethylenetetramine, di-(β-aminoethoxy)- or di-(β-aminopropoxy)ethane. Further suitable polyamines are polymers and copolymers containing amino groups in the side chain and amino-terminated oligoamides.

Examples of such unsaturated amides are: methylenebisacrylamide, 1,6-hexamethylenebisacrylamide, diethylenetriaminetrismethacrylamide, bis(methacrylamidopropoxy)ethane, β-methacrylamidoethyl methacrylate, N-[(β-hydroxyethoxy)ethyl]acrylamide.

Suitable unsaturated polyesters and polyamides are derived, for example, from maleic acid and diols or diamines. Maleic acid can be replaced in part by other dicarboxylic acids. They can be used together with ethylenically unsaturated comonomers, for example styrene. The polyesters and polyamides can also be derived from dicarboxylic acids and ethylenically unsaturated diols or diamines, in particular from longer-chain ones having, for example, 6 to 20 C atoms. Examples of polyurethanes are those synthesized from saturated or unsaturated diisocyanates and unsaturated or saturated diols.

Polybutadiene and polyisoprene and copolymers thereof are known. Examples of suitable comonomers are olefins, such as ethylene, propene, butene, hexene, (meth)acrylate, acrylonitrile, styrene or vinyl chloride. Polymers having (meth)acrylate groups in the side chain are also known. They can be, for example, reaction products of novolak-based epoxy resins with (meth)acrylic acid, homo- or copolymers of polyvinyl alcohol or hydroxyalkyl derivatives thereof esterified with (meth)acrylic acid, or homo- and copolymers of (meth)acrylates esterified with hydroxyalkyl (meth) acrylates.

The colourless compounds can be used by themselves or in any desired mixture.

Examples of suitable oligomeric or polymeric colourless compounds are preferably various polyester acrylates, for example $CH_2=CH-[CO-O(CH_2)_n]-CO-O-CH=CH_2$, epoxy acrylates, for example $(CH_2=CH-CO-O-CH_2-CHOH-CH_2-O-C_6H_4)_2C(CH_3)_2$, urethane acrylates, for example

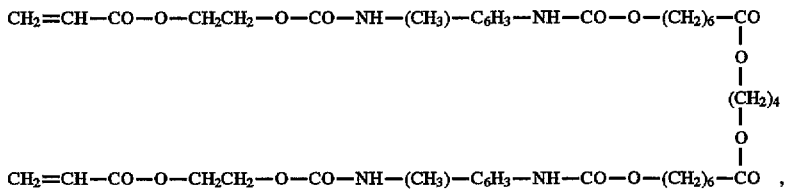

polyether acrylates, for example

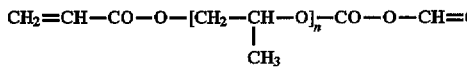

and silicone acrylates, such as disclosed in Textilpraxis International (1987), pages 848–852.

In a preferred embodiment of the process according to the invention, the colourless compounds used are those having an acrylic radical as the polymerisable group, particular preference being given to oligomeric polyether acrylates, polyurethane acrylates and polyester acrylates.

The colourless compound used in the process according to the invention is in particular N-vinylpyrrolidine, acrylic acid, butyl acrylate, 2-ethylhexyl acrylate, 2-hydroxyethyl acrylate, hydroxypropyl acrylate, butanediol monoacrylate, 2-ethoxyethyl acrylate, ethylene glycol acrylate, butanediol acrylate, 2-ethoxyethyl acrylate, ethylene glycol acrylate, bisacrylates of polyethylene glycol having a molecular weight of 200 to 1500, butanediol diacrylate, tetraethylene glycol diacrylate, 1,6-hexanediol diacrylate, diethylene glycol diacrylate, dipropylene glycol diacrylate, triethylene glycol diacrylate, tripropylene glycol diacrylate, trimethylolpropane triacrylate, pentaerythritol triacrylate, bromoacrylamide, methylenebisdi(bromoacrylamide), methylenebis(diacrylamide), N-alkoxyacrylamide, tetraethylene glycol diacrylate, soya bean oil acrylate, polybutadiene acrylate, diethylene glycol dimethacrylate, 1,6-hexanediol dimethacrylate, 2-(2-ethoxyethoxy)ethyl acrylate, stearyl acrylate, tetrahydrofurfuryl acrylate, pentaerythritol tetraacrylate, lauryl acrylate, 2-phenoxyethyl acrylate, ethoxylated bisphenol diacrylate, di(trimethylolpropane) tetraacrylate, tris(2-hydroxyethyl) isocyanurate triacrylate, isodecyl acrylate, dipentaerythritol pentaacrylate, ethoxylated trimethylolpropane triacrylate, isobornyl acrylate, ethoxylated tetrabromobisphenol diacrylate, propoxylated neopentylglycol diacrylate, propoxylated glyceryl triacrylate.

The cationic polymerisable compounds can be used in combination with one another or with the nonionic polymerisable compounds. Preferably, combinations of the quaternary salts of the formula $$CH_2=CH-CO-O-CH_2-CH_2-N(CH_3)_3^+A^- \quad (50b),$$

$$CH_2=C(CH_3)-CO-O-CH_2-CH_2-N(CH_3)_3^+A^- \quad (50c),$$

$$CH_2=C(CH_3)-CO-NH-CH_2-CH_2-CH_2-N(CH_3)_3^+A^- \quad (50d),$$

$$CH_2=C(CH_3)-CO-O-CH_2-CHOH-CH_2-N(CH_3)_3^+A^- \quad (50e) \text{ or}$$

$$(CH_3)_2(CH_2=CH-CH_2)_2N^+A^- \quad (50f)$$

with a bireactive acrylic compound of the formula $$CH_2=CR_{37}-CO-O-(CH_2-CH_2-O)_{w'}-CO-CR_{37}=CH_2 \quad (51a)$$

are used, in which $R_{37}$ is hydrogen or $C_{1-2}$alkyl and w' is an integer between 1 and 9.

Also preferably, the combinations of the quaternary ammonium salts of the formula $$CH_2=CH-CO-O-CH_2-CH_2-N(CH_3)_3^+A^- \quad (50b),$$

$$CH_2=C(CH_3)-CO-O-CH_2-CH_2-N(CH_3)_3^+A^- \quad (50c),$$

$$CH_2=C(CH_3)-CO-NH-CH_2-CH_2-CH_2-N(CH_3)_3^+A^- \quad (50d),$$

$$CH_2=C(CH_3)-CO-O-CH_2-CHOH-CH_2-N(CH_3)_3^+A^- \quad (50e) \text{ or}$$

$$(CH_3)_2(CH_2=CH-CH_2)_2N^+A^- \quad (50f)$$

with a reactive acrylic compound of the formula $$CH_2=CR_{37}-Y_1-Q_4-R_{11} \quad (52)$$

in which $Y_1$, $Q_4$, and $R_{37}$ are as defined above and $R_{11}$ is 2-oxazolidon-3-yl and a bireactive acrylic compound of the formula (51a) are used.

The printing pastes or dyeing liquors can also contain, in addition to the dye and the polymerizable compounds according to the invention, customary additives such as thickeners, dyeing assistants, fillers, dispersants, lubricants, antioxidants and polymerization inhibitors. The latter are usually also added to the polymerizable compounds as stabilizers.

The process according to the invention can be applied to a wide range of fibres, for example fibres of animal origin, such as wools, silks, hair (for example in the form of felt), or regenerated polymer fibres, such as regenerated protein fibres or alginate fibres, synthetic fibres, such as polyvinyl, polyacrylonitrile, polyester, polyamide, aramid, polypropylene or polyurethane fibres and in particular cellulose-containing materials, such as bast fibres, for example linen, hemp, jute, ramie and, in particular, cotton, and regenerated cellulose fibres, such as viscose fibres or modal fibres, cuprammonium, nitrocellulose or hydrolysed acetate fibres or fibres made of cellulose acetate, such as acetate fibre, or fibres made of cellulose triacetate, such as Arnel, Trilan®, Courpleta® or Tricel®.

The fibres mentioned can be present in forms such as are used in particular in the textile industry, for example as filaments or yarns or as woven fabrics, knitted fabrics or non-wovens, such as felts.

Fibre materials preferably used in the process according to the invention are wool, silk, hair, alginate fibres, polyvinyl, polyacrylonitrile, polyester, polyamide, aramid, polypropylene or polyurethane fibres or cellulose-containing fibres.

Particularly preferably, cellulose fibres, polyester-cellulose combination weaves and knits and intimate polyester-cellulose fibre blends are used.

Treatment of the material to be dyed with a dye according to the definition can take place in the usual manner, for example, in the case of a textile fabric, by impregnation with a dye solution in an exhaust bath or by spraying onto the fabric or by padding with a padding solution, or by printing, for example, in a screen printing machine or by means of the ink-jet printing method.

The dye and colourless compounds can be applied together in the form of a solution, suspension, emulsion or foam according to customary methods.

The dyed fibre material can be irradiated in the wet, moist or dry state.

In general, the colourless compounds, the photoinitiator and the remaining additives are applied to the material to be dyed together with the dye. However, it is also possible to apply the colourless compounds, or the colourless compounds and the photoinitiator and, if desired, the polymerization co-initiators separately, for example, in the form of a pre- or aftertreatment. In the case where a water-insoluble photoinitiator is used and the dyeing is produced by the exhaust method or by padding, it is advantageous first to impregnate the woven fabric or knitted fabric with the photoinitiator and then to dye it with the dye liquor also containing a photoinitiator.

Emulsion printing processes in which the mixture of the radiation-polymerisable compounds replaces the hydrophobic component, so that neither varnish-makers' and painters' naphtha nor thickeners are required, are also advantageous.

The process is suitable in particular for carrying out continuous dyeing and fixation processes but the process or individual steps thereof can also be carried out batchwise.

The process of the invention is carried out for example by passing the textile material which has been dyed and treated with a solution of a colourless compound through the beam of an electron accelerator at room temperature. This is done at such a speed that a certain radiation dose is achieved. The radiation doses to be used are normally between 0.1 and 15 Mrad, advantageously between 0.1 and 4 Mrad. A dose of less than 0.1 Mrad will generally result in too low a degree of fixation, while a dose of more than 15 Mrad will effectively give rise to damage to the fibre material and to the dye. The concentration of dye in the dye solutions or print pastes used can be chosen as for conventional dyeing or printing processes, for example 0.001 to 20% by weight based on the fibre material used. After the treatment with ionizing radiation the dyed or printed material need additionally only be dried. The attainable degrees of fixation are high, for example more than 80%. The process of the invention produces dyeings having generally good fastness properties, for example good water and light fastness properties.

When carrying out the process according to the invention it is of course necessary to take account of the particular technical preconditions. Thus, the specific embodiment depends in particular on the nature of the ionizing rays to be used and on their method of generation. If, for example, a yarn roll impregnated with dye solution and with the solution of the colourless compound is to be irradiated with γ-rays, it will be exposed to the radiation enclosed in a cell. If a higher dose of radiation is to be produced from rays of low intensity, the material to be irradiated can be exposed to the radiation in a plurality of passes.

To prevent oxidative destruction of the dye, it is advantageous to carry out the irradiation in the atmosphere of an inert protective gas, for example under nitrogen.

In a preferred embodiment of the process according to the invention, not only the fixation of fibre material with appropriate dyes but also the dyeing or printing is carried out continuously.

Furthermore, the invention relates to preparations comprising a dye containing no polymerisable double bond, at least one colourless cationic compound containing at least one polymerisable double bond, and, if desired, one or more colourless nonionic compounds containing at least one polymerisable double bond. If UV-light is used, the presence of at least one photoinitiator is necessary. Preferred preparations contain those preferred individual components whose details have been given in the description of the dyes and colourless binders. These preparations can contain further additives customary for dyeing or printing. These preparations are thus also to be understood as including print pastes which are suitable for emulsion printing.

Preference is given to preparations comprising (a) 5–30 parts by weight of a dye, (b) 5–70 parts by weight of a colourless cationic compound, (c) 0–60 parts by weight of a nonionic colourless compound and (d) 0–5 parts by weight of a photoinitiator, relative to 100 parts by weight of the preparation.

Particular preference is given to preparations comprising

10–20 parts by weight of component (a),

10–60 parts by weight of component (b),

0–60 parts by weight of component (c) and

0–3 parts by weight of component (d), relative to 100 parts by weight of the preparation.

In order to prepare a dye liquor or print paste, the concentrated preparations described can be diluted to any desired, required dye concentration, it being possible for the nonionic colourless component (c), in the case where it is not already present in the preparations, either to be added to the liquor in concentrations of 50–125 g/l or to have already previously been applied to the fibre material in concentrations of 30–90 g/kg.

In the embodiment examples which follow, the radiation doses are expressed in the usual way in Mrad (megarad), 1 rad corresponding to an absorption of $10^{-2}$ J/kg (joule/kg). Irradiation with UV is carried out using a 120 watt/cm medium pressure mercury lamp at transport speeds of 8 m/min.

The fabric specified in the examples which follow is printed on one side or pad-dyed and irradiated under a protective gas atmosphere. Dyeings are irradiated from both sides, in two passes. After irradiation, the dyeings are washed off as usual for reactive dyes.

The degrees of fixation of the dye are determined from the dye contents of the extracts of two punched-out specimens, both 2.5 $cm^2$ in size, one which had been irradiated but not washed off and one which had not been irradiated. The specimens are treated with 25 ml of a solution of 600 ml/l of phosphate buffer (pH 7) and 40 ml/l of tetramethylurea in deionized water for 20 minutes once at room temperature and then once at 100° C. The two extracts of each specimen are combined and measured by spectroscopy. The degrees of fixation are determined from the absorbances (at $\lambda_{max}$) of the extracts of the corresponding punched-out specimens.

The oligoethylene glycol acrylate used has an average molecular weight of 508 g/mol.

Parts and percentages are by weight. Temperatures are reported in degree Celsius. Parts by weight relate to parts by volume as the gram relates to the cubic centimeter.

EXAMPLE 1

A bleached and mercerized cotton cretonne fabric is padded (wet pick-up about 70%) with a mixture containing 30 g/l of a dye of the formula

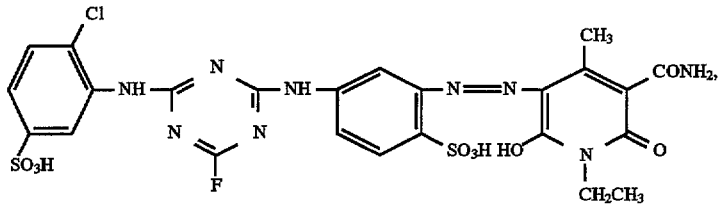

(100)

100 g/l of an oligoethylene glycol diacrylate, 85 g/l of trimethylammoniumethyl methacrylate chloride, and 100 g/l of urea. The fabric is dried and then irradiated both sides with accelerated electrons to a dose of 1 Mrad per side. The result is a brilliant yellow dyeing having a degree of fixation of 84%.

Instead of the dye of formula (100) it is also possible to use the dyes listed in Table 2.

TABLE 2

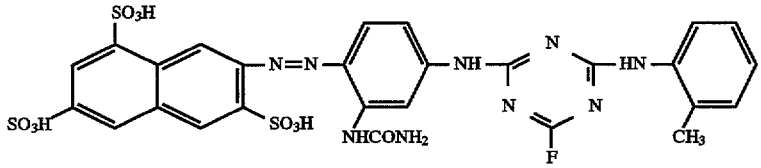

(101)

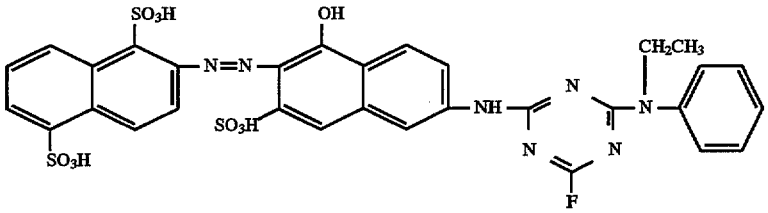

(102)

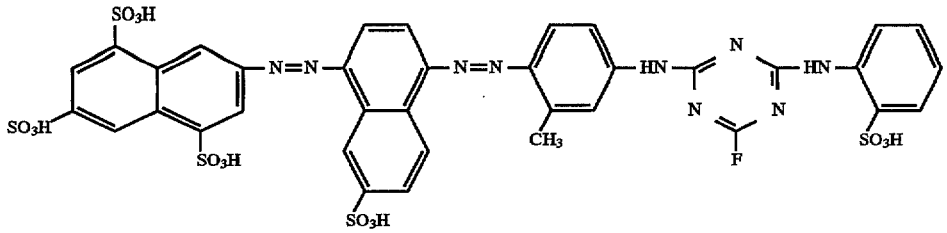

(103)

TABLE 2-continued
(104)
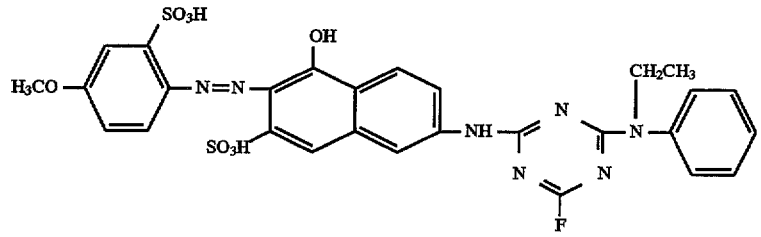
(105)
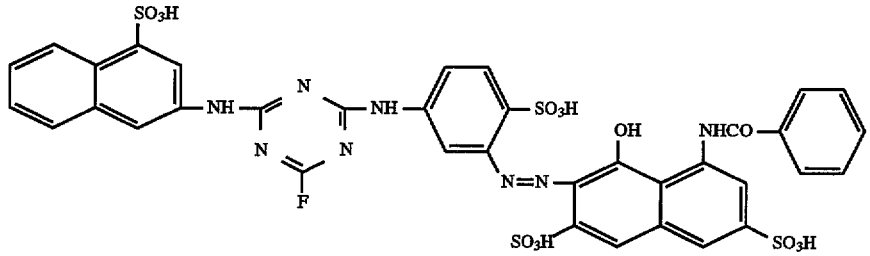
(106)
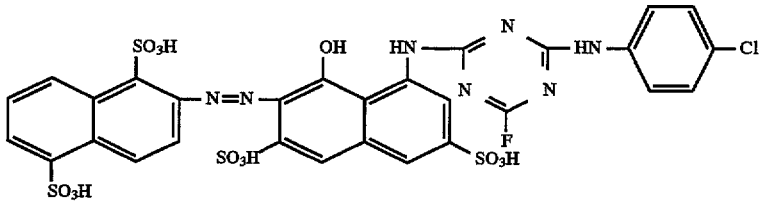
(107)
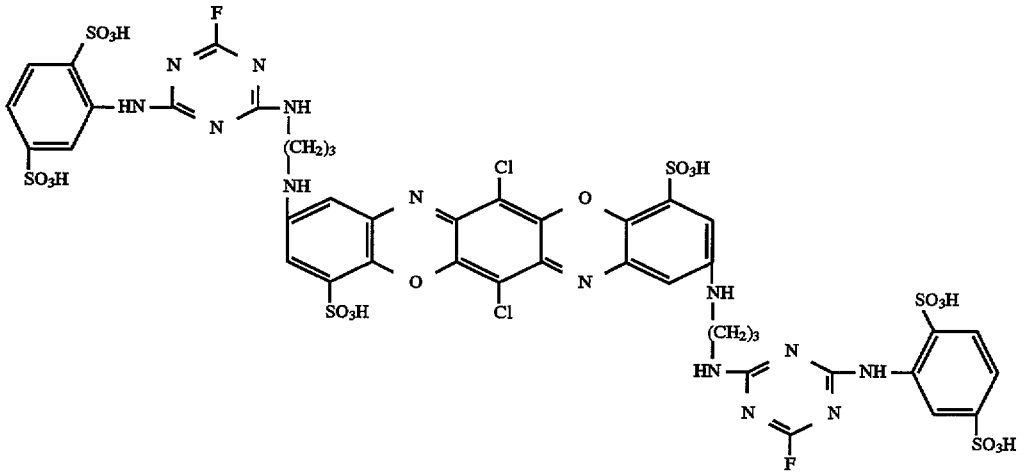
(108)
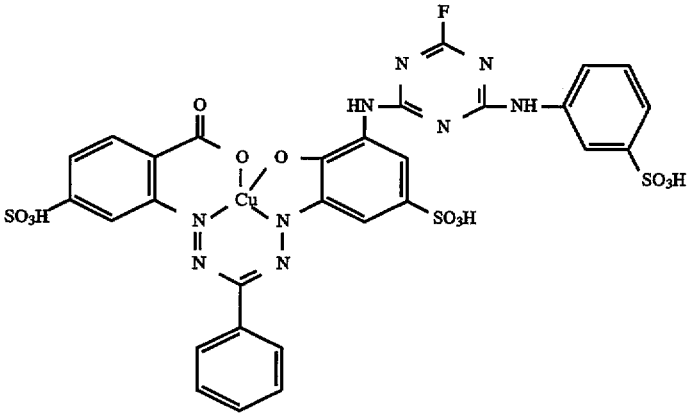

TABLE 2-continued
(109)
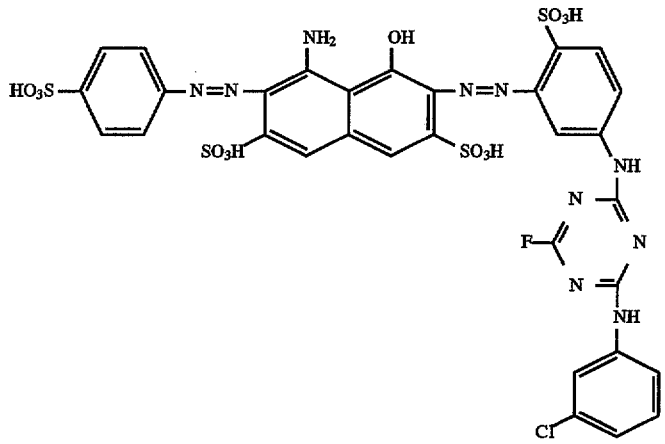
(110)
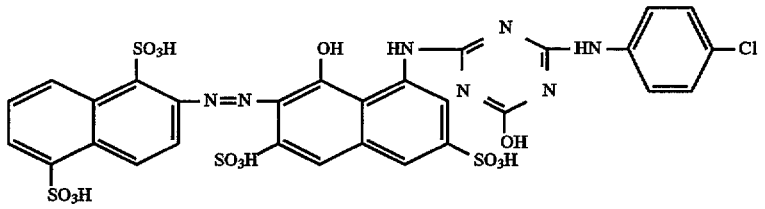
(111)
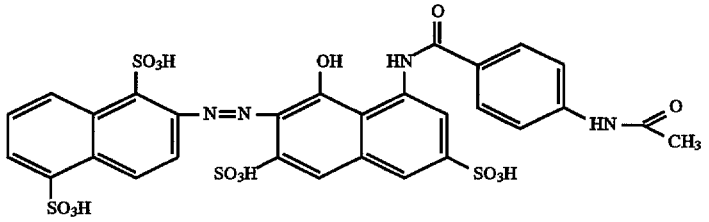
(112)
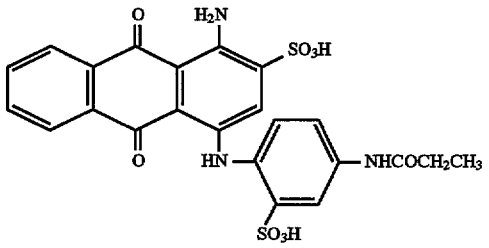
(113)
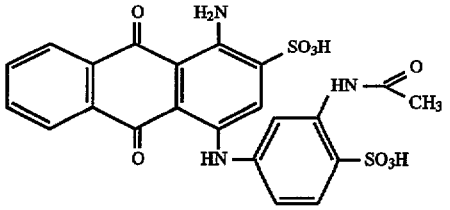
(114)
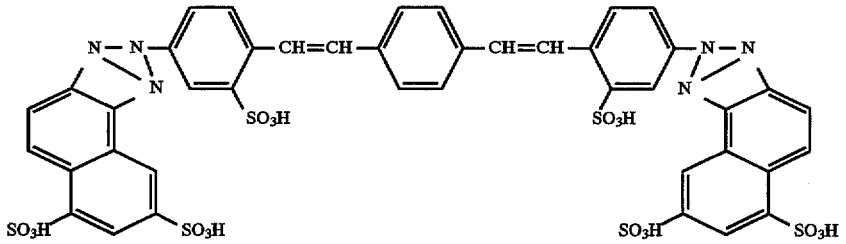

TABLE 2-continued
(115)
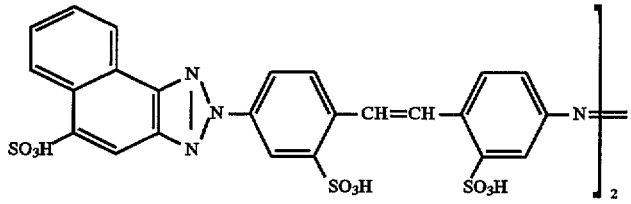
(116)
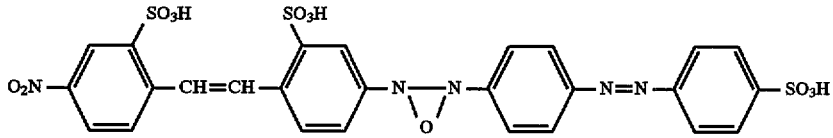
(117)
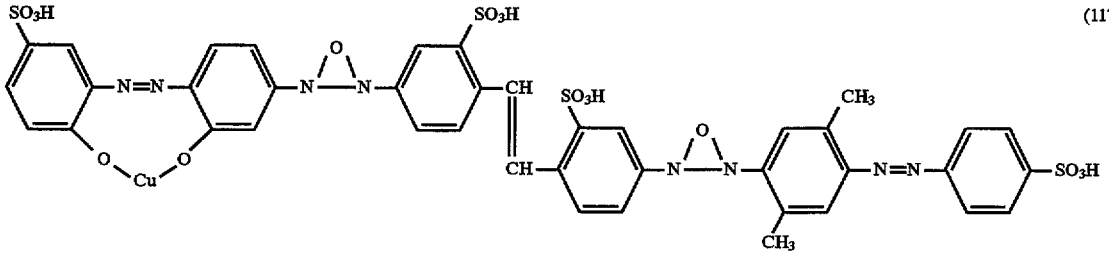
(118)
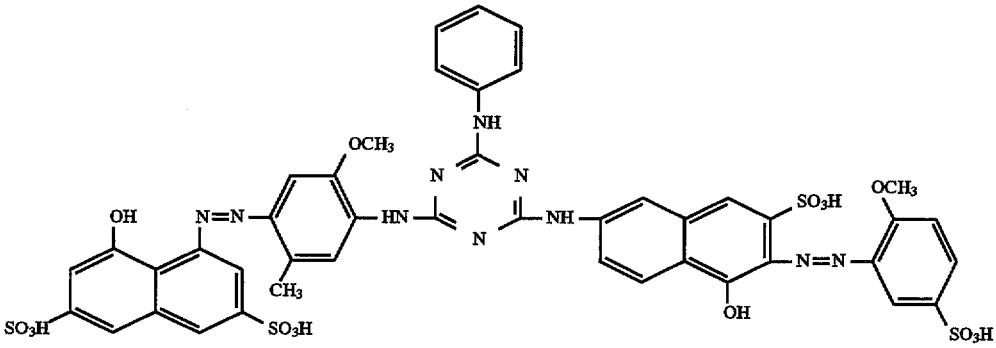
(119)
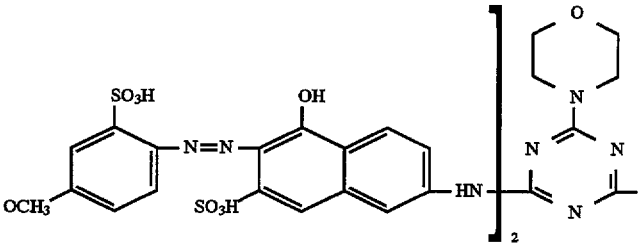
(120)
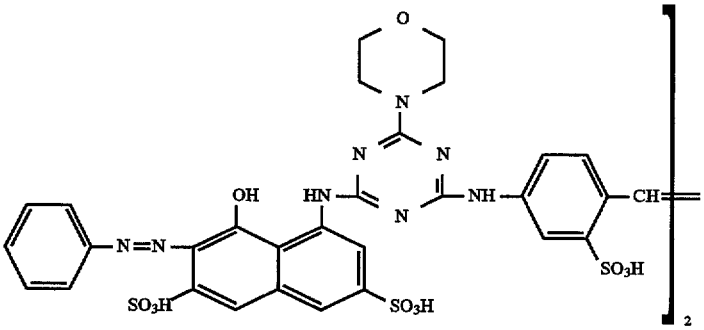

TABLE 2-continued
(121)
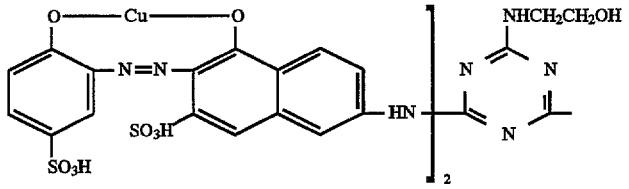
(122)
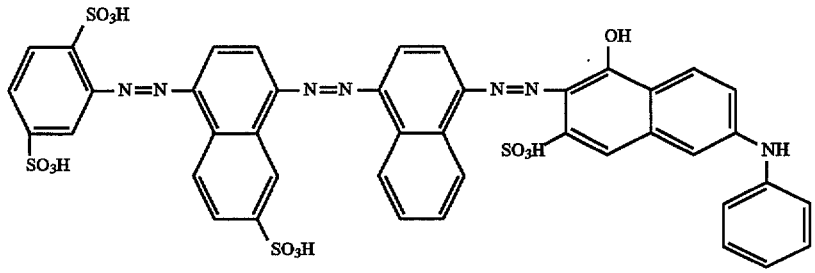
(123)
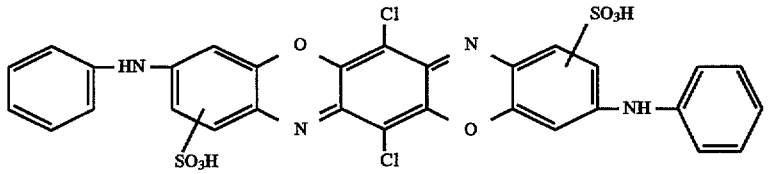
(124)
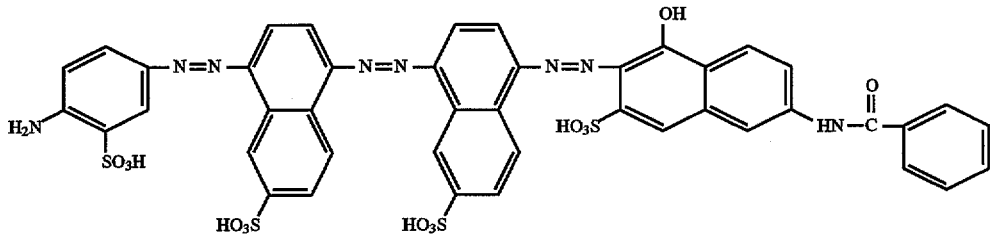
(125)
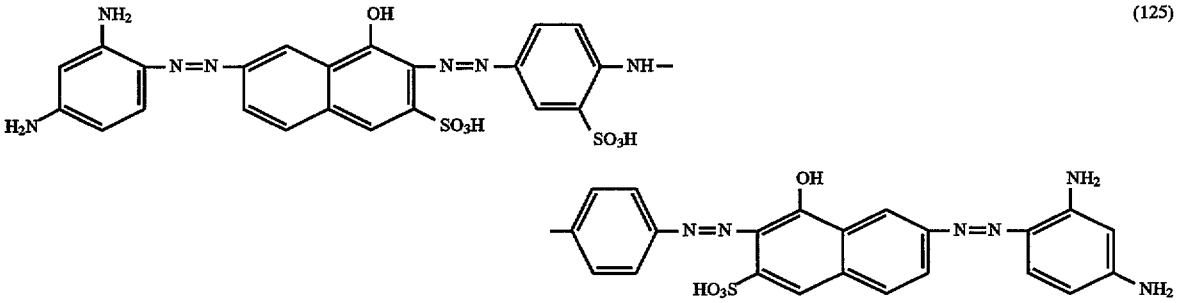
(126)
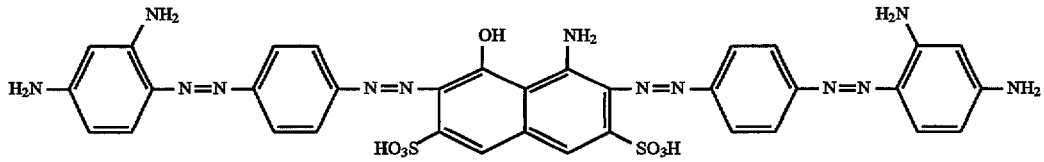
(127)
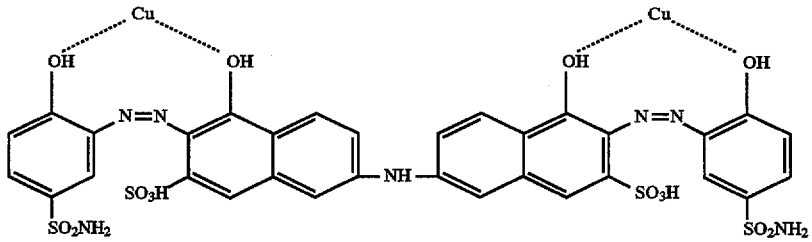

TABLE 2-continued
(128)
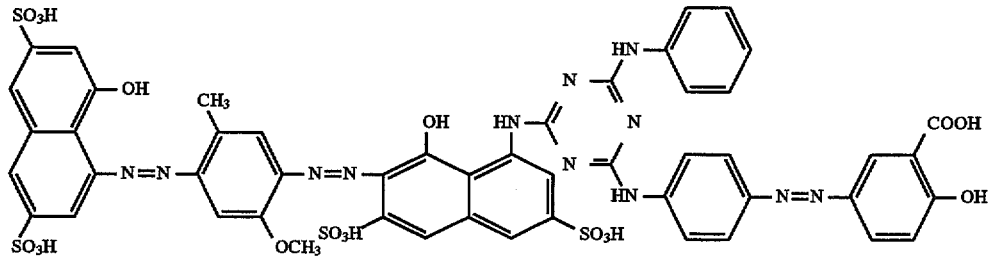
(129)
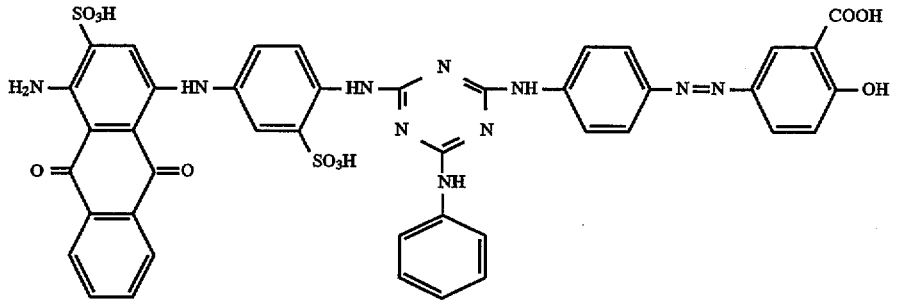
(130)
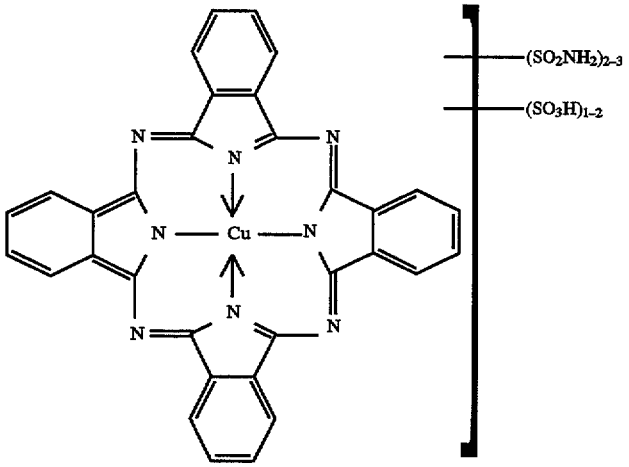
(131)
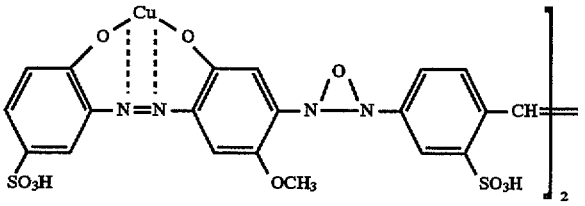
(132)
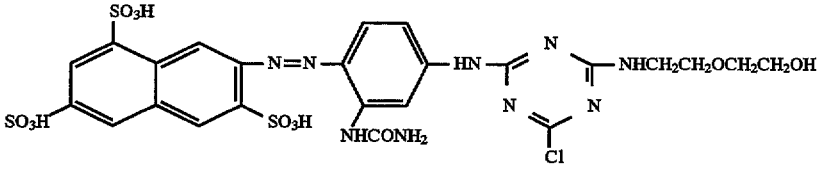

TABLE 2-continued
(133)
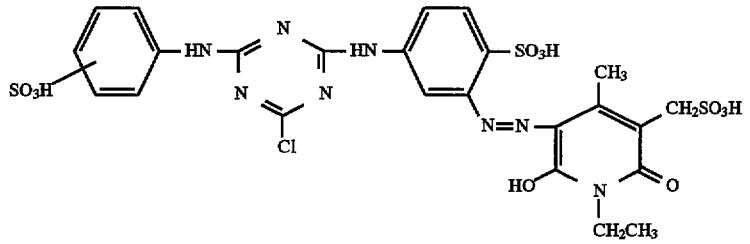
(134)
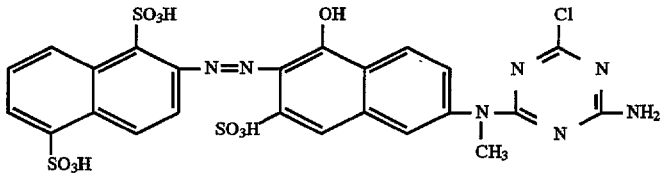
(135)
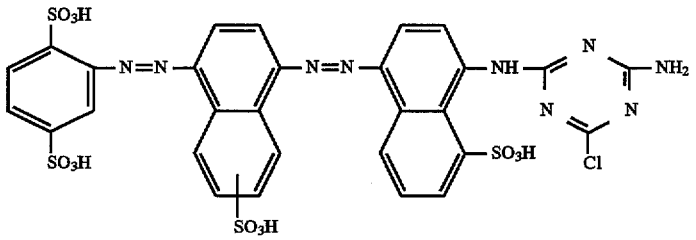
(136)
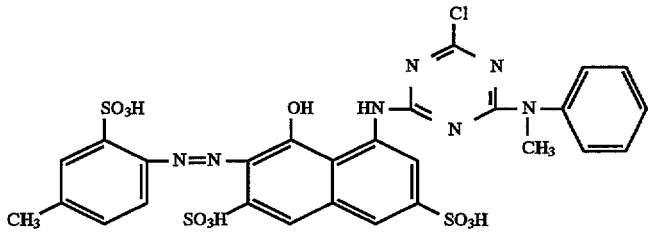
(137)
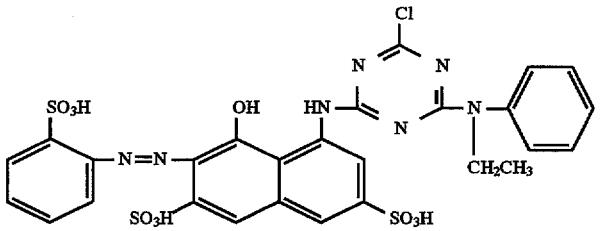
(138)
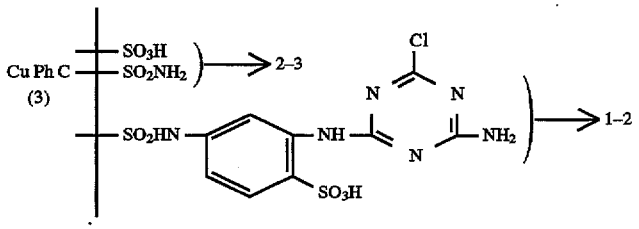

TABLE 2-continued
(139)
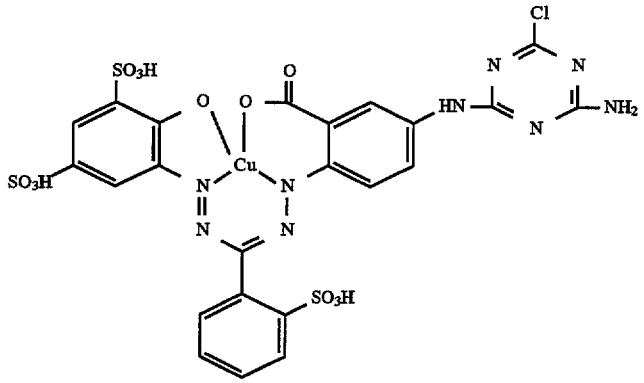
(140)
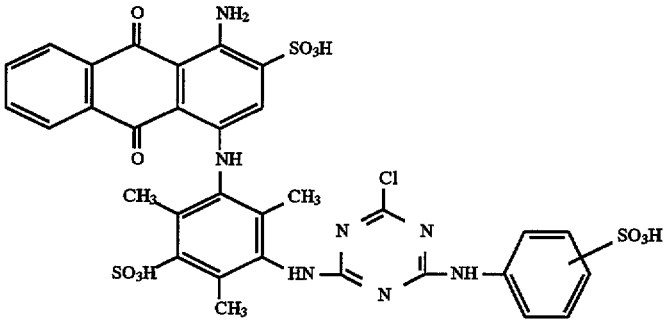
(141)
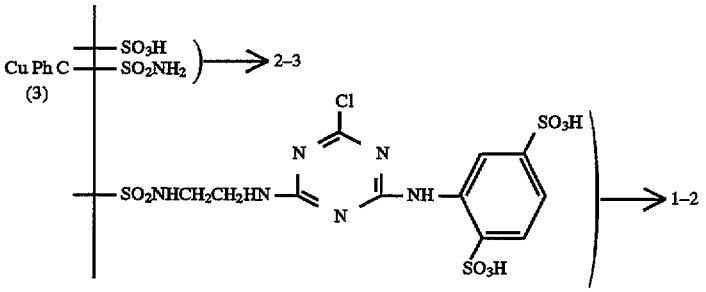
(142)
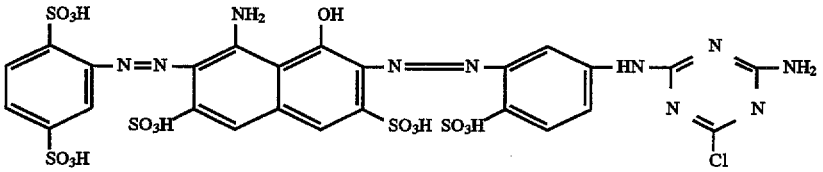
(143)
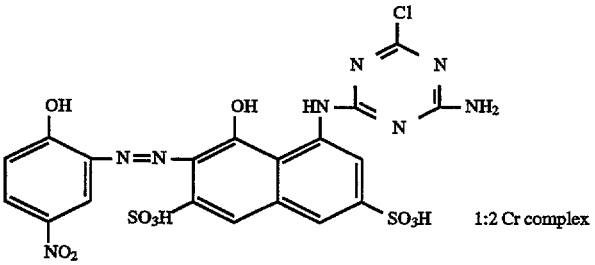

TABLE 2-continued
(144)
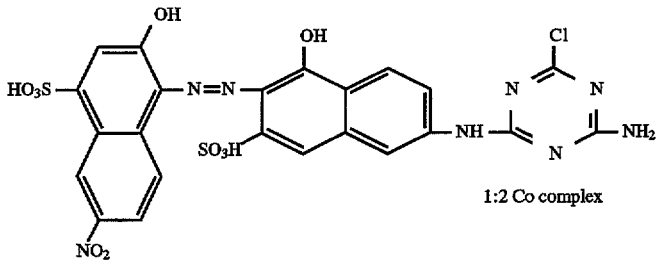
1:2 Co complex
(145)
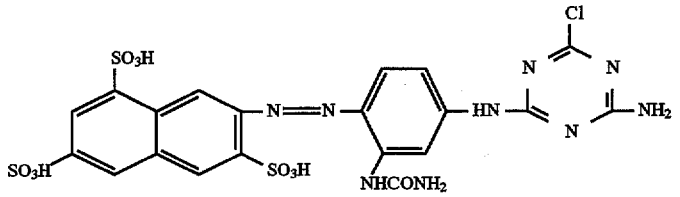
(146)
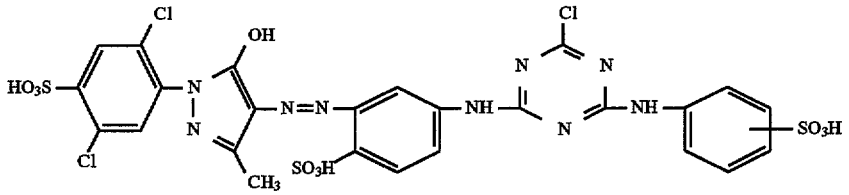
(147)
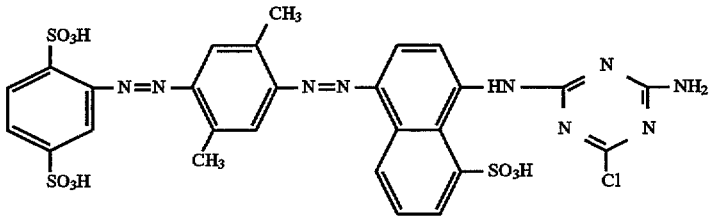
(148)
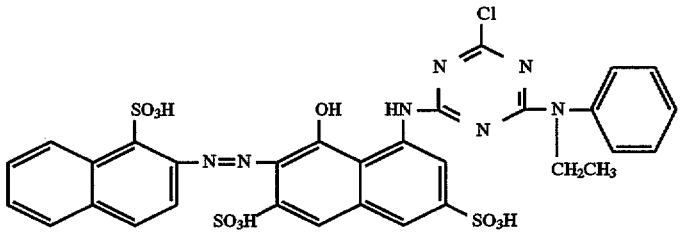
(149)
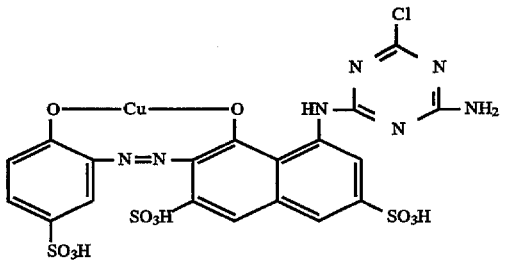

TABLE 2-continued
(150)
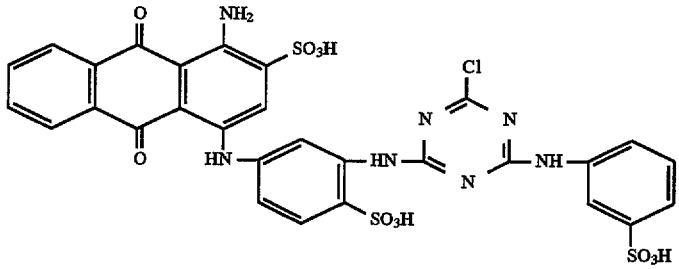
(151)
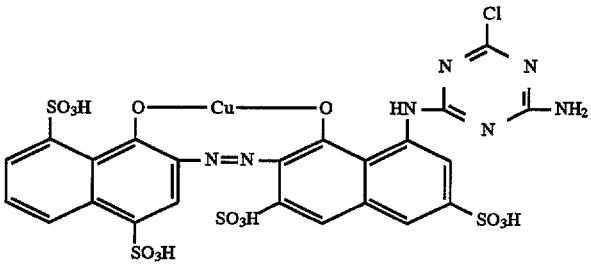
(152)
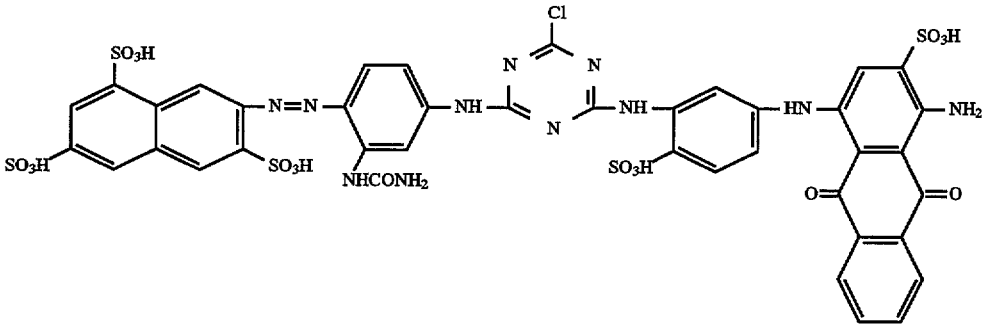
(153)
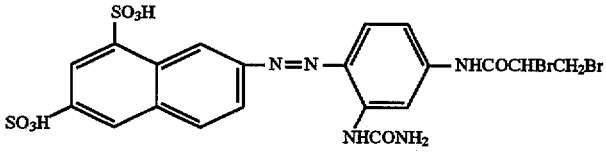
(154)
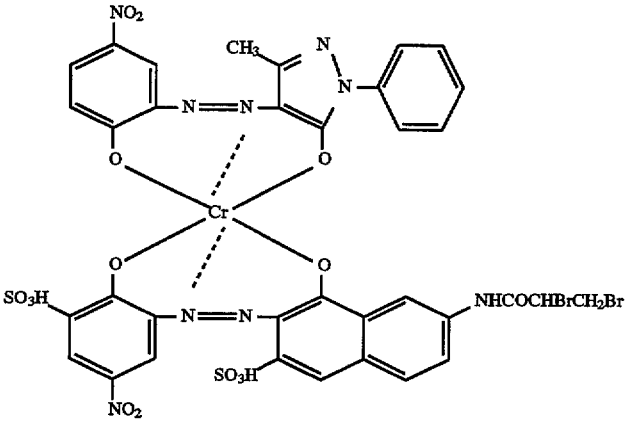

TABLE 2-continued
(155)
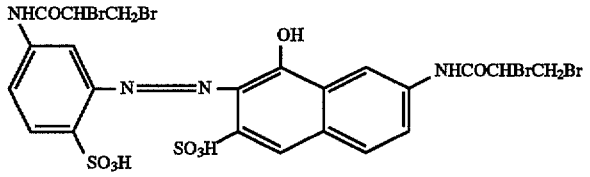
(156)
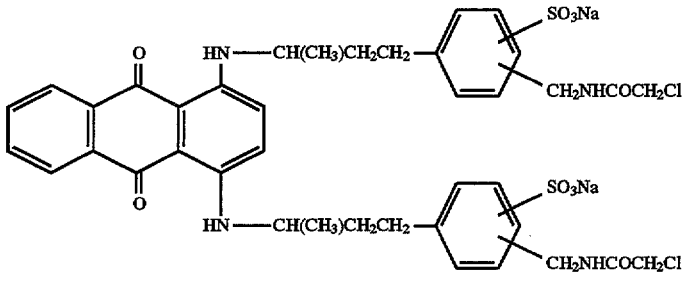
(157)
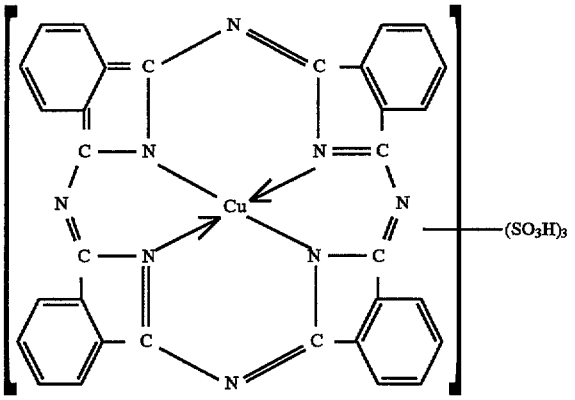
(158)
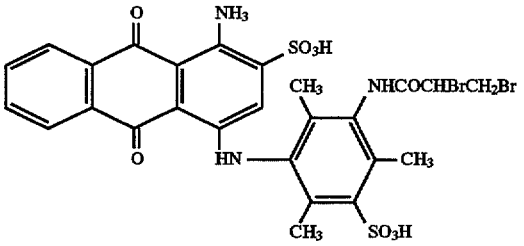
(159)
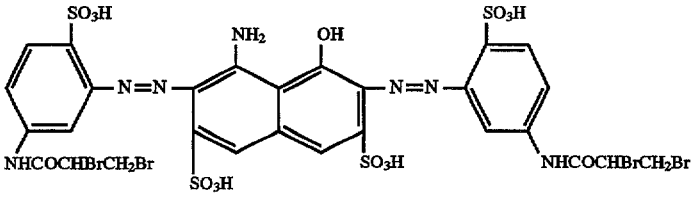
(160)
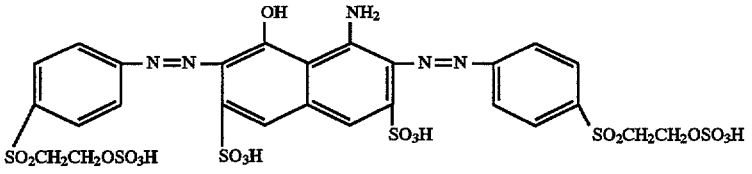

TABLE 2-continued
(161)
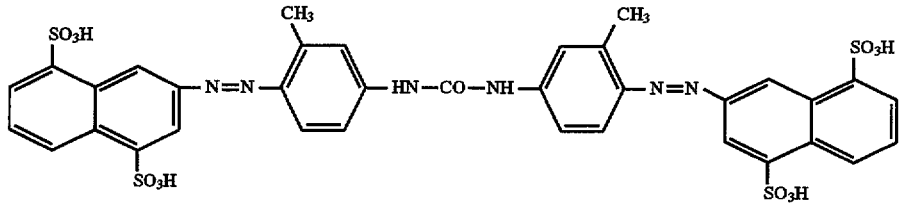
(162)
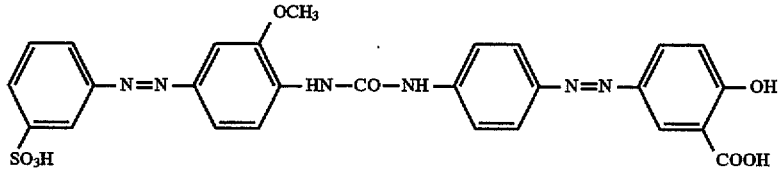
(163)
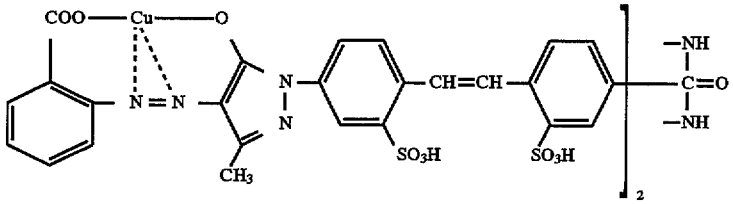
(164)
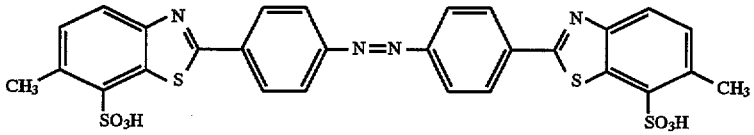
(165)
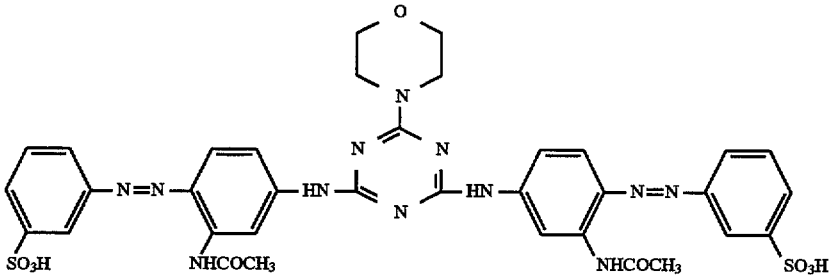
(166)
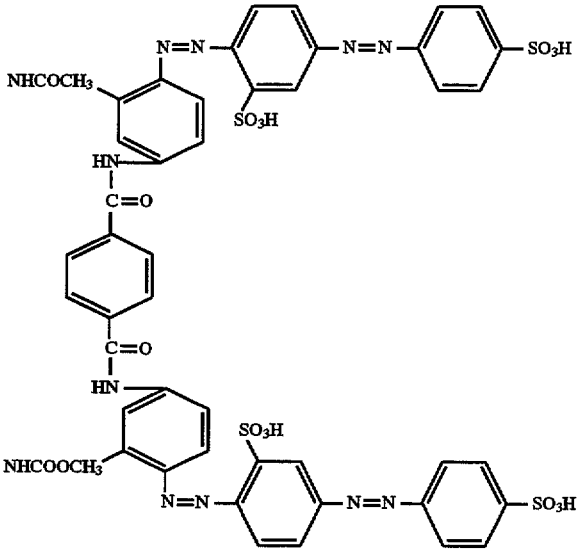

TABLE 2-continued
(167)
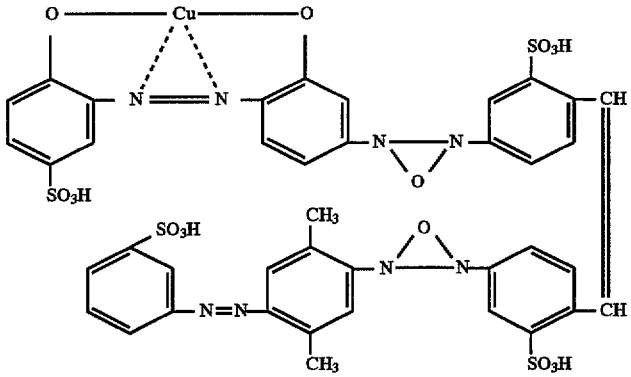
(168)
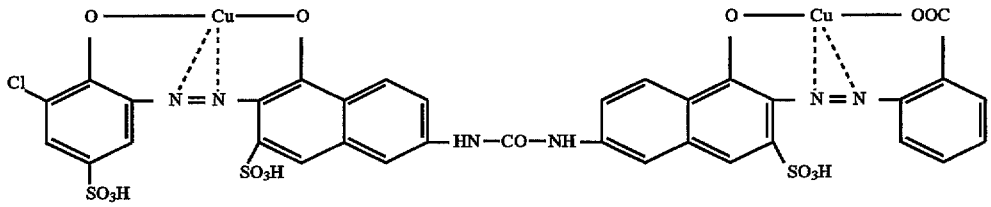
(169)
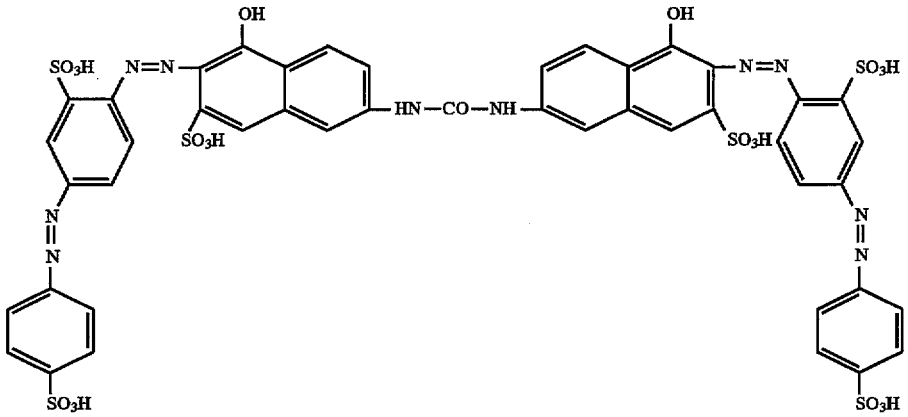
(170)
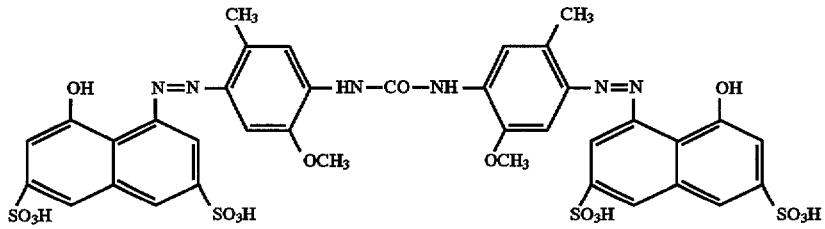
(171)
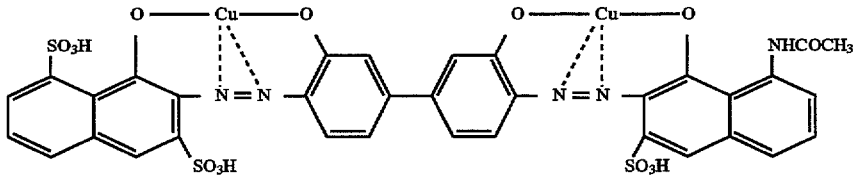

TABLE 2-continued
(172)
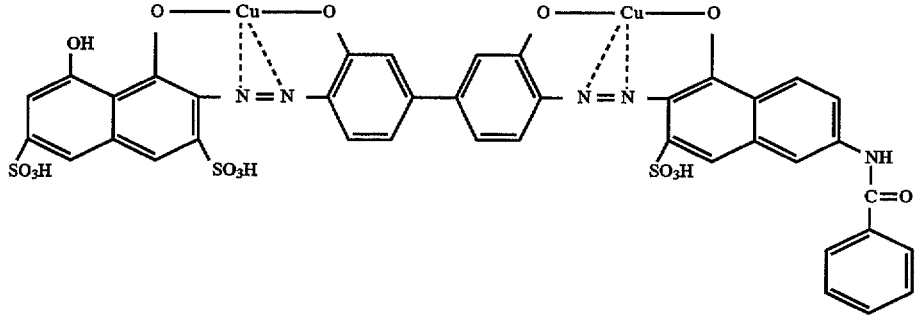
(173)
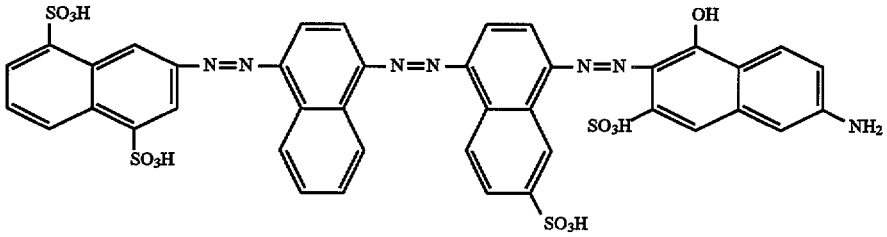
(174)
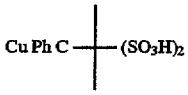
(175)
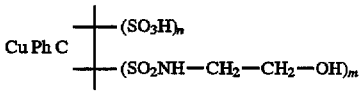
n = 1–2
m = 1–2
(176)
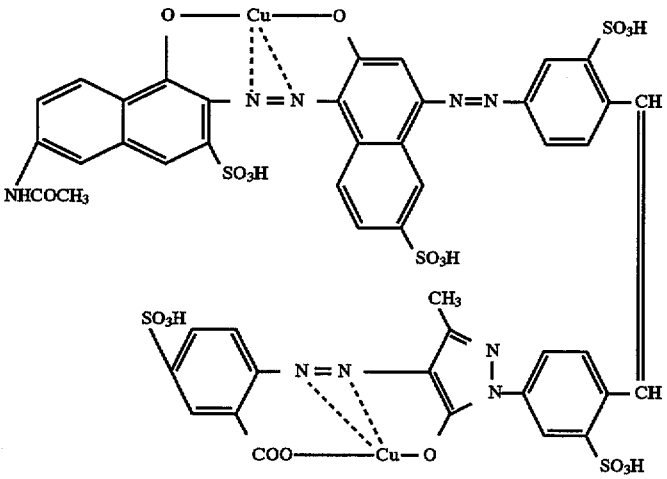
(177)
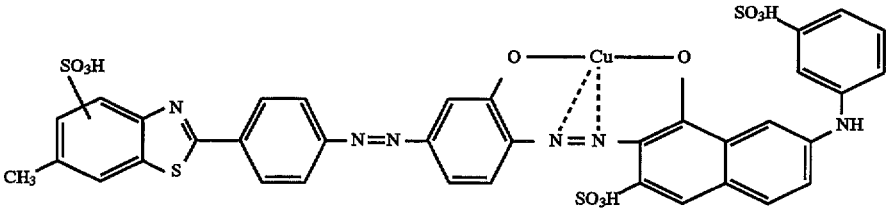
Table 3 shows the hues, initial quantities and degrees of fixation of some of the dyes listed in Table 2.

TABLE 3

| Dye of the formula | | | |
|---|---|---|---|
| No. | Hue | Amount in g/l | Degree of fixation |
| 101 | Golden yellow | 30.0 | 96% |
| 102 | Orange | 30.0 | 99% |
| 103 | Brown | 30.0 | 99% |
| 104 | Scarlet | 30.0 | 90% |
| 105 | Red | 30.0 | 98% |
| 106 | Red | 30.0 | 94% |
| 107 | Blue | 30.0 | 90% |
| 108 | Blue | 30.0 | 96% |
| 109 | Navy | 30.0 | 96% |
| 110 | Red | 17.6 | 100% |
| 111 | Red | 20.8 | 100% |
| 112 | Blue | 17.3 | 66% |
| 113 | Blue | 19.1 | 98% |
| 114 | Yellow | 30.0 | 99% |
| 115 | Yellow | 30.0 | 100% |
| 116 | Orange | 30.0 | 97% |
| 117 | Brown | 30.0 | 75% |
| 118 | Scarlet | 30.0 | 82% |
| 119 | Scarlet | 30.0 | 89% |
| 120 | Red | 30.0 | 99% |
| 121 | Bordeau | 30.0 | 97% |
| 122 | Blue | 30.0 | 89% |
| 123 | Blue | 30.0 | 83% |
| 124 | Blue | 30.0 | 83% |
| 125 | Black | 30.0 | 93% |
| 127 | Violet | 30.0 | 89% |
| 129 | Green | 30.0 | 86% |
| 130 | Turquoise | 30.0 | 91% |
| 131 | Grey | 30.0 | 75% |
| 132 | Golden yellow | 30.0 | 95% |
| 133 | Yellow | 30.0 | 90% |
| 134 | Orange | 30.0 | 99% |

TABLE 3-continued

| Dye of the formula | | | |
|---|---|---|---|
| No. | Hue | Amount in g/l | Degree of fixation |
| 135 | Brown | 30.0 | 88% |
| 136 | Red | 30.0 | 97% |
| 137 | Red | 30.0 | 93% |
| 139 | Blue | 30.0 | 99% |
| 140 | Blue | 30.0 | 99% |
| 142 | Navy | 30.0 | 99% |
| Mix 143 + 144 | Black | 30.0 | 99% |
| 145 | Golden yellow | 30.0 | 99% |
| 146 | Yellow | 30.0 | 99% |
| 147 | Orange | 30.0 | 95% |
| 148 | Red | 30.0 | 99% |
| 149 | Violet | 30.0 | 99% |
| 150 | Blue | 30.0 | 98% |
| 151 | Blue | 30.0 | 100% |
| 152 | Olive | 30.0 | 100% |
| 153 | Golden yellow | 30.0 | 90% |
| 154 | Brown | 30.0 | 100% |
| 155 | Scarlet | 30.0 | 95% |
| 156 | Blue | 30.0 | 92% |
| 157 | Turquoise | 30.0 | 97% |
| 158 | Blue | 30.0 | 94% |
| 159 | Black | 30.0 | 99% |
| 160 | Black | 30.0 | 92% |

EXAMPLE 2

A bleached and mercerized cotton cretonne fabric is padded (wet pick-up about 70%) with a mixture containing 30 g/l of a dye of the formula

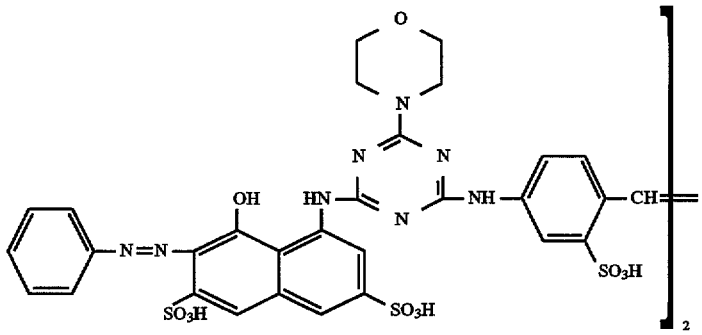

(120)

100 g/l of an oligoethylene glycol diacrylate and 85 g/l of trimethylammoniumethyl methacrylate chloride. The fabric is dried and then irradiated both sides with accelerated electrons to a dose of 1 Mrad per side. The result is a brilliant red dyeing having a degree of fixation of 96%.

EXAMPLE 3

Bleached and mercerized cotton cretonne is exhaust-dyed with the dye of the formula

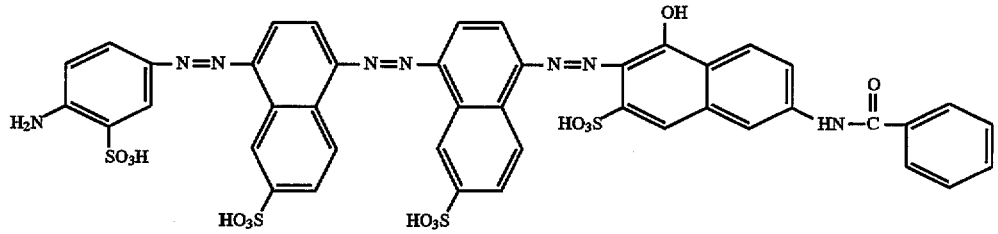

(124)

in a Vistacolor dyeing machine from ZELTEX. The substrate is treated with a wetting agent prior to the dyeing. The dyeing liquor contains 1.1% of dye based on the substrate weight and 2 g/l of liquor of Glauber salt. The liquor ratio is 20:1. The temperature is raised from 40° C. to 95° C. in the course of 30 minutes and then a further 8 g/l of liquor of Glauber salt are added. The temperature is maintained at 95° C. for 40 minutes then lowered to 80° C. in the course of 15 minutes and held constant for a further 15 minutes. Thereafter the dyeing is rinsed with demineralized water, hydroextracted and dried. The dyeing is then padded to a wet pick-up of about 70% with a solution containing 100 g/l of an oligoethylene glycol diacrylate, 85 g/l of trimethylammonium ethyl methacrylate chloride and 100 g/l of urea. The dyeing is dried, then irradiated from both sides with accelerated electrons to a dose of 1 Mrad per side, and has the fastness properties shown in Table 4.

TABLE 4

| | | Staining of adjacent fabric | |
|---|---|---|---|
| Fastness standard | Rating | Cotton | Viscose |
| ISO 105/C06 C2 | 4–5 | 5 | 5 |

EXAMPLE 4

A cotton cretonne fabric is padded to a wet pick-up of about 70% with a mixture containing the dyes as listed in Table 5 in the amounts indicated there, 100 g/l of an oligoethylene glycol diacrylate, 85 g/l of trimethylammonium ethyl methacrylate chloride, 100 g/l of urea and 10 g/l of 4-(2-hydroxyethoxy)phenyl 2-hydroxy-2-propyl ketone. The fabric is dried and then irradiated from both sides with UV light. For this the sample moves underneath a 120 watt/cm medium pressure Hg lamp on a conveyor belt at a speed of 8 m/min. The dyeings obtained have the degrees of fixation shown in Table 5. The degrees of fixation of the dyes are determined by the above-indicated method. Cloudy extracts are filtered before being spectroscoped.

TABLE 5

| Dye of the formula | | | |
|---|---|---|---|
| No. | Hue | Amount in g/l | Degree of fixation |
| 106 | Red | 20.1 | 99% |
| 110 | Red | 17.6 | 99% |
| 114 | Yellow | 30.0 | 98% |
| 115 | Yellow | 30.0 | 99% |
| 120 | Red | 30.0 | 100% |
| 124 | Blue | 30.0 | 100% |
| 128 | Violet | 30.0 | 98% |
| 151 | Blue | 30.0 | 100% |

EXAMPLE 5

A cotton cretonne fabric is padded to a wet pick-up of about 70% with a solution adjusted to pH 6–7 containing one of the dyes listed in Table 6 and the amount indicated there and 85 g/l of trimethylammonium ethyl methacrylate chloride and is then irradiated from both sides with accelerated electrons to a dose of 1 Mrad per side using an acceleration voltage of 180 kV. The fabric is then dried. The dyeings obtained have the degrees of fixation reported in Table 6.

TABLE 6

| Dye of the formula | | | |
|---|---|---|---|
| No. | Hue | Amount in g/l | Degree of fixation |
| 111 | Red | 20.8 | 96% |
| 120 | Red | 30.0 | 93% |
| 157 | Turquoise | 30.0 | 94% |

What is claimed is:

1. A process for dyeing or printing organic material, which comprises applying a dye selected from the group of dyes having a chromophore radical of the monoazo, polyazo, metal complex azo, anthraquinone, phthalocyanine, formazan, azomethine, dioxazine, phenazine, stilbene, triphenylmethane, xanthene, thioxanthone, naphthoquinone, pyrenequinone or perylenetetracarbimide series, containing no polymerizable double bond and at least one colourless cationic compound containing at least one polymerizable double bond and, optionally, one or more colourless nonionic compounds containing at least one polymerizable double bond and, optionally, further auxiliaries to the fibre material and then fixing them by means of ionizing radiation, or applying said dye and at least one colourless cationic compound containing at least one polymerizable double bond and, optionally, one or more colourless nonionic compounds containing at least one polymerizable double bond and at least one photoinitiator and also, optionally, further auxiliaries to the fibre material and then fixing them by means of UV light.

2. A process according to claim 1, wherein the colourless cationic or nonionic compound is a monomeric, oligomeric or polymeric organic compound containing at least one polymerisable double bond or a mixture thereof.

3. A process according to claim 2, wherein the cationic colourless compound is a quaternary ammonium salt having at least one polymerisable double bond, or a mixture thereof.

4. A process according to claim 1, wherein the colourless cationic compound is a quaternary ammonium salt of the formula $$(R_3R_5R_{5'}R_{5''}N)_m^+(A)^{m-} \quad (50),$$

in which $R_3$ is a radical of the formula $$CH_2{=}CX_5{-}Y_1{-}Q_4{-} \quad (50a)$$

in which $X_5$ is hydrogen, $C_{1-2}$alkyl or halogen, $Y_1$ is —CO—O—, —CO—NH— or a direct bond, $Q_4$ is —$CH_2$—

$CHOH—CH_2—$, $—(CH_2)_z—$ or $—(CH_2—CH_2—O)_z—CH_2—CH_2—$, $R_5$, $R_{5'}$ and $R_{5''}$, independently of one another are hydrogen, $C_{1-24}$alkyl or $R_3$, or the quaternary nitrogen atom in formula (50) is a part of an N heterocyclic ring which is substituted or unsubstituted and can contain further hetero atoms, A is an anion selected from the group consisting of halides, sulfates, $C_{1-2}$alkyl sulfates, thiosulfates, phosphates, carboxylates and sulfonates, z is an integer between 1 and 20, and m is 1, 2 or 3.

5. A process according to claim 1, wherein the colourless nonionic compound is selected from the group consisting of acrylates, methacrylates, acrylamides and methacrylamides.

6. A process according to claim 4, wherein the colourless cationic compound is a quaternary ammonium salt of the formula $$CH_2=CH—CO—O—CH_2—CH_2—N(CH_3)_3^+A^- \quad (50b),$$

$$CH_2=C(CH_3)—CO—O—CH_2—CH_2—N(CH_3)_3^+A^- \quad (50c),$$

$$CH_2=C(CH_3)—CO—NH—CH_2—CH_2—CH_2—N(CH_3)_3^+A^- \quad (50d)$$

$$CH_2=C(CH_3)—CO—O—CH_2—CHOH—CH_2—N(CH_3)_3^+A^- \quad (50e)$$

or $$(CH_3)_2(CH_2=CH—CH_2)_2N^+A^- \quad (50f)$$

in which A is an anion selected from the group consisting of halides, sulfates, $C_{1-2}$alkyl sulfates, thiosulfates, phosphates, carboxylates and sulfonates.

7. A process according to claim 5, wherein the colourless nonionic compound is a diacrylate of the formula $$CH_2=CR_{37}—CO—O—(CH_2—CH_2—O)_w—CO—CR_{37}=CH_2 \quad (51)$$

in which $R_{37}$ is hydrogen or $C_{1-2}$alkyl and w is an integer between 1 and 12.

8. A process according to claim 5, wherein the colourless nonionic compound is acrylate of the formula $$CH_2=CR_{37}—Y_1—Q_4—R_{11} \quad (10)$$

in which $Y_1$ is —CO—O—, —CO—NH— or a direct bond, $Q_4$ is $—CH_2—CHOH—CH_2—$, $—(CH_2)_t—$ or $—(CH_2—CH_2—O)_t—CH_2—CH_2—$, $R_{37}$ is hydrogen or $C_{1-2}$alkyl and $R_{11}$ is 2-oxazolidon-3-yl.

9. A process according to claim 1, wherein a reactive dye having monoazo- or disazo dye radicals of the formula $$D_1—N=N—(M—N=N)_u—K— \quad (6a),$$

$$—D_1—N=N—(M—N=N)_u—K \quad (6b)$$

or $$—D_1—N=N—(M—N=N)_u—K— \quad (6c),$$

or a metal complex derived therefrom is used; $D_1$ is the radical of a diazo component of the benzene or naphthalene series, M is the radical of a middle component of the benzene or naphthalene series, and K is the radical of a coupling component of the benzene, naphthalene, pyrazolone, 6-hydroxy-2-pyridone or acetoacetarylamide series, where $D_1$, M and K can carry substituents selected from the group consisting of hydroxy, amino, methyl, ethyl, methoxy, ethoxy, substituted or unsubstituted alkanoylamino having 2 to 4 carbon atoms, substituted or unsubstituted benzoylamino, halogen and fibre-reactive radicals; u is 0 or 1, and $D_1$, M and K contain at least one sulfo group, or a dye having the radical of a disazo dye of the formula $$—D_1—N=N—K—N=N—D_2 \quad (7a)$$

or $$—D_1—N=N—K—N=N—D_2— \quad (7b),$$

where $D_1$ and $D_2$ are independently of each other the radical of a disazo component of the benzene or naphthalene series and K is the radical of a coupling component of the naphthalene series and $D_1$, $D_2$ and K can carry substituents selected from the group consisting of hydroxyl, amino, methyl, ethyl, methoxy, ethoxy, substituted or unsubstituted alkanoylamino having 2 to 4 carbon atoms, substituted or unsubstituted benzoylamino, halogen and fibre-reactive radicals and $D_1$, $D_2$ and K together contain at least two sulfo groups, or a dye having the radical of a formazan dye of the formula

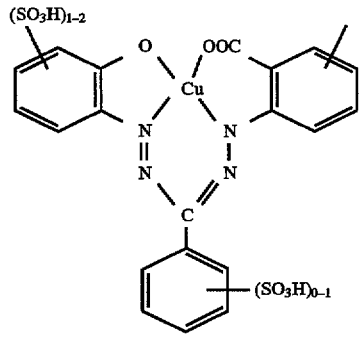

(8a)

or

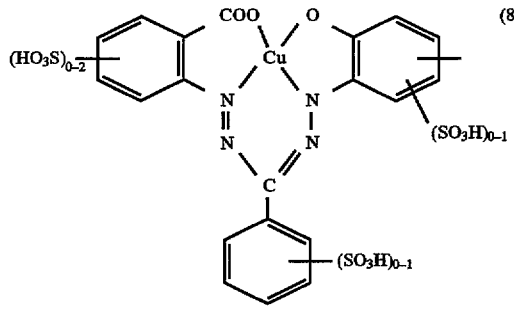

(8b)

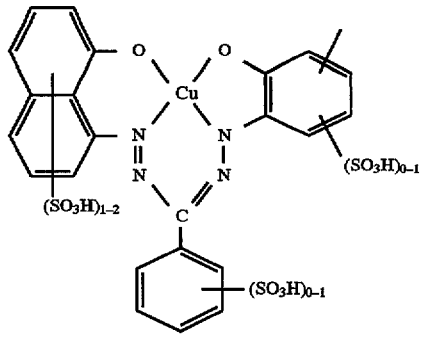

(8c)

or

-continued (8d)

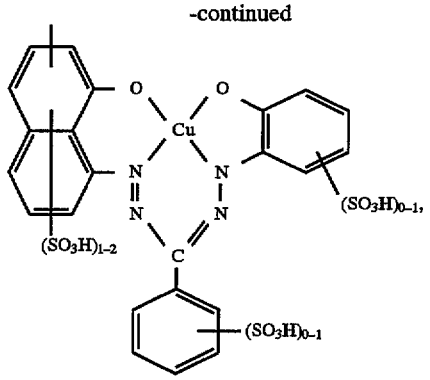

where the benzene rings can be further substituted by alkyl having 1 to 4 carbon atoms, alkoxy having 1 to 4 carbon atoms, alkylsulfonyl having 1 to 4 carbon atoms, halogen or carboxyl, or a dye having the radical of an anthraquinone dye of the formula (9)

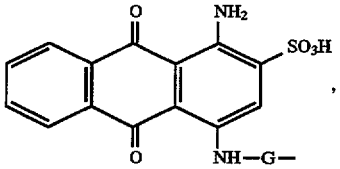

where G is a phenylene, cyclohexylene, phenylenemethylene or $C_2$–$C_6$alkylene radical, the anthraquinone nucleus can be substituted by a further sulfo group, and phenyl G can be substituted by alkyl having 1 to 4 carbon atoms, alkoxy having 1 to 4 carbon atoms, halogen, carboxyl or sulfo, and the dye contains at least 2 sulfo groups, or a dye having the radical of a phthalocyanine dye of the formula (10)

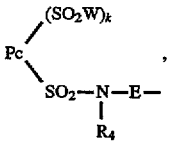

where Pc is the radical of a copper or nickel phthalocyanine, W is —OH and/or —$NR_5R_{5'}$; $R_5$ and $R_{5'}$, are independently of each other hydrogen or alkyl having 1 to 4 carbon atoms, which can be substituted by hydroxyl or sulfo, $R_4$ is hydrogen or alkyl having 1 to 4 carbon atoms, E is a phenylene radical which can be substituted by alkyl having 1 to 4 carbon atoms, halogen, carboxyl or sulfo, or an alkylene radical having 2 to 6 carbon atoms, and k is 1, 2 or 3, or a dye having the radical of a dioxazine dye of the formula (11a)

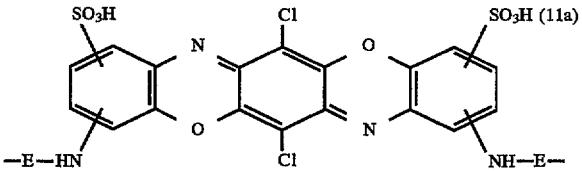

or

-continued (11b)

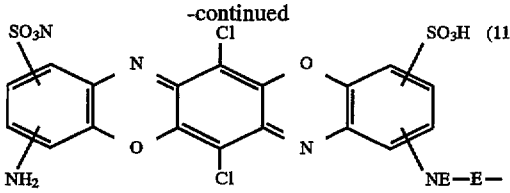

or (11c)

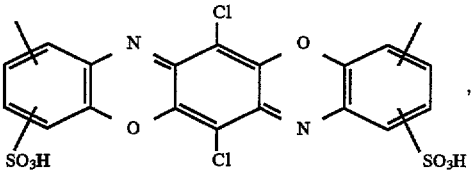

where E is a phenylene radical which can be substituted by alkyl of 1 to 4 carbon atoms, halogen, carboxyl or sulfo or is an alkylene radical having 2 to 6 carbon atoms, and the outer benzene rings in the formulae (11a), (11b) and (11c) can be further substituted by alkyl having 1 to 4 carbon atoms, alkoxy having 1 to 4 carbon atoms, acetylamino, nitro, halogen, carboxyl, sulfo or —$SO_2$—Z, where Z is β-sulfatoethyl, β-thiosulfatoethyl, β-phosphatoethyl, β-acyloxyethyl or β-haloethyl.

10. A process according to claim 1, wherein there is used a phthalocyanine dye, a dioxazine dye or a dye of the formula $$A_1—B_2—A_2 \quad (34a)$$

where $B_2$ is a bridge member and $A_1$ and $A_2$ are independently of each other the radical of a monoazo, polyazo, metal complex azo, stilbene or anthraquinone dye, or where $B_2$ and $A_1$ are each as defined and $A_2$ is a phenyl or naphthyl radical substituted by a heterocyclic radical or a benzoylamino or phenylamino radical or is a reactive group as defined above, or where $B_2$ is the direct bond and $A_1$ and $A_2$ are each the radical of a metal complex azo dye, or a dye of the formula $$A_3—NH—L \quad (34b),$$

where $A_3$ is the chromophore radical of an organic dye and L is a radical of the formulae

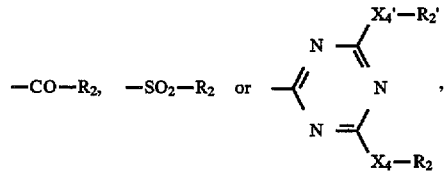

where $X_4$ and $X_4'$ are independently of each other a direct bond, NH, NR, O or S, $R_2$ and $R_2'$ are independently of each other hydrogen, aromatic, aliphatic or cycloaliphatic radicals which are optionally substituted by halogen, OR", COOR", $SO_3H$ or aralkyl, which is optionally substituted by halogen, OR", COOR" or $SO_3H$, where R" is hydrogen or $C_1$–$C_6$alkyl.

11. A process according to claim 1, wherein a dye is used together with at least one quaternary ammonium salt selected from the group consisting of:

$$CH_2=CH—CO—O—CH_2—CH_2—N(CH_3)_3^+A^- \quad (50b),$$

$$CH_2=C(CH_3)—CO—O—CH_2—CH_2—N(CH_3)_3^+A^- \quad (50c),$$

$$CH_2{=}C(CH_3){-}CO{-}NH{-}CH_2{-}CH_2{-}CH_2{-}N(CH_3)_3^+A^- \quad (50d),$$

$$CH_2{=}C(CH_3){-}CO{-}O{-}CH_2{-}CHOH{-}CH_2{-}N(CH_3)_3^+A^- \quad (50e)$$

or $$(CH_3)_2(CH_2{=}CH{-}CH_2)_2N^+A^- \quad (50f)$$

where A is an anion selected from the group consisting of halides, sulfates, $C_{1-2}$alkyl sulfates, thiosulfates, phosphates, carboxylates and sulfonates, and an acrylic compound of the formula $$CH_2{=}CR_{37}{-}CO{-}O{-}(CH_2{-}CH_2{-}O)_{w'}{-}CO{-}CR_{37}{=}CH_2 \quad (51a),$$

where $R_{37}$ is hydrogen or $C_{1-2}$alkyl and w' is 1 to 9.

12. A process according to claim 1, wherein a dye is used together with at least one quaternary ammonium salt selected from the group consisting of:

$$CH_2{=}CH{-}CO{-}O{-}CH_2{-}CH_2{-}N(CH_3)_3^+A^- \quad (50b),$$

$$CH_2{=}C(CH_3){-}CO{-}O{-}CH_2{-}CH_2{-}N(CH_3)_3^+A^- \quad (50c),$$

$$CH_2{=}C(CH_3){-}CO{-}NH{-}CH_2{-}CH_2{-}CH_2{-}N(CH_3)_3^+A^- \quad (50d),$$

$$CH_2{=}C(CH_3){-}CO{-}O{-}CH_2{-}CHOH{-}CH_2{-}N(CH_3)_3^+A^- \quad (50e)$$

or $$(CH_3)_2(CH_2{=}CH{-}CH_2)_2N^+A^- \quad (50f)$$

where A is an anion selected from the group consisting of halides, sulfates, $C_{1-2}$alkyl sulfates, thiosulfates, phosphates, carboxylates and sulfonates, a reactive acrylic compound of the formula $$CH_2{=}CR_{37}{-}Y_1{-}Q_4{-}R_{11} \quad (52),$$

where $Y_1$ is —CO—O—, —CO—NH— or a direct bond, $Q_4$ is $-CH_2-CHOH-CH_2-$, $-(CH_2)_z-$ or $-(CH_2-CH_2-O)_z-CH_2-CH_2$, $R_{37}$ is hydrogen or $C_{1-2}$alkyl and $R_{11}$ is 3-(2-oxazolidone), and a bireactive acrylic compound of the formula $$CH_2{=}CR_{37}{-}CO{-}O{-}(CH_2{-}CH_2{-}O)_{w'}{-}CO{-}CR_{37}{=}CH_2 \quad (51a),$$

where $R_{37}$ is hydrogen or $C_1$–$C_2$alkyl and w' is 1 to 9.

13. A process according to claim 1, wherein the UV source used is one or more conventional UV light producing lamps.

14. A process according to claim 13, wherein the conventional UV light producing lamp is selected from the group consisting of high-, medium- or low-pressure mercury vapour lamps, halogen lamps, metal halide lamps, xenon lamps, tungsten lamps, carbon arc lamps, fluorescent lamps, H lamps, D lamps, superactinic fluorescent tubes and lasers.

15. A process according to claim 14, wherein an undoped or iron- or gallium-doped high-, medium- or low-pressure mercury vapour lamp is used.

16. A process according to claim 15, wherein a mercury high-pressure lamp or an iron-doped mercury medium-pressure lamp is used.

17. A process according to claim 1, wherein the photoinitiator is selected from the group consisting of 2,3-hexanedione, diacetylacetophenone, benzoin, benzoin ethers, 2,2-diethoxyacetophenone, 2,2-dimethoxyacetophenone, benzophenone, phenyl 1-hydroxycyclohexyl ketone, the ketone of the formula

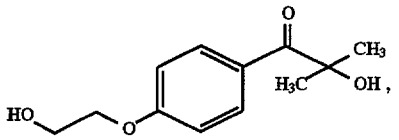

(80)

acylphosphine oxides diazomethane, azobisisobutyronitrile, hydrazine, phenylhydrazine, trimethylbenzylammonium chloride, benzenesulfonate, diphenyl disulfide, tetramethylthiuram disulfide and water-soluble copolymerisable photosensitizers.

18. A process according to claim 17, wherein a photoinitor of the formula (80) is used.

19. A process according to claim 1, wherein the ionizing radiation used comprises particle-accelerator-produced electron beams or β- or γ-rays.

20. A process according to claim 19, wherein an irradiation dose of 0.1 to 15 Mrad is chosen.

21. A process according to claim 1, wherein the irradiation is carried out under protective gas atmosphere.

22. A process according to claim 1, wherein the printing is effected by means of an ink-jet printer.

23. A process according claim 1, wherein the fixation is carried out continuously.

24. A process according claim 1, wherein not only the dyeing or printing but also the fixation of the dyes on the fibre material is effected continuously.

25. A process according to claim 1, wherein the fibre material used is wool, silk, hair, polyvinyl, polyacrylonitrile, polyester, synthetic polyamide, polypropylene or polyurethane fibres, cellulose-containing fibres or glass fibres.

26. A process according to claim 25, wherein dyed or printed cellulose fibres or cellulose-containing fibres and also polyester fibres are used.

27. A process according to claim 25, wherein cellulose fibres, polyester-cellulose combination weaves and knits and also intimate polyester-cellulose fibre blends are used.

28. A process according to claim 1, wherein the dyed or printed fibre material is irradiated in the wet state.

29. A process according to claim 1, wherein the dyed or printed fibre material is irradiated in the dry state.

30. A process according to claim 1, wherein the irradiation takes place on one or both sides of the fibre material.

31. A process according to claim 1, wherein the steps are applying a dye containing no polymerizable double bond together with at least one colourless cationic compound containing at least one polymerizable double bond and, optionally, one or more colourless nonionic compounds containing at least one polymerizable double bond and, optionally, further auxiliaries to the fibre material and then fixing them by means of ionizing radiation, or applying a dye containing no polymerizable double bond together with at least one colourless cationic compound containing at least one polymerizable double bond and, optionally, one or more colourless nonionic compounds containing at least one polymerizable double bond and at least one photoinitiator and also, optionally, further auxiliaries to the fibre material and then fixing them by means of UV light.

32. A process according to claim 1, wherein the fibre material is first dyed with dyes containing no polymerizable bond and subsequently with at least one colourless cationic compound containing at least one polymerizable double bond and, optionally, one or more colourless nonionic compound(s) containing at least one polymerizable double bond and, optionally, further auxiliaries are applied to the fibre material and fixed.

33. The irradiated dyed or printed fibre material of the process according to claim 1.

34. A process according to claim 2, wherein a mixture of at least one quaternary ammonium salt of the formula $$(R_3R_5R_{5'}R_{5''}N)_m^+(A)^{m-} \quad (50),$$

in which $R_3$ is a radical of the formula $$CH_2{=}CX_5{-}Y_1{-}Q_4{-} \quad (50a)$$

in which $X_5$ is hydrogen, $C_{1-2}$alkyl or halogen, $Y_1$ is —CO—O—, —CO—NH— or a direct bond, $Q_4$ is —$CH_2$—CHOH—$CH_2$—, —$(CH_2)_z$— or —($CH_2$—$CH_2$—O)$_z$—$CH_2$—$CH_2$—, $R_5$, $R_{5'}$, and $R_{5''}$, independently of one another are hydrogen, $C_{1-24}$alkyl or $R_3$, or the quaternary nitrogen atom in formula (50) is a part of an N heterocyclic ring which is substituted or unsubstituted and can contain further hetero atoms, A is an anion selected from the group consisting of halides, sulfates, $C_{1-2}$alkyl sulfates, thiosulfates, phosphates, carboxylates and sulfonates, z is an integer between 1 and 20, and m is 1, 2 or 3, with at least one colourless nonionic compound selected from the group consisting of acrylates, methacrylates, acrylamides and methacrylamides is used.

35. A process according to claim 34, wherein a mixture of at least one quaternary ammonium salt of the formula $$CH_2{=}CH{-}CO{-}O{-}CH_2{-}CH_2{-}N(CH_3)_3^+A^- \quad (50b),$$

$$CH_2{=}C(CH_3){-}CO{-}O{-}CH_2{-}CH_2{-}N(CH_3)_3^+A^- \quad (50c),$$

$$CH_2{=}C(CH_3){-}CO{-}NH{-}CH_2{-}CH_2{-}CH_2{-}N(CH_3)_3^+A^- \quad (50d),$$

$$CH_2{=}C(CH_3){-}CO{-}O{-}CH_2{-}CHOH{-}CH_2{-}N(CH_3)_3^+A^- \quad (50e)$$

or $$(CH_3)_2(CH_2{=}CH{-}CH_2)_2N^+A^- \quad (50f)$$

in which A is an anion selected from the group consisting of halides, sulfates, $C_{1-2}$alkyl sulfates, thiosulfates, phosphates, carboxylates and sulfonates, with at least one diacrylate of the formula $$CH_2{=}CR_{37}{-}CO{-}O{-}(CH_2{-}CH_2{-}O)_w{-}CO{-}CR_{37}{=}CH_2 \quad (51)$$

in which $R_{37}$ is hydrogen or $C_{1-2}$alkyl and w is an integer between 1 and 12 is used.

36. A process according to claim 34, wherein a mixture of at least one quaternary ammonium salt of the formula $$CH_2{=}CH{-}CO{-}O{-}CH_2{-}CH_2{-}N(CH_3)_3^+A^- \quad (50b),$$

$$CH_2{=}C(CH_3){-}CO{-}O{-}CH_2{-}CH_2{-}N(CH_3)_3^+A^- \quad (50c),$$

$$CH_2{=}C(CH_3){-}CO{-}NH{-}CH_2{-}CH_2{-}CH_2{-}N(CH_3)_3^+A^- \quad (50d),$$

$$CH_2{=}C(CH_3){-}CO{-}O{-}CH_2{-}CHOH{-}CH_2{-}N(CH_3)_3^+A^- \quad (50e)$$

or $$(CH_3)_2(CH_2{=}CH{-}CH_2)_2N^+A^- \quad (50f)$$

in which A is an anion selected from the group consisting of halides, sulfates, $C_{1-2}$alkyl sulfates, thiosulfates, phosphates, carboxylates and sulfonates, with acrylates of the formula $$CH_2{=}CR_{37}{-}CO{-}O{-}(CH_2{-}CH_2{-}O)_w{-}CO{-}CR_{37}{=}CH_2 \quad (51)$$

and of the formula $$CH_2{=}CR_{37}{-}Y_1Q_4{-}R_{11} \quad (10)$$

in which $R_{37}$ is hydrogen or $C_{1-2}$alkyl, w is an integer between 1 and 12, $Y_1$ is —CO—O—, —CO—NH— or a direct bond, $Q_4$ is $CH_2$—CHOH—$CH_2$—, —$(CH_2)_t$— or —($CH_2$—$CH_2$—O)$_t$—$CH_2$—$CH_2$—, $R_{37}$ is hydrogen or $C_{1-2}$alkyl and $R_{11}$ is 2-oxazolidon-3-yl is used.

37. A process according to claim 17, wherein the photoinitiator is 2,4,6-trimethylbenzoyldiphenylphosphine oxide, the ketone of the formula (80), or the compound of the formula

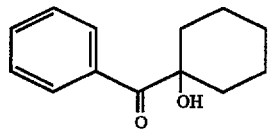

(80a)

38. A process according to claim 17, wherein the photoinitiator of the formula

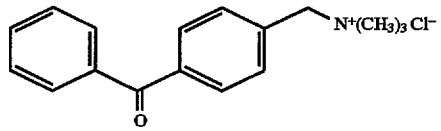

(80b)

is used together with a co-initiator of the formula

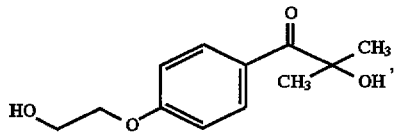

(80)

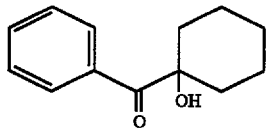

(80a)

or

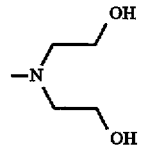

(80c)

39. A process according to claim 17, wherein benzophenone is used together with a co-initiator of the formula

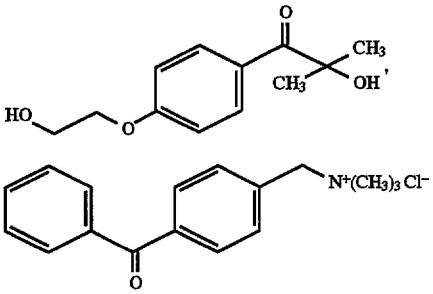
(80)
(80b)
-continued
or
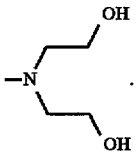
(80c)
* * * * *